US005272044A

United States Patent [19]

Nishigaki et al.

[11] Patent Number: 5,272,044

[45] Date of Patent: Dec. 21, 1993

[54] SILVER HALIDE PHOTOGRAPHIC MATERIAL AND PROCESSING SOLUTION AND PROCESS FOR THE PROCESSING THEREOF

[75] Inventors: Junji Nishigaki; Akihiko Ikegawa; Masaki Okazaki; Minoru Yamada; Nobuhiko Uchino, all of Kanagawa, Japan

[73] Assignee: Fuji Photo Film Co., Ltd., Kanagawa, Japan

[21] Appl. No.: 936,728

[22] Filed: Aug. 31, 1992

Related U.S. Application Data

[63] Continuation of Ser. No. 608,498, Nov. 2, 1990, abandoned.

[30] Foreign Application Priority Data

Nov. 2, 1989 [JP] Japan ..... 1-286660
Nov. 7, 1989 [JP] Japan ..... 1-289312

[51] Int. Cl.[5] ..... G03C 7/407

[52] U.S. Cl. ..... 430/393; 430/372; 430/429; 430/430; 430/445; 430/446; 430/486; 430/490

[58] Field of Search ..... 430/372, 393, 399, 400, 430/429, 430, 434, 446, 455, 486, 490, 566, 615, 963, 966, 204, 302, 570

[56] References Cited

U.S. PATENT DOCUMENTS

| | | | |
|---|---|---|---|
| 3,904,412 | 9/1975 | Serrien et al. | 430/460 |
| 4,212,672 | 7/1980 | Mihara et al. | 430/302 |
| 4,501,811 | 2/1985 | Saikawa et al. | 430/204 |
| 4,770,961 | 9/1988 | Tanaka et al. | 430/204 |

FOREIGN PATENT DOCUMENTS

| | | |
|---|---|---|
| 1419121 | 12/1975 | United Kingdom . |
| 1419122 | 12/1975 | United Kingdom . |

OTHER PUBLICATIONS

Chemical Abstracts No. 129916e, vol. 81, 1974.
Chemical Abstracts No. 115:207999w, vol. 115, 1991.

*Primary Examiner*—Hoa Van Le
*Attorney, Agent, or Firm*—Sughrue, Mion, Zinn, Macpeak & Seas

[57] ABSTRACT

Disclosed is a silver halide photographic material comprising a compound represented by the general formula (I), (II), or a salt thereof or a compound represented by the general formula (III), with these groups being defined as in the specification:

(I)

(II)

(III)

also disclosed is a method for the processing of a silver halide photographic material, which comprises processing a silver halide photographic material in the presence of a compound represented by the general formula (I) or (II) or a salt thereof or a compound represented by the general formula (III).

11 Claims, No Drawings

SILVER HALIDE PHOTOGRAPHIC MATERIAL AND PROCESSING SOLUTION AND PROCESS FOR THE PROCESSING THEREOF

This is a continuation of application Ser. No. 07/608,498 filed Nov. 2, 1990, now abandoned.

FIELD OF THE INVENTION

The present invention relates to a silver halide photographic material and a processing solution and a process for the processing thereof. More particularly, the present invention relates to a process for the processing of a silver halide photographic material which provides improvements in photographic properties and which provides improved ability to inhibit residual coloration.

BACKGROUND OF THE INVENTION

With progress and development in the field of electronics; there has also arisen a demand for greater rapidity in all fields and the field of silver halide photographic processing is no exception.

In particular, the need for rapid processing has greatly increased in the development processing of sheet-shaped photographic materials such as photographic materials for the graphic arts, X-ray photographic materials, photographic materials for scanners, photographic materials for CRT image recording and the like.

Furthermore, rapid development processing has the advantage that with more rapid development processing, smaller tank capacities are required to develop a unit quantity of photographic material in a unit time, and hence smaller automatic processor may be employed. Rapid development processing is therefore of great importance.

However, with the increase in the development processing speed, more often a problem occurs in that sensitizing dyes contained in silver halide photographic materials do not elute during processing, leaving the inside of the photographic materials discolored (so-called residual coloration) or a problem occurs in that sensitizing dyes are delayed in desorption from silver halide grains, deteriorating photographic properties (e.g., inhibition of development, fixation and bleach).

Various approaches for eliminating residual coloration are known. For example, *Research Disclosure*, No. 20733, vol. 207, Jul. 1981, discloses a method which comprises incorporating a water-soluble stilbene compound or a nonionic surface active agent or a mixture thereof into a developer, a method which comprises processing a photographic element which has been developed, bleached and fixed with an oxidizing agent to destroy dyes, and a method which comprises using a persulfate bath as a bleaching bath. However, these methods are not sufficiently effective to eliminate much residual coloration. Further, these methods do not positively accelerate desorption and elution of sensitizing dyes. These methods are not suitable particularly for rapid processing.

Methods which comprise the use of an additive for processing solutions as disclosed in JP-A-64-4739, JP-A-64-15734, JP-A-1-9451, JP-A-1-35440, JP-A-1-21444, JP-A-1-35441, and JP-A-1-159645 (the term "JP-A" as used herein means an "unexamined published Japanese patent application") are effective. However, these methods do not necessarily provide satisfactory results.

On the other hand, methods which comprise the use of an additive for destroying the association of sensitizing dyes as disclosed in U.S. Pat. No. 4,906,553 are excellent. In particular, a method as disclosed in U.S. Pat. No. 4,906,553 is very effective. However, these methods tend to have weaker effects on aged processing solutions or processing solutions which have been used for running processing.

SUMMARY OF THE INVENTION

Therefore an object of the present invention is to provide a silver halide photographic material which is suitable for rapid processing.

Another object of the present invention is to provide a processing solution which enables rapid processing.

A further object of the present invention is to provide a process for rapid development processing.

A still further object of the present invention is to provide a silver halide photographic material and a processing solution and a process for the processing thereof which overcomes the problem of residual coloration which is caused by non-eluted sensitizing dyes which may remain after rapid processing or the problem of deterioration in the photographic properties.

Yet a still further object of the present invention to provide a silver halide photographic material and a processing solution and a process for the processing thereof which has excellent preservability and adaptability to running processing.

These and other objects of the present invention will become more apparent from the following detailed description and examples.

These and other objects of the present invention are accomplished in one embodiment with a silver halide photographic material, comprising a compound represented by the general formula (I) or (II) or a salt thereof or a compound represented by the general formula (III):

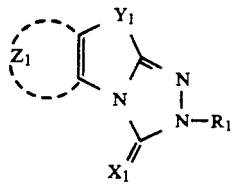

(I)

wherein in the general formula (I), $Z_1$ represents a nonmetallic atom group required to form an unsaturated ring;

$Y_1$ represents an oxygen atom, a sulfur atom or

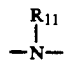

in which $R_{11}$ represents a hydrogen atom, an alkyl group, an aryl group, an acyl group, an allyl group, an alkanesulfonyl group or an arylenesulfonyl group;

$R_1$ represents an alkyl group, an acyl group, an alkanesulfonyl group or an arylenesulfonyl group; and $X_1$ represents an oxygen atom or a sulfur atom;

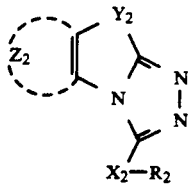

(II)

wherein in the general formula (II), $Z_2$ represents a nonmetallic atom group required to form an unsaturated ring;

$Y_2$ represents an oxygen atom, a sulfur atom or

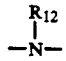

in which $R_{12}$ has the same meaning as $R_{11}$;

$R_2$ represents an alkyl group; and $X_2$ represents an oxygen atom, a methylene group

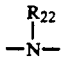

in which $R_{22}$ has the same meaning as $R_{11}$; and

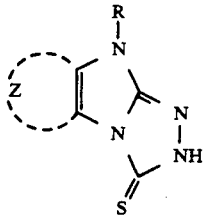

(III)

wherein in the general formula (III),

Z represents a nonmetallic atom group required to form an unsaturated ring; and

R represents a hydrogen atom, an alkyl group, an aryl group, an acyl group, an allyl group, an alkanesulfonyl group or an arylenesulfonyl group.

These and other objects of the present invention are also accomplished in another embodiment by an aqueous solution for processing a silver halide photographic material, this aqueous solution containing a compound represented by the general formula (I) or (II) or a salt thereof or a compound represented by the general formula (III).

These and other objects of the present invention are also accomplished in another embodiment by a process for processing of a silver halide photographic material, which comprises processing a silver halide photographic material in the presence of a compound represented by the general formula (I) or (II) or a salt thereof or a compound represented by the general formula (III).

DETAILED DESCRIPTION OF THE INVENTION

The compounds represented by the general formulae (I), (II) and (III) are described further hereinafter.

Preferred examples of the unsaturated rings formed by $Z_1$ or $Z_2$ include monocyclic and polycyclic unsaturated carbocyclic and heterocyclic rings such as a benzene ring, a naphthalene ring, and a 5- or 6-membered heterocyclic ring. These rings may contain substituents. Specific examples of suitable substituents are the same as defined later for Z. Particularly preferred of these 5- or 6-membered heterocyclic rings are a pyridine ring, a pyrimidine ring, a pyrazine ring, a furan ring, a thiene ring, a pyrrole ring, a triazine ring, an imidazole ring, a quinazoline ring, a purine ring, a quinoline ring, an acridine ring, an indole ring, a thiazole ring, an oxazole ring, a selenazole ring, a furazalane ring, and a heterocyclic ring in which these heterocyclic rings are further condensed with a benzo condensed ring or a naphtho condensed ring or to each other.

The alkyl group, aryl group, acyl group, allyl group, alkanesulfonyl group or arylenesulfonyl group represented by $R_1$, $R_2$, $R_{11}$, $R_{12}$ or $R_{22}$ may contain substituents. These groups (including a substituent) each preferably contains 10 or less carbon atoms. Preferred examples of such substituents include an amino group, an ammonio group, a hydroxyl group, a carboxyl group, a sulfo group, a phosphonic acid, a sulfonyl group, a sulfonamido group, an amide group, an acyl group, a cyano group, an alkoxycarbonyl group, an aryloxycarbonyl group, a ureide group, an alkoxy group, an aryloxy group, an alkylthio group, an arylthio group, a nitrogen-containing heterocyclic residue, an alkyl group, and an aryl group. These substituents may be further substituted.

Preferred examples of $R_1$ and $R_2$ include an alkyl group substituted by an amino group, a dialkylamino group or a sulfonamido group, and an unsubstituted an alkyl group. Particularly preferred of these alkyl groups is an alkyl group substituted by a dialkylamino group.

Preferred examples of $R_{11}$ and $R_{12}$ include an alkyl group substituted by a dialkylamino group, an unsubstituted alkyl group, and an alkoxy group. Preferred examples of $R_{22}$ include a hydrogen atom.

Particularly preferred of the groups represented by $Y_1$ is a sulfur atom. Particularly preferred among the groups represented by $X_1$ is an oxygen atom.

Preferred of the groups represented by $X_2$ is —O— or —NH—.

Preferred of the unsaturated rings formed by Z are a benzene ring, a naphthalene ring, and a 5- or 6-membered heterocyclic ring. Preferred examples of such 5- or 6-membered heterocyclic ring include a pyridine ring, a pyrimidine ring, a pyrazine ring, a furan ring, a thiene ring, a pyrrole ring, a triazine ring, an imidazole ring, a quinazoline ring, a purine ring, a quinoline ring, an acridine ring, an indole ring, a thiazole ring, an oxazole ring, a selenazole ring, a furazalane ring, and a heterocyclic ring in which these heterocyclic rings are condensed with a benzo condensed ring or a naphtho condensed ring or to each other.

The rings represented by Z include those containing substituents. Specific examples of suitable substituents include a hydroxyl group, an alkoxy group, an aryloxy group, a carboxyl group, an amino group, an ammonio group, a sulfo group, a phosphonic acid group, a sulfonyl group, a ureide group, an acyl group, an alkylthio group, an arylthio group, a carbamoyl group, a sulfamoyl group, an acylamino group, a sulfonamido group, an oxo group, a halogen group, a cyano group, a nitro group, an alkyl group, an alkenyl group, an alkynyl group, and an aryl group. These groups may contain substituents.

R represents a hydrogen atom, an alkyl group (preferably an alkyl group containing 4 or less carbon atoms, e.g., methyl, ethyl, propyl), an aryl group (preferably an aryl group containing a benzene nucleus, e.g., phenyl), an acyl group (preferably an acyl group containing 10 or less carbon atoms, e.g., acetyl, benzoyl), an allyl group, an alkanesulfonyl group (preferably an alkanesulfonyl group containing 3 or less carbon atoms, e.g., methanesulfonyl, ethanesulfonyl, propanesulfonyl), or an arylenesulfonyl group (preferably an arylenesulfonyl group containing a benzene nucleus, e.g., benzenesulfonyl, p-toluenesulfonyl).

Examples of the alkyl group, aryl group, acyl group, alkanesulfonyl group or arylenesulfonyl group represented by R include those containing substituents. Examples of such substituents include a hydroxyl group, an alkoxy group, an aryloxy group, a carboxyl group, an amino group, an ammonio group (examples of amino groups and ammonio groups include those containing substituents; two or more such substituents may be connected to each other to form a ring such as a morpholino ring), a sulfo group, a phosphono group, a sulfonyl group, a ureide group, an acyl group, an alkylthio group, an arylthio group, a carbamoyl group, a sulfamoyl group (examples of carbamoyl groups and sulfamoyl groups include those containing substituents; two or more such substituents may be connected to each other to form a ring such as a morpholino ring), an acylamino group, a sulfonamido group, an oxo group, a halogen group, a cyano group, and a nitro group. If possible, these substituents and functional groups may be further substituted. Of the functional groups of compounds of the general formula (III), a carboxyl group, a sulfo group, and a phosphono group may be in the form of salt with an alkali metal (e.g., sodium, potassium) or monovalent positive atom (e.g., NH4 ) The amino group may form a salt with various acids such as hydrochloric acid, sulfuric acid, nitric acid, phosphoric acid, oxalic acid and acetic acid. Particularly preferred examples of R include a hydrogen atom and an alkyl group. Preferred examples of substituents for the alkyl group include a dialkylamino group, a sulfonic acid group, and a phosphonic acid group.

The compound represented by the general formula (I), (II) or (III) preferably has a molecular weight of 600 or less, more preferably 500 or less. The compound represented by the general formula (I), (II) or (III) is preferably water-soluble. Such a compound is preferably soluble in water in a proportion of 0.04 g or more, particularly 0.08 g or more, per 100 cc of water at a temperature of 20° C.

The compound represented by the general formula (I) or (II) may be used in the form of a salt with an inorganic or organic acid. Preferred examples of such inorganic or organic acids include hydrochloric acid, sulfuric acid, nitric acid, hydrobromic acid, hydroiodic acid, perchloric acid, oxalic acid, p-toluenesulfonic acid, methanesulfonic acid, and trifluoromethanesulfonic acid.

The compound represented by the general formula (III) may be in the form of tautomeric enol.

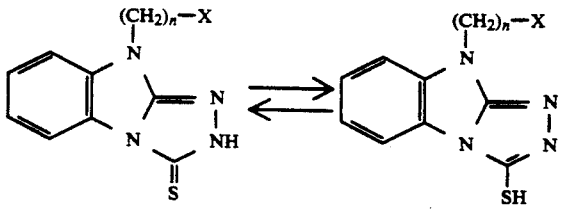

The compound represented by the general formula (I) or (II) or a salt thereof or by the general formula (III) preferably satisfies Condition 1 described below.

Condition 1

4 ml of a $8.0\times10^{-2}$ mol/l aqueous solution of a compound of the general formula (I) or (II) or a salt thereof or the general formula (III) is added to a mixture of 2 ml of a $4.0\times10^{-4}$ mol/l aqueous solution of anhydro-5,5'-dichloro-9-ethyl-3,3'-bis(3-sulfopropyl)-thiacarbocyanine hydroxide pyridinium salt and 1 ml of a $1.0\times10^{-1}$ mol/l aqueous solution of potassium chloride. The solution is diluted with water to make 10 ml. The aqueous solution thus prepared exhibits a molecular extinction coefficient of $1.0\times10^{5}$ or less at 624 nm.

Specific examples of compounds used in the present invention are set forth below, but the present invention should not be construed as being limited thereto.

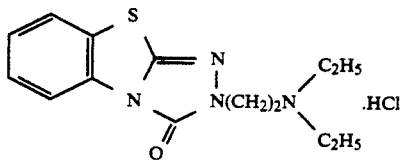

I-(1)

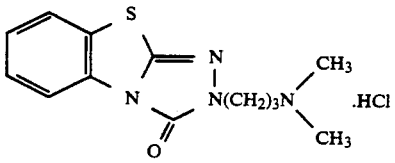

I-(2)

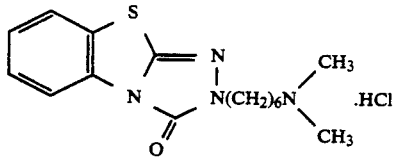

I-(3)

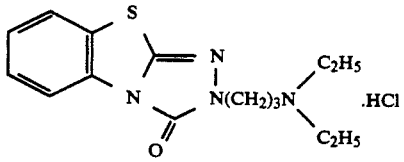

I-(4)

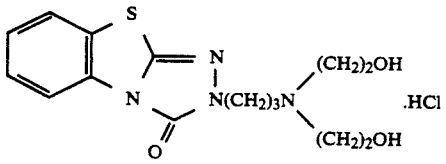

I-(5)

-continued
I-(6)
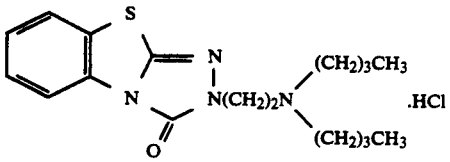
I-(7)
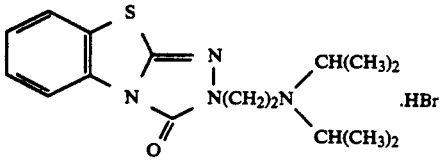
I-(8)
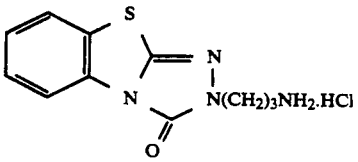
I-(9)
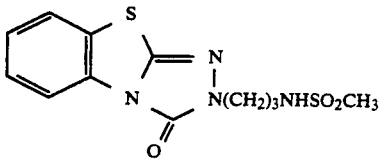
I-(10)
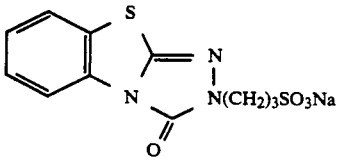
I-(11)
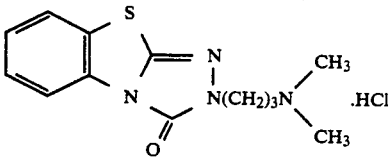
I-(12)
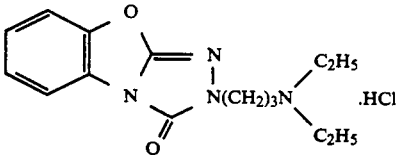
I-(13)
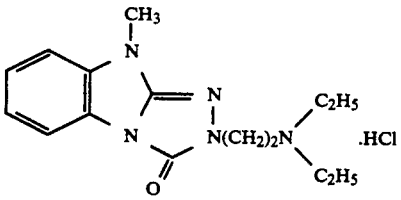
I-(14)
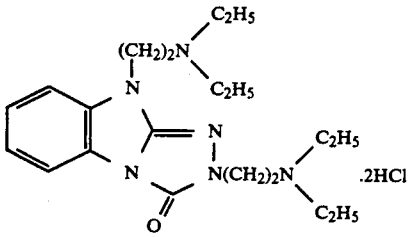
-continued
I-(15)
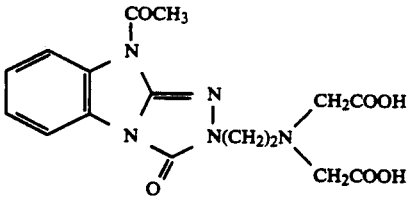
I-(16)
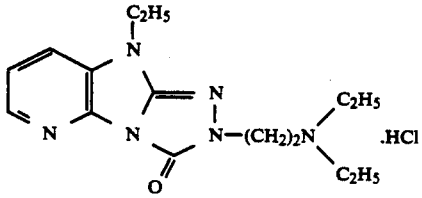
I-(17)
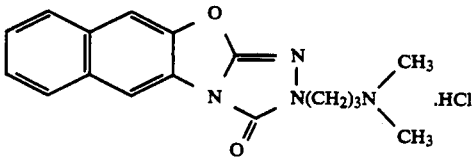
II-(1)
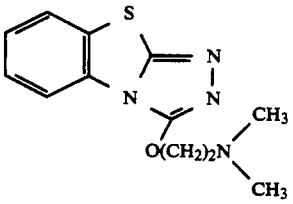
II-(2)
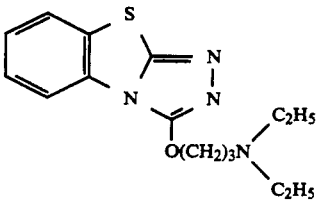
II-(3)
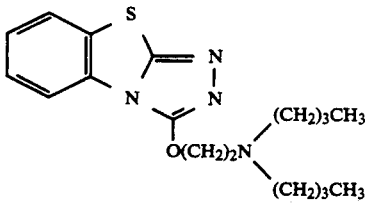
II-(4)
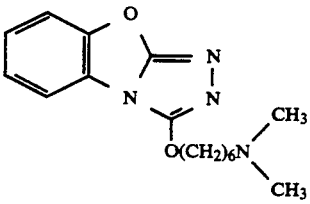
II-(5)
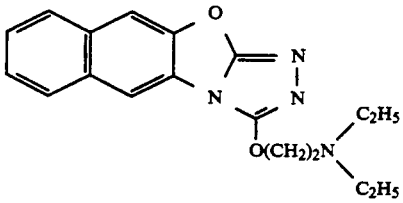

-continued

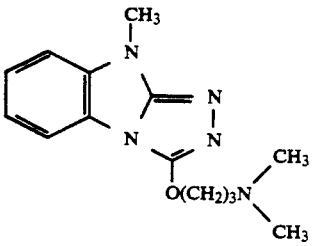

II-(6)

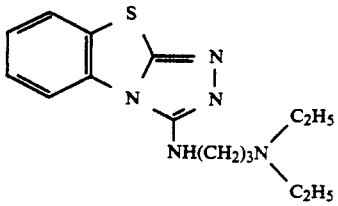

II-(7)

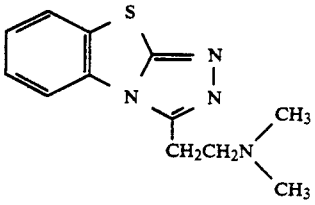

II-(8)

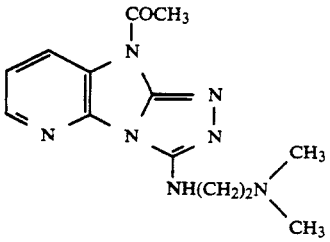

II-(9)

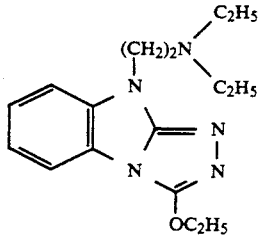

II-(10)

The synthesis of the compounds represented by the general formula (I) or (II) can be easily accomplished by any suitable method as described in JP-B-54-18338, *Journal of Organic Chemistry*, vol. 24, page 1478 (1959), *Journal of Chemical Society*, page 442, 1957, and *Journal of Heterocyclic Chemistry*, vol. 22, page 313 and page 1065, 1985, or by methods analogous thereto. (The term "JP-B" as used herein means an "examined Japanese patent publication".)

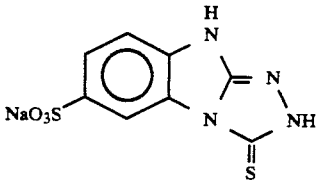

(III)-1

-continued

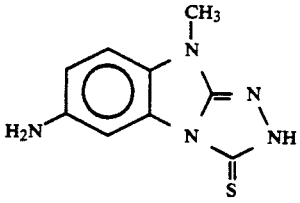

III-(2)

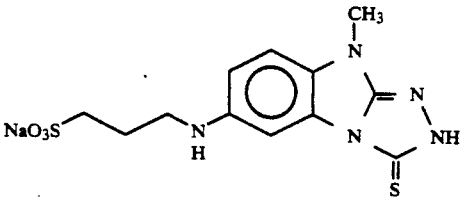

III-(3)

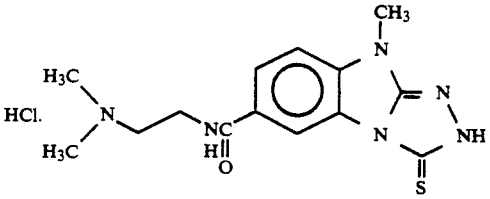

III-(4)

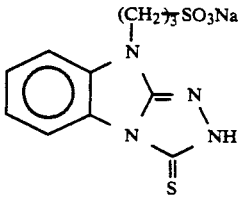

III-(5)

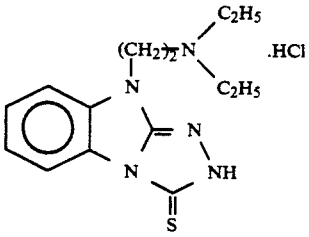

III-(6)

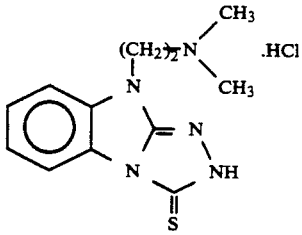

III-(7)

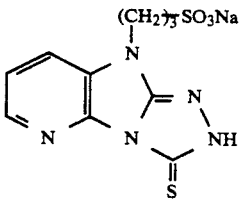

III-(8)

-continued

III-(9)

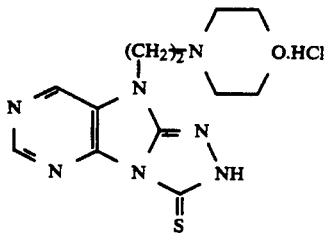

III-(10)

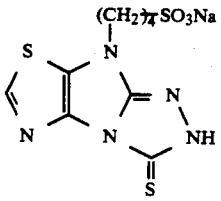

III-(11)

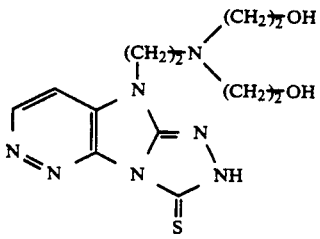

III-(12)

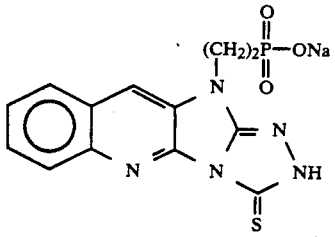

The synthesis of the compounds represented by the general formula (III) can be accomplished in accordance with any suitable method as described in JP-B-49-8852, JP-B-49-11063, and JP-B-54-18338, West Ge Patent 2,349,527, *Journal of Heterocyclic Chemistry*, vol. 14, page 1045, 1977, *Journal of Organic Chemistry*, vol. 24, page 1478, 1973 and vol. 38, page 3084, 1973, and *Journal of Chemical Society*, page 3311, 1949.

Examples of the synthesis of typical compounds of the present invention are set forth below. Unless otherwise indicated herein, all parts, percents, ratios and the like are by weight Synthesis of Compound I-(2)

76.5 g of 2-hydrazinobenzothiazole and 77.0 g of urea were stirred over an oil bath at a temperature of 145° C. for 4 hours. 40 ml of m-cresol was then added to the reaction solution. The reaction solution was further stirred for 2 hours. The reaction solution was then poured into 1 of ice-water. The resulting crystals were filtered off, and then washed with 1 l of water. The crystals were then dissolved in 800 ml of ethanol and 100 ml of water under heating. 1 l of water was added to the solution so that the solution was cooled. The resulting crystals were filtered off, and then dried under reduced pressure to obtain 3-oxotriazolobenzothiazole in the form of white crystals (yield: 91%).

77.1 g of a 20% methanol solution of sodium methylate was dissolved in 800 ml of isopropanol. 38.2 g of 3-oxotriazolobenzothiazole was added to the solution. The reaction solution was then heated at reflux for 10 minutes. After cooling, 37.2 g of hydrochloride of dimethylaminopropyl chloride was added to the reaction solution. The reaction solution was further heated at reflux for 4 hours. The reaction solution was poured into 800 ml of ice-water. The reaction solution was then extracted with 1.5 l of ethyl acetate. The organic phase thus extracted was dried with magnesium sulfate. Magnesium sulfate was filtered off and the organic phase was concentrated under reduced pressure. The residue was dissolved in 500 ml of tetrahydrofuran. Hydrogen chloride gas was bubbled into the solution under cooling with ice. The resulting crystals were filtered off, washed with tetrahydrofuran, and then dried under reduced pressure to obtain Compound I-(2) (yield: 71%; m.p. 245° C.).

Synthesis of Compound II-(2)

1.9 ml of a 28% methanol solution of sodium methylate was added to 20 ml of an acetonitrile solution of 1.38 g of diethylaminoethanol. The reaction solution was heated at reflux for 2 hours. After cooling, 20 ml of an acetonitrile solution of 2.5 g of 3-bromotriazolobenzothiazole (obtained by the synthesis method as described in JP-B-54-18338) was dropwise added to the reaction solution. The reaction solution was further heated at reflux for 5 hours. The reaction solution was cooled, and the resulting crystals were filtered off, washed with acetonitrile, and then dried to obtain Compound II-(2) (yield: 73%; m.p. 282°-285° C.).

Synthesis of Compound III-6

164 g (1.0 mol) of 2-methylthiobenzoimidazole was suspended in 1,500 cc of water. 1.65 g (0.005 mol) of sodium tungstate dihydrate and 280 ml of 35% hydrogen peroxide were added to the suspension. The reaction solution was then stirred over a hot water bath at a temperature of 50° C. over 6 hours. The resulting crystals were then filtered off to obtain 181 g of 2-methanesulfonylbenzoimidazole.

70 g (0.36 mol) of 2-methanesulfonylbenzoimidazole, 74 g (0.4 mol) of 1-chloro-2-diethylaminoethane hydrochloride, and 119 ml of triethylamine were heated at reflux in 700 ml of acetonitrile for 3 hours.

The resulting hydrochloride of triethylamine was filtered off. The filtrate was concentrated under reduced pressure. The solution was extracted with ethyl acetate (1,000 cc×2). The resulting ethyl acetate phase was dried with magnesium sulfate, and then concentrated under reduced pressure to obtain 85.3 g of 1-(2-diethylaminoethyl)-2-methanesulfonylbenzoimidazole.

85 g of 1-(2-diethylaminoethyl)-2-methanesulfonylbenzoimidazole thus obtained was then heated at reflux in 200 ml of hydrazine monohydrate for 4 hours. The reaction solution was extracted with ethyl acetate, dried with sodium sulfate, and then dried under reduced pressure to obtain a syrupy residue. Isopropanol was added to the residue. 20 ml of hydrochloric acid was added to the system to obtain 84 g of 1-(2-diethylaminoethyl)-2-hydrazinobenzoimidazole dihydrochloride in crystal form. 84 g of 1-(2-diethylaminoethyl)-2-hydrazinobenzoimidazole dihydrochloride thus obtained was suspended in acetonitrile. 19 ml of carbon disulfide and 80 ml of triethylamine were added to the suspension. The mixture was then stirred at a temperature of 60° C. to effect thorough dissolution. The reaction solution was further stirred at a temperature of 60° C. for 2 hours, and then cooled with ice. The resulting crystals were filtered off, and then suspended in 500 ml of methanol. 20 ml of hydrochloric acid was added to the suspension to effect thorough dissolution. The reaction solution was again cooled with ice. The resulting crystals were filtered off to obtain 40 g of 8-(2-diethylaminoethyl)-3-mercaptobenzoimidazotriazole (III-(6)). (m.p. 258°-260° C.)

| Elemental Analysis: | | | | |
|---|---|---|---|---|
| Calculated %: | C 54.58, | H 5.29, | N 17.14, | S 11.21 |
| Found %: | C 54.60, | H 5.25, | N 17.01, | S 11.30 |

The synthesis of other compounds can be accomplished by suitable methods similar to the above mentioned methods.

All aqueous solutions obtained from these exemplified compounds in accordance with condition 1 exhibited a molecular extinction coefficient of at 624 nm. Furthermore, all these compounds have a molecular weight of 600 or less.

The compounds of the general formula (I), (II) or (III) of the present invention serve to enable rapid processing of a silver halide photographic material. In particular, the present compounds serve to extremely minimize the amount of sensitizing dye left in the photographic material which has been processed.

In the present invention, the compound represented by the general formula (I), (II) or (III) may be incorporated in the silver halide photographic material or a processing solution for the processing of the silver halide photographic material.

If the compound represented by the general formula (I), (II) or (III) is incorporated in the silver halide photographic material, it may be incorporated in any of the silver halide emulsion layers, interlayers, protective layers, and a back layer which is provided on the side opposite to the emulsion layer side of a support. The present compound is preferably incorporated in layers other than the silver halide emulsion layers, particularly the back layer. The incorporation of the present compound in these layers can be accomplished using conventional methods.

The amount of the compound of the general formula (I), (II), or (III) to be incorporated in the silver halide photographic material is not specifically limited but is generally in the range of $3\times10^{-7}$ to $3\times10^{-2}$ mol, preferably $3\times10^{-6}$ to $1\times10^{-3}$ mol, per $m^2$ of support.

In a particularly preferred embodiment of the present invention, the compound of the general formula (I), (II), or (III) is incorporated in the processing solution.

The photographic processing of the present invention, in the case of a black-and-white light-sensitive material, comprises at least the steps of developing, fixing, rinsing (or stabilizing) and drying the silver halide photographic material which has been exposed to light. In the case of a color photographic material, the present photographic processing comprises at least the steps of color-developing, bleaching, fixing (bleach and fixation may be effected in the same bath, i.e., a blix bath), rinsing (or stabilizing), and drying the silver halide photographic material which has been exposed to light.

The compound of the general formula (I), (II), or (III) may be incorporated in any of a developer, color developer, fixing solution, bleaching solution, blix solution, rinsing solution, and prebath thereof. In particular, the compound is preferably incorporated in a developer, a color developer, a fixing solution, a blix solution, a rinsing solution or a prebath thereof. In other words, the processing solution of the present invention is a developer, a color developer, a fixing solution, a bleaching solution, a blix solution or a prebath thereof containing a compound represented by the general formula (I), (II), or (III).

The amount of the compound of the general formula (I), (II), or (III) to be incorporated in the processing solution depends on the kind of processing solution but is generally in the range of $5\times10^{-5}$ to $10^{-1}$ mol/l, preferably $10^{-4}$ to $5\times10^{2}$ mol/l, particularly $3\times10^{-2}$ to $10^{-2}$ mol/l. If this amount falls below this range, the effect of improving adaptability to rapid processing cannot be obtained. On the contrary, if the amount exceeds this range, precipitation in the processing solution occurs or the manufacturing cost is increased.

The silver halide photographic material of the present invention exhibits pronounced effects when a silver halide photographic material which has been spectrally sensitized is processed rapidly, preferably for 90 seconds or less, particularly 70 seconds or less.

When the silver halide photographic material of the present invention is a black-and-white photographic material, it is most preferably developed with a developer containing a combination of a dihydroxybenzene and a 1-phenyl-3-pyrazolidone. Other p-aminophenol-based developing agents may also be included, if desired.

Examples of suitable dihydroxybenzene developing agents include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone. Particularly preferred of these dihydroxybenzene developing agents is hydroquinone.

Examples of p-aminophenol-based developing agents include N-methyl-p-aminophenol, p-aminophenol, N-(μ-hydroxyethyl)-p-aminophenol, N-(4-hydroxyphenyl)glycine, 2-methyl-p-aminophenol, and p-benzylaminophenol. Particularly preferred of these p-aminophenol-based developing agents is N-methyl-p-aminophenol.

Examples of 3-pyrazolidone-based developing agents include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone.

The developing agent is preferably used in an amount of 0.01 to 1.2 mol/l.

Examples of sulfite preservatives used in the processing solution include sodium sulfite, potassium sulfite, lithium sulfite, ammonium sulfite, sodium bisulfite, and potassium metabisulfite. The sulfites are preferably used at 0.2 mol/l or more, particularly 0.4 mol/l. Furthermore, an upper limit of 2.5 mol/l is preferred.

The pH of the developer is preferably in the range of 9 to 13, more preferably 10 to 12.

Examples of alkalis to be used to set the pH include pH adjusters such as sodium hydroxide, potassium hydroxide, sodium carbonate, potassium carbonate, sodium triphosphate, and potassium triphosphate.

Buffers such as those described in JP-A-62-186259 (borates), those described in JP-A-60-93433 (e.g., saccharose, acetoxime, 5-sulfosalicylic acid), phosphates, and carbonates may also be used.

Film hardeners may also be incorporated in the above mentioned developer. Examples of film hardeners preferably used are dialdehyde-based film hardeners or bisulfite addition products thereof. Specific examples of these film hardeners include glutaraldehyde, and bisulfite addition products thereof.

Examples of additives which may be used in addition to the above-mentioned constituents include development inhibitors such as sodium bromide, potassium bromide and potassium iodide; organic solvents such as ethylene glycol, diethylene glycol, triethylene glycol, dimethylformamide, methyl cellosolve, hexylene glycol, ethanol and methanol; and antifoggants such as 1-phenyl-5-mercaptotetrazole, sodium 2-mercaptobenzimidazole-5-sulfonate, and other mercapto compounds, 5-nitroindazole and other indazole-based compounds, and 5-methylbenzotriazole and other benzotriazole-based compounds. Other examples of additives which may be used include development accelerators as described in *Research Disclosure*, No. 17643, vol. 176, Section XXI (Dec. 1978). If desired, toners, surface active agents, defoaming agents, water softeners, and amino compounds as described in JP-A-56-106244 can also be present.

Silver stain inhibitors such as the compounds as described in JP-A-56-24347 can be incorporated in the developer in the development processing.

The developer can comprise amino compounds such as the alkanolamines described in European Patent 0,136,582 and JP-A-56-106244.

In addition, the developer can also comprise those compounds described in L. F. A. Mason, *Photographic Processing Chemistry*, pp. 226–229, Focal Press, 1966, U.S. Pat. Nos. 2,193,015 and 2,592,364, and JP-A-48-64933.

The fixing solution to be used in the present invention is an aqueous solution containing a thiosulfate as a fixing agent and a pH of 3.8 or more, more preferably 4.2 to 7.0, and most preferably 4.5 to 5.5.

Examples of suitable fixing agents include sodium thiosulfate, and ammonium thiosulfate. Particularly preferred of these fixing agents is ammonium thiosulfate from the standpoint of fixing speed. The amount of fixing agent to be used can be appropriately varied, but is generally in the range of about 0.1 mol/l to about 6 mol/l.

The fixing solution can comprise a water-soluble aluminum salt which serves as a film hardener. Examples of such water-soluble aluminum salts include aluminum chloride, aluminum sulfate, and potash alum.

The fixing solution can comprise tartaric acid, citric acid, gluconic acid, and derivatives thereof, alone or in combination. These compounds are effective if present in a concentration of 0.005 mol or more, particularly 0.01 to 0.03 mol, per 1 of fixing solution.

If desired, the fixing solution can comprise preservatives (e.g., sulfite, bisulfite), pH buffers (e.g., acetic acid, boric acid), pH adjusters (e.g., sulfuric acid), chelating agents capable of softening water, and the compounds as described in JP-A-62-78551.

It is preferable to reduce the processing hardening by reducing the percentage swelling of the photographic material (preferably 150% to 50%) since this facilitating faster processing. Thus, it is preferable that there be no hardening during development and also preferable that there be no hardening during fixing, and the hardening reaction may also be reduced by adopting a pH of 4.6 or more in the fixing solution. In this way, it is possible to construct a replenishing agent composed of a developing solution and a fixing solution respectively in a single solution, which has the advantage that a simple dilution with water is sufficient for adjusting the replenishment solution.

The above-mentioned silver halide photographic materials of the present invention are processed with washing water or a stabilizing solution after the developing and fixing stages. The stabilizing solution is the same as for the washing, the nomenclature being all that is different.

The replenishment rate of the washing water or stabilizing solution is preferably in the range of 2 l or less (including 0, which is to say a standing water wash) per $m^2$ of photographic material.

This not only makes it possible to effect a saving of water in the processing but also reduces the need for piping in an automatic processor.

A known approach for reducing the replenishment rate is the multi-stage countercurrent system (for example with 2 or 3 stages). If a multi-stage counter-current system is applied in the present invention, even more efficient washing can be attained, since, after the material has been fixed, the photographic material progressively contacts a gradually cleaner washing solution, which is to say in the direction of the processing solution which is not contaminated by the fixing solution.

When the above-mentioned development processing is carried out as a water-saving processing or as a pipeless processing, it is preferable to have an antimicrobial means in the washing water or stabilizing solution.

Suitable antimicrobial means include use of the ultraviolet irradiation method described in JP-A-60-263939, the method using a magnetic field described in JP-A-60-263940, the method in which water is purified using an ion-exchange resin described in JP-A-61-131632, and methods using antibacterial agents described in JP-A-62-115154, JP-A-62-153952, JP-A-62-220951, and JP-A-62-209532.

Furthermore, it is possible to use antibacterial agents, antifungal agents and surface active agents as described in L. E. West, "Water Quality Criteria", *Photo. Sci. & Eng.*, vol. 9, No. 6 (1965), M. W. Beach, "Microbiological Growths in Motion-Picture Processing", *SMPTE Journal*, vol. 85, 1976, R. O. Deegan, "Photo Processing Wash Water Biocides", *J. Imaging Tech* 10, No. 6 (1984), and JP-A-57-8542, 57-58143, 58-105145, 57-132146, 58-18631, 57-97530, and 57-157244.

Furthermore, the washing bath and stabilizing bath can comprise isothiazoline-based compounds as described in R. T. Kreiman, *J. Image. Tech.* 10, (6), page 242, 1984, and *Research Disclosure* Nos. 20526, vol. 205, May 1981, and 22845, vol. 228, Apr. 1983, and compounds as described in JP-A-62-209532 as microbiocides.

In addition, compounds such as those described in Hiroshi Horiguchi, *Bokin Bobai No Kagaku* (*The Chemistry of Antimicrobial and Antifungal Agents*), Mitsumoto Publishing (1982), and Japanese Antimicrobial and Antifungal Society, *Bokin Bobai Gijutsu Handbook* (*Antimicrobial and Antifungal Technology Handbook*), Hakuhodo (1986) may also be included.

When the silver halide photographic material of the present invention is stabilized in a stabilizing solution or washed with a small amount of washing water, it is preferable to provide a squeeze roller washing tank as described in JP-A-63-18350. Furthermore, it is preferable to adopt a washing stage configuration such as that described in JP-A-63-143548.

Moreover, part or all of the overflow from the washing or stabilization bath, which is produced by replenishing the washing or stabilization bath with water which has undergone an antifungal stage in the processing, can be used in a processing solution having a fixing capability, which is the preceding processing stage, as described in JP-A-60-235133.

When the silver halide photographic material of the present invention is a black-and-white material, and when it is processed in an automatic processor including at least the above developing, fixing and washing or stabilizing and drying steps, it is preferable that the steps from development to drying be completed within 90 seconds, which is to say that the time taken from when the front edge of the photographic material is immersed in the developing solution, as it passes through the fixing and washing (or stabilization) stages and is dried and until the front edge emerges from the drying zone (the so-called dry to dry time) is 90 seconds or less, and this is particularly preferably 70 seconds or less. More preferably, this dry to dry time is 60 seconds or less.

In the present invention "the time taken in the developing step" or the "developing time" refers to the time from when the front end of the photographic material being processed is immersed in the solution in the developing tank in an automatic processor until it is immersed in the fixing solution which follows, the "fixing time" refers to the time from when it is immersed in the solution in the fixing tank until it is immersed in the washing tank solution (stabilizing solution) which follows, and the "washing time" refers to the time during which it is immersed in the washing tank solution.

Furthermore, an automatic processor is normally equipped with a drying zone through which a hot gas of 35° C. to 100° C., and preferably 40° C. to 80° C., and the "drying time" refers to the time spent in this drying zone.

To achieve a rapid processing with a dry to dry time of 90 seconds or less as discussed above, the developing time is 30 seconds or less and preferably 25 seconds or less, and the developing temperature is preferably in the range of 25° C. to 50° C., more preferably 30° C. to 40° C.

The fixing temperature and time in the present invention are preferably in the range of about 20° C. to about 50° C. and 6 seconds to 30 seconds, more preferably 30° C. to 40° C. and 6 seconds to 20 seconds, respectively.

The washing or stabilization temperature and time are preferably in the range of 0° to 50° C. and 6 seconds to 20 seconds, more preferably 15° C. to 40° C. and 6 seconds to 15 seconds, respectively.

In the present invention, the photographic material which has been developed, fixed and washed or stabilized is dried by pressing out the washing water, for example, by passing it through squeeze rollers. Drying is at about 40° C. to about 100° C. and the drying time may be varied depending to the surrounding conditions, but it is normally about 5 seconds to 30 seconds, more preferably 40° C. to 80° C. for about 5 seconds to 20 seconds.

In order to prevent development unevenness, which is a characteristic feature of rapid processing, when effecting a development processing from dry to dry in 90 seconds or less using a photographic material/processing system of the present invention, it is preferable to use rubber rollers as described in JP-A-63-151943 as the rollers at the developing tank outlet, to adopt a discharge running rate of 10 m/min. or more for the developing solution stirring within the developing solution tank as described in JP-A-63-151944, or to stir more strongly in the holding mechanism in the development processing at least as described in JP-A-63-264758. The circulation rate of the processing solution is preferably in the range of 9 l/min. or more. Moreover, for rapid processing of the type achievable with the present invention, it is particularly preferable that the structure of the rollers in the fixing solution tank results in a more rapid fixing rate and involves facing rollers. By adopting a facing-roller construction it is possible to reduce the number of rollers and decrease the size of the processing tank. Thus, it is possible to make the automatic processor more compact.

There are no particular limitations on the photographic material of the present invention which may be used and any common photographic material can be employed. For example, the photographic material can be a scanner material for printing or a photographic material for laser printers in medical imaging, or a direct X-ray material for medical purposes, an indirect X-ray material for medical purposes, a CRT image-recording material, a high-contrast material, a color reversal material, a color printing paper and the like.

The production of the photographic material of the present invention can be carried out, for example, by one or a combination of two or more of the following methods.

(1) Using a silver halide containing a small amount of or no iodide, which is to say, using silver chloride, silver bromide, silver chlorobromide, silver iodobromide, silver chloroiodobromide or the like with a silver iodide content of 0 to 5 mol %.

(2) Including a water-soluble iridium salt in the silver halide emulsion.

(3) Reducing the amount of coated silver in the silver halide emulsion layers; for example, with 1 to 5 g/m$^2$, preferably 1 to 4 g/m$^2$, and more preferably 1 to 3 g/m$^2$, on one side.

(4) Reducing the average grain size of the silver halide in the emulsion; for example, to 1.0 μm or less and preferably 0.7 μm or less.

(5) Using tabular grains as the silver halide grains in the emulsion; for example, using those with an aspect ratio of 4 or more and preferably of 5 or more.

(6) Achieving a percentage swelling of 200% or less in the silver halide photographic material.

The silver halide grains in the photographic emulsion may be the so-called regular grains having a cubic, octahedral, tetradecahedral or other such regular crystal form, or those having a spherical or other such irregular crystal form, those having twin crystal surfaces or other such crystal defects, or they may be tabular grains or complex forms of these, with tabular grains being preferable.

The aspect ratio of the tabular grains is given as the ratio between the average value of the diameters of circles having the same surface area as the projected surface area of each of the tabular grains and the average value of the grain thickness of each of the tabular grains. In the present invention, preferred tabular grains have aspect ratio of 4 or more and under 20 and more preferably 5 or more and under 10. Moreover, the grain thickness is preferably 0.3 μm or less and particularly preferably 0.2 μm or less.

It is preferable that 80% by weight, and more preferably 90% by weight or more, of all the grains be tabular grains.

A monodisperse emulsion in which the silver halide grain size has a narrow distribution or a polydisperse emulsion which has a wide distribution may be employed.

The preparation of the silver halide photographic emulsion of the present invention can be accomplished by any suitable known method as described in *Research Disclosure*, No. 17643, Dec. 1978, pp. 22–23, "I. Emulsion Preparation and Types", and *Research Disclosure*, No. 18716 (Nov. 1979), page 648.

The preparation of the photographic emulsion to be used in the present invention also can be accomplished by any suitable method as described in described in P. Glafkides, *Chimie et Phisique Photographique*, Paul Montel, 1967, G. F. Duffin, *Photographic Emulsion Chemistry*, Focal Press, 1966, and V. L. Zelikman et al, *Making and Coating Photographic Emulsion*, Focal Press, 1964.

In order to control the growth of the grains during the formation of the silver halide grains used in the present invention, it is possible to use, as silver halide solvents, ammonia, potassium thiocyanate, ammonium thiocyanate, the thioether compounds as described in U.S. Pat. Nos. 3,271,157, 3,574,628, 3,704,130, 4,297,439, and 4,276,374, the thione compounds as described in JP-A-54-144319, JP-A-53-82408, and JP-A-55-777737, and the amine compounds as described in JP-A-54-100717.

In the present invention, water-soluble rhodium salts and water-soluble iridium salts mentioned above can be used. The one-sided mixing method, the simultaneous mixing method, a combination thereof and the like may all be used as the system for reacting soluble silver salts and soluble halogen salts.

It is also possible to use methods in which the grains are formed in the presence of an excess of silver ions (the so-called reverse mixing method). One form of the simultaneous mixing method is a method in which the pAg is kept constant in the liquid phase in which the silver halide is formed, in other words, the controlled double jet method, and this method provides silver halide grains with a regular grain form and a nearly uniform grain size.

The silver halide emulsion to be used in the present invention is preferably subjected to chemical sensitization.

Chemical sensitization can be in the usual manner and sulfur sensitization, reduction sensitization, noble metal sensitization and combinations thereof may be used for chemical sensitization.

More specifically, chemical sensitizers include sulfur sensitizers such as allyl thiocarbamides, thioureas, thiosulfates, thioethers and cistines; noble metal sensitizers such as potassium chloroaurate, aurous thiosulfate and potassium chloropalladate; and reducing sensitizers such as tin chloride, phenyl hydrazine and redactone.

The silver halide emulsion of the present invention can be spectrally sensitized with known spectral sensitizing dyes as desired. Examples of spectral sensitizing dyes which may be used include the cyanine, merocyanine, rhodacyanine, styryl hemicyanine, oxonol, benzylidene and holopolar sensitizing dyes as described in F. M. Hamer, *Heterocyclic Compounds—The Cyanine Dyes and Related Compounds*, John Wiley & Sons, 1964, and D. M. Sturmer, *Heterocyclic Compounds—Special Topics in Heterocyclic Chemistry*, John Wiley & Sons, 1977. Particularly preferred of these sensitizing dyes are cyanine and merocyanine dyes, most preferably benzoimidazolobenzoxazolocarbocyanine dyes.

Examples of sensitizing dyes which can be preferably used in the present invention include cyanine dyes and merocyanine dyes as described in JP-A-60-133442, JP-A-61-75339, JP-A-62-6251, JP-A-59-212827, JP-A-50-122928, and JP-A-59-1801553. Specific examples of these sensitizing dyes include sensitizing dyes which spectrally sensitize silver halides in the blue region, green region, red region or infrared region of the spectrum as described in JP-A-60-133442 (pp. 8–11), JP-A-61-75339 (pp. 5–7 and 24–25), JP-A-62-6251 (pp. 10–15), JP-A-59-59-212827 (pp. 5–7), JP-A-50-122928 (pp. 7–9), and JP-A-59-180553 (pp. 7–18).

These sensitizing dyes can be used alone or in combination. Combinations of sensitizing dyes are often used for the purpose of supersensitization in particular. Dyes which do not themselves provide a spectral sensitizing action and substances exhibiting a supersensitizing effect, which are substances which essentially do not absorb visible light, may be included in the emulsion together with the sensitizing dyes. For example, it is possible to use substituted aminostilbene compounds which are nitrogen-containing heterocyclic nuclei (for example those described in U.S. Pat. Nos. 2,933,390 and 3,635,721), aromatic organic acid formaldehyde condensates (for example those described in U.S. Pat. No. 3,743,510), cadmium salts and azaindene compounds. The combinations described in U.S. Pat. Nos. 3,615,613, 3,615,641, 3,617,295, and 3,635,721 are particularly effective.

The above mentioned sensitizing dyes are incorporated in the silver halide photographic emulsion in a proportion of $5\times10^{-7}$ to $5\times10^{-2}$ mol, preferably $1\times10^{-6}$ to $1\times10^{-3}$ mol, particularly $2\times10^{-6}$ to $5\times10^{-4}$ mol per mol of silver halide.

The above described sensitizing dyes can be directly dispersed into the emulsion layer. Furthermore, these dyes may be first dissolved in a suitable solvent such as methyl alcohol, ethyl alcohol, methyl cellosolve; acetone, water, pyridine and a mixture thereof, and added to the emulsion in the form of a solution. Further, ultrasonic waves can be used to produce the solution. Further, the method of addition of the above mentioned sensitizing dyes can be the method in which the dye is dissolved in a volatile organic solvent, the resulting solution is dispersed in a hydrophilic colloid and this dispersion is added to the emulsion as described in U.S. Pat. No. 3,469,987; the method in which a water-insoluble dye is dispersed in a water-soluble solvent without being dissolved and this dispersion is added to the emulsion as described in JP-B- 46-24185; the method in which a water-insoluble dye is mechanically crushed and dispersed in a water-based solvent and this dispersion is added to the emulsion as described in JP-B-61-45217; the method in which the dye is dissolved in a surface active agent and the resulting solution is added to the emulsion as described in U.S. Patent 3,822,135; the method in which the dye is dissolved using a red-shifting compound and the resulting solution is added to the emulsion as described in JP-A-51-74624; and the method in which the dye is dissolved in an acid containing virtually no water and the resulting solution is added to the emulsion as described in JP-A-50-80826. In addition, the methods as described in U.S. Pat. Nos.

2,912,343, 3,342,605, 2,996,287, and 3,429,835 can also be used for the addition of the dye to the emulsion. Further, the above sensitizing dyes may be dispersed uniformly in the silver halide emulsion before it is coated onto an appropriate support, and the dyes can also be dispersed at any stage in the preparation of the silver halide emulsion.

Other sensitizing dyes can be used in combination with the above sensitizing dyes. For example, the sensitizing dyes as described in U.S. Pat. Nos. 3,703,377, 2,688,545, 3,397,060, 3,615,635, 3,628,964, 3,416,927, 2,615,613, 3,615,632, 3,617,295, and 3,635,721, British Patents 1,242,588 and 1,293,862, JP-B-43-4936, JP-B-44-14030, JP-B-43-10773, and JP-B-43-4930 can be used.

In order to rapidly process the silver halide photographic material, it is preferable to keep the percentage swelling of the silver halide photographic material at 200% or less.

It is preferable that the percentage swelling is no lower than required since if it is too low, there is a reduction in the rapidity of development, fixing, washing and the like.

The preferred percentage swelling is between 200% and 30%, particularly between 150% and 50%.

Those skilled in the art can easily control the percentage swelling to 200% or less, for example, by increasing the amount of film hardener to be incorporated in the photographic material.

The percentage swelling can be determined by (a) incubating the photographic material for 3 days at 38° C. and 50% RH, (b) measuring the thickness of the hydrophilic colloid layer, (c) immersing the photographic material in distilled water at 21° C., and (d) comparing the thickness of the hydrophilic colloid layer with that measured in step (b).

Known film hardeners which can be used for the photographic materials in the present invention include aldehyde compounds, compounds having active halogens as described in U.S. Pat. No. 3,288,775, compounds having a reactive ethylenically unsaturated group as described in U.S. Pat. No. 3,635,718, epoxy compounds as described U.S. Pat. No. 3,091,537, halocarboxaldehydes such as mucochloric acid and other such organic compounds. Of these, vinyl sulfone-based film hardeners are preferred. Moreover, macromolecular film hardeners are also preferred.

Polymers having an active vinyl group or a group comprising a precursor thereof are preferred as macromolecular film hardeners, and of these, particular preference is given to polymers of the kind in which the active vinyl group or the group constituting a precursor thereof is joined to the main polymer chain via a long spacer as described in JP-A-56-142524. The amount of these film hardeners to be incorporated to achieve the percentage swelling discussed above will vary depending on the type of film hardener and the type of gelatin used.

When the silver halide photographic material of the present invention is processed rapidly, it is preferable to include an organic substance of a type which flows out in the development processing stage from the emulsion layers and/or other hydrophilic colloid layers. When the substance which flows out is gelatin, preference is given to the type of gelatin which is unaffected by the gelatin crosslinking reaction of the film hardener, acetylated gelatin and phthalated gelatin and the like corresponding to this definition. For example, it is preferable to use a gelatin with a low molecular weight. Moreover, in addition to gelatin, hydrophilic polymers such as polyacrylamide as described in U.S. Pat. No. 3,271,158 or polyvinyl alcohol and the like can be used to advantage as macromolecular substances. Dextran and saccharose, pullulan and other such saccharides are also advantageous. Of these, polyacrylamide and dextran are preferred, and polyacrylamide is a particularly preferred substance. The average molecular weight of these substances is preferably in the range of 20,000 or less, more preferably 10,000 or less. In addition, it is also possible to use stabilizers and antifoggants as described in *Research Disclosure*, No. 17643, vol. 176, Section VI (Dec. 1978).

The silver halide photographic materials of the present invention can be put to use as silver halide photographic materials capable of providing photographic characteristics of high speed and ultrahigh contrast by the use of a hydrazine derivative as described in U.S. Pat. Nos. 4,224,401, 4,168,977, 4,166,742, 4,311,781, 4,272,606, 4,221,857, and 4,243,739.

Further, the present invention can also be used for silver halide color photographic materials. The use of the present invention for silver halide color photographic materials is discussed in detail below.

In the present invention, the first stage in the processing of a color photographic material designates the processing stage which is carried out initially, and this normally corresponds to color development in the processing of color negative films.

When the so-called wet processing time, which is the time from when the photographic material is immersed in the processing solution of the first stage until it leaves the processing solution of the final stage, is 6 minutes or less, the present invention has a good effect, and the effect is more pronounced when this time is reduced to 5 minutes 30 seconds or less, which is therefore preferred, 5 minutes or less being even more preferred.

With a wet processing time of 6 minutes or less, it is preferable for the fixing or bleach-fixing time to be 2 minutes or less and, when this is reduced to 1 minute 30 seconds or less this is even more preferred from the standpoint of the clarity of the effect. Further, the present invention can be appropriately used when the total replenishment amount for each of the processing solutions is 2,500 ml or less and, preferably 2,000 ml or less, with 1,800 ml or less, per $m^2$ of color photographic material, being even more preferred.

Because the effects of the present invention become more pronounced, preference is given to a replenishment rate for the fixing solution or blix solution of 1,200 ml or less, and more preferably 800 ml or less, and even more preferably 600 ml or less.

Further, a replenishment rate for the color developer of 700 ml or less is preferred, and 500 ml or less is particularly preferred. Additionally, a replenishment rate for the bleaching solution of 600 ml or less is preferred, and 300 ml or less is further preferred.

Further, when the present invention is applied to color photographic materials, the effects are pronounced with color photographic materials for picture taking which use silver bromoiodide emulsions; In particular, even more outstanding effects are exhibited in color photographic materials in which the total thickness of all of the photographic structural layers excluding the support is 20 μm or less and the film-swelling rate $T_{\frac{1}{2}}$ for the binder for the photographic emulsion layers is 10 seconds or less, more preferably where the thickness of all of the photographic structural layers is 18 μm or less and the film-swelling rate $T_{\frac{1}{2}}$ is 8 seconds or less.

"Photographic structural layers" refer to all of the hydrophilic colloid layers contributing to image formation on the same side of the support as that having the silver halide emulsion layers. These layers include, for example, antihalation layers (black colloidal silver antihalation layers and the like), underlayers, interlayers (simple interlayers or filter layers, ultraviolet absorbing layers and the like), protective layers and the like as well as the silver halide emulsion layers.

The thickness of the photographic structural layers is the total thickness of the above hydrophilic colloid layers and may be measured with a micrometer.

The film swelling rate $T_{\frac{1}{2}}$ of the binder for the silver emulsion layers in the silver halide color photographic material of the present invention is 25 seconds or less. This is to say, gelatin is normally used for the hydrophilic binder employed in the coating of the silver halides of the silver halide color photographic material, although macromolecular polymers can also be used. In the present invention, the film swelling rate $T_{\frac{1}{2}}$ of the binder must be 25 seconds or less. The swelling rate $T_{\frac{1}{2}}$ of the binder can be measured using known techniques in the art. For example, it can be measured using a swellometer of the type described in A. Green, *Photographic Science and Engineering*, vol. 19, No. 2, pp. 124–129. $T_{\frac{1}{2}}$ is defined as the time taken to reach half the saturated film thickness which is taken to be 90% of the maximum swollen film thickness which is achieved upon processing in a color developing solution at 30° C. for 3 minutes and 15 seconds. Thus, the film swelling rate, taken as $T_{\frac{1}{2}}$, is the time required to reach half the film thickness when the swollen film thickness is at a maximum.

The film swelling rate $T_{\frac{1}{2}}$ can be adjusted by adding a film hardener to the gelatin acting as the binder.

Examples of film hardeners used either alone or in combination include film hardeners of the aldehyde type, azylidine type (for example those described in PB Report 19921, U.S. Pat. Nos. 2,950,197, 2,964,404, 2,983,611, and 3,271,175, JP-B-46-40898, and JP-A-50-91315), isoxazolium type (for example those described in U.S. Pat. No. 3,321,323), epoxy type (for example those described in U.S. Pat. No. 3,047,394, West German Patent 1,085,663, British Patent 1,033,518, and JP-B-48-35495), vinylsulfone type (for example those described in PB Report 19920, West German Patents 1,100,942, 2,337,412, 2,545,722, 2,635,518 and 2,742,308, British Patent 1,251,091, and U.S. Pat. Nos. 3,539,644 and 3,490,911), acryloyl type (for example those described in U.S. Pat. No. 3,640,720), carbodiimide type (for example those described in U.S. Pat. Nos. 2,938,892, 4,043,818 and 4,061,499, and JP-B-46-38715), triazine type (for example those described in West German Patents 2,410,973 and 2,553,915, U.S. Pat. No. 3,325,287, and JP-A-52-12722), macromolecular type (for example those described in British Patent 822,061, U.S. Pat. Nos. 3,623,878, 3,396,029 and 3,226,234, JP-B-47-18578, JP-B-47-18579, and JP-B-47-48896), in addition to film hardeners of the maleimide type, acetylene type, methanesulfonic acid ester type and N-methylol type. By way of useful combining techniques, it is possible to mention the combinations described in West German Patents 2,447,587, 2,505,746, and 2,514,245, U.S. Pat. Nos. 4,047,957, 3,832,181, 3,840,181, and 3,840,370, JP-A-48-43319, JP-A-50-63062, and JP-A-52-127329, and JP-B-48-32364.

Processing stages which can be used with the present invention are set forth below.

1. Color development—bleach fixing—washing
2. Color development—bleaching—fixing—washing —stabilization
3. Color development—bleaching—bleach fixing—washing —stabilization
4. Color development—bleach fixing stabilization
5. Color development—bleaching—fixing—stabilization
6 Color development—bleaching—bleach fixing—stabilization
7. Color development—fixing—bleach fixing—washing —stabilization
8. Black-and-white development—washing—color development—reversal—conditioning—bleaching —fixing—washing—stabilization The details of these processing solutions are given below.

The color developing agents to be used in the color developing solution and color development replenishing solution are primary aromatic amine compounds including known compounds which are widely used in various color photographic processes. However, in the present invention, preferred color developing agents are:

(1) 4-(N-ethyl-N-β-hydroxyethylamino)-2-methylaniline sulfate
(2) 4-(N-ethyl-N-β-methanesulfonoamidoethylamino)-2-methylaniline sulfate
(3) 4-(N-ethyl-N-β-methoxyethylamino)-2-methylaniline-p-toluenesulfonate
(4) 4-(N,N-diethylamino)-2-methylaniline hydrochloride
(5) 4-(N-ethyl-N-dodecylamino)-2-methylaniline sulfate
(6) N,N-diethyl-p-phenylenediamine hydrochloride and other N,N-dialkyl-p-phenylenediamine-based color developing agents. These compounds are added to the color developing solution in the range of 0.005 to 0.05 mol/l, more preferably in the range of 0.01 to 0.04 mol/l, particularly preferably in the range of 0.015 to 0.03 mol/l. Further, they are preferably added to the color development replenishing solution so as to yield an even higher concentration than the concentrations given above. More specifically, the exact magnitude of the concentration varies depending upon the amount of replenishment selected, but in general they are added within a range of 1.05 to 2.0 times greater, ore more often 1.2 to 1.8 times greater than the amount present in the color developing solution (parent solution).

The above mentioned color developing agents may be used alone, but may also be used in combination depending on the intended results. Examples of preferred combinations include (1) and (2), (1) and (3) as well as (2) and (3) of the above color developing agents.

In the present invention, the bromide ion concentration in the color developer is preferably within the range of 0.005 to 0.02 mol/l. It is preferable to keep the bromine compound content of the replenishment solution at no more than 0.005 mol/l. Generally, the bromine compound content of the replenishment solution ought to be reduced as the replenishment rate is reduced. In the present invention in particular, it is preferable for the replenishment solution to contain no bromine compounds since this provides the ability for a great reduction in the replenishment amount.

Moreover, the above described bromine compounds include potassium bromide, sodium bromide, lithium bromide and hydrobromic acid.

The color developer and the color developer replenisher may include preservatives, notably hydroxylamine, diethylhydroxylamine and triethylanolamine, and the compounds described in West German Patent (OLS) 2,622,950, the hydrazines described in JP-A-63-146041, sulfites and hydrogen sulfites. Further, various chelating agents may be incorporated in the system for the purposes of water softening and metal sequestering. In the present invention it is particularly preferable to include at least one type of compound represented by the following general formulae (A) and/or (B):

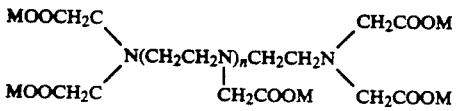

(A)

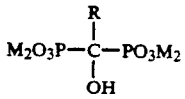

(B)

wherein n represents an integer 1 or 2; R represents a lower alkyl group; and the M's may be the same or different and represent a hydrogen atom, alkali metal atom or ammonium.

R is particularly preferably a methyl group or an ethyl group, and M is preferably a hydrogen atom or a sodium atom.

Specific examples of compounds represented by general formulae (A) and (B) are set forth below.

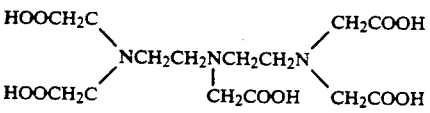

(A-1)

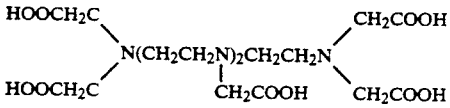

(A-2)

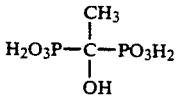

(B-1)

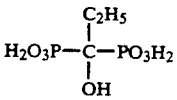

(B-2)

In addition to the above compounds, the color developer to be used in the present invention can contain, either alone or in combination, pH buffers such as alkali metal carbonates, borates, or phosphates; antifoggants or development inhibitors such as iodine compounds, benzimidazoles, benzothiazoles and mercapto compounds; organic solvents such as diethylene glycol; development accelerators such as benzyl alcohol, polyethylene glycol, quaternary ammonium, amines and thiocyanates; nucleating agents such as sodium borohydride; auxiliary developers such as 1-phenyl-3-pyrazolidone; viscosity enhancers; and various chelating agents, such as ethylenediaminetetraacetic acid, nitrilotriacetic acid, cyclohexanediaminetetraacetic acid, iminodiacetic acid hydroxyethyliminodiacetic acid and the organic phosphonates described in *Research Disclosure*, No. 18170 (May 1979) in addition to the compounds represented by the general formulae (A) and (B).

In the present invention, the pH of the color developer and its replenisher is normally 9 or more, preferably 9.5 to 12, particularly preferably 9.5 to 11.0. In the above ranges, it is preferable to set the replenisher pH at a value which is higher than the color developer by about 0.05 to 0.5.

Further, the temperature of the color development processing is 30° to 45° C. and is preferably at a high temperature in order to achieve a greater degree of low-replenishment processing, and the development processing is preferably carried out at 35° C. to 45° C., and particularly preferably at 38° to 42° C. in the present invention.

The present invention can be employed with both an automatic processor and in manual processing, but it is preferably employed with an automatic processor. When processing with an automatic processor, one or a plurality of color developer tanks can be used, and lower replenishment can be achieved by the use of a multi-stage sequential current replenishment system in which a plurality of tanks are employed and sequential flow into the subsequent tanks is achieved by replenishing a first tank. Furthermore, it is preferable to keep the area of contact between air and the developer within the tank(s) as low as possible. More specifically, the effects of the present invention are further improved by the use of a shielding means such as a floating lid, a seal using a high boiling liquid with a lower density than the developer, or a tank structure with a constricted opening as described in JP-A-63-216050.

Moreover, in order to compensate for concentration due to evaporation of the developer, it is preferable to replenish water in an amount corresponding to the amount evaporated as a means of improving the effects of the present invention. The replenished water is preferably deionized water which has undergone an ion-exchange treatment or deionized water which has undergone a treatment such as reverse osmosis or distillation.

The color developer and color developer replenisher are prepared by progressively adding and dissolving the above chemicals in a fixed amount of water, and it is preferable to use deionized water described above as the water for the preparation.

In the present invention, the photographic material is processed in a bleaching solution or blix solution after color development. Bleaching agents are generally complex salts of chelating agents such as an aminocarboxylic acid, a polycarboxylic acid, an aminopolycarboxylic acid and ferric ion. Examples of preferred chelating agents which are used as complex salts with ferric ions inc10de:

(1) Ethylenediaminetetraacetic acid
(2) Diethylenetriaminepentaacetic acid
(3) Cyclohexanediaminetetraacetic acid
(4) 1,3-Diaminopropanetetraacetic acid
(5) Nitrilotriacetic acid
(6) Iminodiacetic acid
(7) Glycol ether-diaminetetraacetic acid, and (1), (2), (3) and (4) are particularly preferred from the standpoint of ultimate performance and rapidity of bleaching.

The ferric ion complexes may be used in the form of complex salts or they may be used by forming ferric ion complexes in solution using chelating agents such as an aminopolycarboxylic acid, an aminopolyphosphoric acid and a phosphonocarboxylic acid with ferric sulfate, ferric chloride, ferric nitrate, ferric ammonium sulfate, ferric phosphate and the like. One type of complex salt may be used or two or more types of complex salt may be used when used in the form of a complex salt. In such cases, the combined use of chelating agents (1) and (4) is particularly preferred. Furthermore, when forming a complex salt in solution using a chelating agent and a ferric salt, one or more types of ferric salt may be used. Moreover, one or more types of chelating agent may be used. In addition, in all these cases, the chelating agent may be used in excess of the amount needed to form the ferric ion complex. An aminopolycarboxylic acid iron complex is preferred of the iron complexes, and the addition amount for this complex is 0.1 to 1 mol/l and preferably 0.2 to 0.4 mol/l in the bleaching solution for a color photographic material for picture taking such as a color negative film, and is 0.05 to 0.5 mol/l and preferably 0.1 to 0.3 mol/l in the blix solution for this type of material. Further, with bleaching solutions or blix solutions for a color photographic material for prints such as a color paper, the addition amount is 0.03 to 0.3 mol/l and preferably 0.05 to 0.2 mol/l.

Further, bleach accelerators can be incorporated in the bleaching solution and blix solution as desired. Specific preferred examples of useful bleach accelerators are compounds having a mercapto group or a disulfide group because they have a large accelerating effect, and the compounds described in U.S. Pat. No. 3,893,858, West German Patent 1,290,812 and JP-A-53-95630 are preferred.

In addition, the bleaching solution or blix solution of the present invention can contain rehalogenating agents such as bromine compounds (for example, potassium bromide; sodium bromide and ammonium bromide), chlorine compounds (for example, potassium chloride, sodium chloride and ammonium chloride) or iodine compounds (for example, ammonium iodide). If desired, it is possible to incorporate corrosion inhibitors such as one or more types of inorganic acid or organic acids with a pH buffering capability such as boric acid, borax, sodium metaborate, acetic acid, sodium acetate, sodium carbonate, potassium carbonate, phosphorous acid, phosphoric acid, sodium phosphate, citric acid, sodium citrate and tartaric acid and the alkali metal or ammonium salts thereof, ammonium nitrate, guanidine and the like.

Moreover, the above mentioned bleaching solution is normally used in a pH range of 3 to 7, preferably 3.5 to 6.5, particularly 4.0 to 6.0. Furthermore, for the blix solution, the pH is 4 to 9, preferably 5 to 8, particularly 5.5 to 7.5. When the pH is above this range, bleaching imperfections tend to occur, and, when it is below this range, color imperfections are tend to occur in the cyan dye.

The fixing agents to be used in the fixing solution used after the processing with the blix solution or bleaching solution of the present invention are known fixing agents. Examples include water-soluble silver halide solvents such as thiosulfates, e.g., sodium thiosulfate and ammonium thiosulfate; thiocyanates, e.g., sodium thiocyanates and ammonium thiocyanates; and thioureas and thioether compounds, e.g., ethylenebisthioglycolic acid and 3,6-dithia-1,8-octanediol, and these can be used either alone or in admixture. Furthermore, it is also possible to use, for example, special blix solutions comprising of a combination of a fixing agent and a large amount of a halogen compound such as potassium iodide as described in JP-A-51-155354. The use of a thiosulfate, and in particular ammonium thiosulfate is preferred in the present invention.

The amount of fixing agent to be incorporated per liter is preferably 0.5 to 3 mol, and more particularly it is in the range of 1 to 2 mol for the processing of color photographic materials for picture taking, and is within the range of 0.5 to 1 mol for the processing of color photographic materials for prints.

The pH for the fixing solution in the present invention is preferably 4 to 9 and particularly preferably 5 to 8. The deterioration of the solution is marked when it is below this, and conversely staining tends to occur due to volatilization of ammonia from the ammonium salt present in the solution when the pH is higher than this.

The pH can be adjusted using hydrochloric acid, sulfuric acid, nitric acid, acetic acid, bicarbonate, ammonia, potassium hydroxide, sodium hydroxide, sodium carbonate, potassium carbonate and the like as desired.

The blix solutions and fixing solutions to be used in the present invention contain, as preservatives, sulfites (such as sodium sulfite, potassium sulfite and ammonium sulfite), bisulfites (such as ammonium bisulfite, sodium bisulfite and potassium bisulfite), metabisulfites (such as potassium metabisulfite, sodium metabisulfite and ammonium metabisulfite) and other sulfite ion-releasing compounds, benzenesulfinic acid, para-toluenesulfinic acid and other aromatic sulfinic acids and salts thereof. These compounds are preferably incorporated in a concentration of about 0.02 to 0.50 mol/l and more preferably 0.04 to 0.40 mol/l.

Sulfites are normally used as preservatives. Ascorbic acid and carbonyl bisulfite adducts of carbonyl compounds and the like may also be used.

Moreover, buffers, fluorescent brightening agents, chelating agents, antifungal agents and the like may also be used as desired.

Washing, stabilization and other processing stages are generally undertaken after the fixing stage or blix stage, but it is also possible to use simplified processing methods, for example, where washing alone is undertaken or, conversely, where a stabilization processing stage alone is undertaken essentially without a washing stage.

The washing stage removes processing solution constituents which have adhered to or been absorbed into the color photographic material and the undesired constituents in the color photographic material and so has the effect of preserving the image stability and good film properties after processing. On the other hand, the stabilization stage is a stage in which the image-storage properties are improved to a level which cannot be attained by washing.

Where the washing stage involves a single tank, but more often it involves a multi-stage countercurrent washing system with two or more tanks. The amount of water to be used in the washing stage can be varied depending on the type of color photographic material and the intended results, and it can be calculated, for example, using the method described in S. R. Goldwasser, "Water Flow Rates in Immersion-Washing of Motion Picture Film", *The Journal of Motion Picture and Television Engineering*, vol. 64, pp. 248–253, May 1955.

Bacterial and fungal propagation will prove to be a problem when economizing on the amount of washing water, and it is preferable to use washing water in which calcium and magnesium levels have been reduced as described in JP-A-62-288838 as a countermeasure to this. In addition, it is also possible to add bactericides and antifungal agents (e.g., compounds as described in *The Journal of Antibacterial and Antifungal Agents*, vol. 11, No. 5, pp. 207 to 223, and Hiroshi Horiguchi, *Sakkin Bobai no Kagaku* (*Bactericidal and Antifungal Chemistry*)). Furthermore, it is also possible to add chelating agents such as ethylenediaminetetraacetic acid and diethylenetriaminepentaacetic acid as water softeners.

A water amount of 100 ml to 1,500 ml per m2 of color photographic material is normally used when economizing on the amount of washing water, and a range of 200 ml to 800 ml is particularly preferred in that this brings out the twin advantages of color image stability and water-saving effect.

The pH in the washing stage is normally within the range of 5 to 9. In addition, various compounds are added to the stabilizing bath in order to stabilize the image. For example, it is possible to add various buffering agents to adjust the film pH after processing (for example, the combined use of borates, metaborates, borax, phosphates, carbonates, potassium hydroxide, sodium hydroxide, aqueous ammonia, monocarboxylic acids, dicarboxylic acids, and polycarboxylic acids), and, in the same way as they can be added to the washing water, chelating agents, bactericides, formaldehyde and formaldehyde-releasing compounds such as hexamethylenetetramine as well as fluorescent brightening agents depending on the application. It is also possible to add various ammonium salts such as ammonium chloride, ammonium sulfite, ammonium sulfate and ammonium thiosulfate.

The pH of the stabilizing bath is normally 3 to 8, but a low pH range of 3 to 5 is particularly preferred due to variations in the type of light-sensitive material and its intended use.

The present invention can be applied to the processing of various color photographic materials. Typical examples of such color photographic materials include color negative films for general use and cinema, color reversal films for slides and television and the like.

Various color couplers can be used in the photographic material used in the present invention, and specific examples of these color couplers are disclosed in the patents described in the previously cited *Research Disclosure*, No. 17643, VII-C to G. Couplers which provide the three subtractive primary colors (namely, yellow, magenta and cyan) during color development are the most important of the color couplers, and the following couplers and the couplers described in the patents described in the previously cited RD 17643, VII-C and D can be used and are preferred in the present invention as specific examples of nondiffusion 4-equivalent and 2-equivalent couplers.

Known yellow couplers of the oxygen atom leaving type or known yellow couplers of the nitrogen atom leaving type are typical examples of yellow couplers which can be used. α-Pivaloylacetoanilide-based couplers have outstanding fastness, particularly light-fastness of the color-forming dye, while α-benzoylacetoanilide-based couplers provide a high color density.

Hydrophobic 5-pyrazolone-based and pyrazoloazole-based couplers with ballast groups are suitable as magenta couplers which can be used in the present invention. 5-Pyrazolone-based couplers in which the 3-position has been substituted with an arylamino group or an acylamino group are preferred from the standpoint of the hue and color density of the color forming dye.

Cyan couplers which can be used in the present invention include hydrophobic, nondiffusible naphtholic and phenolic couplers. Typical examples include 2-equivalent naphtholic couplers of the oxygen atom leaving type and these are preferred. Further, couplers able to form a cyan dye which is resistant to both moisture and heat are used preferably. Typical examples of these are described in U.S. Pat. No. 3,772,002 and include phenolic cyan couplers with an ethyl or higher alkyl group in the meta position of the phenol nucleus, 2,5-diacylamino-substituted phenolic couplers, phenolic couplers with a phenylureido group in the 2-position and an acylamino group in the 5-position or, as described in European Patent 161,626A, 5-aminonaphtholic cyan couplers and the like.

Graininess can be improved by the combined use of a coupler in which the color forming dye has a suitable degree of diffusibility. With respect to such couplers, actual examples of magenta couplers are described in, for example, U.S. Pat. No. 4,366,237, and specific examples of yellow, magenta and cyan couplers are described in, for example, European Patent 96,570.

Dye-forming couplers and the special couplers mentioned above may form dimers and higher polymers. Typical examples of polymerized dye-forming couplers are described in U.S. Pat. No. 3,451,820. Specific examples of polymerized magenta couplers are described in U.S. Pat. No. 4,367,282.

Couplers which release a photographically useful group upon coupling can also be used for preference in the present invention. The couplers in the patents described in the previously cited RD 17643, Section VII-F are useful as DIR couplers which release development inhibitors.

Couplers which release nucleating agents in the form of image or development accelerators or precursors thereof during development can be used in the photographic materials of the present invention. Specific examples of these compounds are described in British Patent 2,097,140 and 2,131,188. In addition, it is also possible to use couplers which release DIR redox compounds as described in JP-A-60-185950, couplers which release color-restoring dyes after split-off as described in European Patent 173,302A and the like.

The couplers to be used in the present invention can be incorporated into the photographic material using various known dispersion methods. Examples of high boiling organic solvents to be used in the oil-in-water dispersion method are described in U.S. Pat. No. 2,322,027. Further, specific examples of the processes, effects and impregnatable latexes used in the latex dispersion method are described in U.S. Pat. No. 4,199,363, West German Patent (OLS) Nos. 2,541,274 and 2,541,230.

Specific examples of the present invention are given below, but the present invention is not to be construed as being limited thereto.

EXAMPLE 1

Emulsion Preparation

The double jet method was used for 1 minute, with stirring, to add an aqueous solution of silver nitrate (5 g as silver nitrate) and an aqueous solution of potassium bromide containing 0.15 g of potassium iodide to a vessel in which 30 g of gelatin and 6 g of potassium bromide had been added to 1 l of water and which was maintained at 60° C. In addition, the double jet method was used to add an aqueous solution of silver nitrate (145 g as silver nitrate) and an aqueous solution of potassium bromide containing 4.2 g of potassium iodide. At this time, the addition flow rate was accelerated so that the flow rate at the end of the addition was 5 times that at the start of the addition. At the end of the addition, the soluble salts were removed by precipitation at 35° C. and then the temperature was increased to 40° C., 75 g of gelatin were added and the pH was adjusted to 6.7. The resulting emulsion comprised tabular grains with a projected surface area diameter of 0.98 μm and an average thickness of 0.138 μm and had a silver iodide content of 3 mol %. The emulsion was chemically sensitized by the combined use of gold and sulfur sensitization.

Preparation of Photographic Material

An aqueous gelatin solution containing polyarylamide with an average molecular weight of 8,000, sodium polystyrenesulfonate, polymethylmethacrylate grains with an average grain size of 3.0 μm, polyethylene oxide, and a film hardener as well as gelatin acting as the surface protective layer was used.

Anhydro-5,5'-dichloro-9-ethyl-3,3'-di(3-sulfopropyl-)oxacarbocyanine hydroxide sodium salt was added as a sensitizing dye to the above emulsion in a proportion of 500 ml/mol of Ag and potassium iodide was added in a proportion of 200 mg/mol of Ag. Furthermore, a photographic material was produced by preparing a coating solution by adding 4-hydroxy-6-methyl-1,3,3a,7-tetraazainddene and 2,6-bis(hydroxyamino)-4-diethylamino-1,3,5-triazine and nitron as stabilizers, trimethylol propane as a dry antifoggant and adding coating aids and film hardeners, coating the material onto both sides of a polyethylene terephthalate support simultaneously with the respective surface protective layers and drying. The coated silver amount in this photographic material was 2 g/m$^2$ on each side. The photographic material exhibited a percentage swelling of 120% as determined in accordance with the above described definition.

The photographic material thus prepared was then exposed to X-rays, and subjected to development processing with the following developer, fixing solution and washing solution.

| | |
|---|---|
| Concentrated Developer | |
| Potassium Hydroxide | 60 g |
| Sodium Sulfite | 100 g |
| Potassium Sulfite | 125 g |
| Diethylenetriaminepentaacetic Acid | 6 g |
| Boric Acid | 25 g |
| Hydroquinone | 87.5 g |
| Diethylene Glycol | 28 g |
| 4-Hydroxymethyl-4-methyl-1-phenyl-3-pyrazolidone | 6.25 g |
| 5-Methylbenzotriazole | 0.15 g |
| Water to make | 1 l |
| pH | 11.0 |
| Replenisher kit size | 5 l |
| Concentrated Fixing Solution | |
| Ammonium Thiosulfate | 560 g |
| Sodium Sulfite | 60 g |
| Disodium Ethylenedimainetetraacetate Dihydrate | 0.10 g |
| Sodium Hydroxide | 24 g |
| Compound of the Present Invention (as set forth in Table 1 below) | 5 mmol |
| Water to make | 1 l |

-continued

| | |
|---|---|
| pH adjusted with acetic acid to | 5.10 |
| Replenisher kit size | 5 l |
| Water Stock Tank Solution | 0.5 g/l |
| Disodium Ethylenedimainetetraacetate Dihydrate (antifungal agent) | |
| Automatic Processor | |
| Processed for 60 seconds on a dry-to-dry basis | |
| Developing Tank: | 7.5 l 35° C. × 11.5 sec. (facing rollers) |
| Developing Tank: | 7.5 l 35° C. × 12.5 sec. (facing rollers) |
| Washing Tank: | 6 l 20° C. × 7.5 sec. (facing rollers) |
| Squeeze Roller Washing Tank: | 200 ml |
| Water Stock Tank: | 25 l |
| Drying | |

A heater was used to maintain a predetermined temperature both in the developing tank and the fixing tank, but cooling water was not used.

At the beginning of the development processing, the processing tanks were filled with the following processing solutions:

| | |
|---|---|
| Developing Tank: | 400 ml of the above mentioned concentrated developer, 600 ml of water, and 10 ml of an aqueous solution containing 1.8 g of acetic acid; pH adjusted to 10.50 |
| Fixing Tank: | 250 ml of the above mentioned concentrated fixing solution and 750 ml of water |
| Washing Tank and cleaning tank: | Same composition as that in the above mentioned stock tank solution |
| Every time a quarter sheet (10 inch × 12 inch) of the above mentioned light-sensitive material was processed, replenishment was effected as follows. | |
| Developing Tank: | 20 ml of concentrated developer; stock tank water to make 30 ml |
| Fixing Tank: | 10 ml of concentrated fixing solution; part of overflow solution form the washing tank to make 30 ml |
| Washing Tank: | stock tank water from the squeeze roller cleaning tank (in the direction opposite to the running of the film) to make 60 ml |

In this manner, 50 quarter sheets of the light-sensitive material were subjected to running processing (percentage development per sheet: 40%) a day. During this processing, whenever the developer, fixing solution and washing water ran short, they were replenished.

When the light-sensitive material was developed, the amount of developer to be circulated and stirred was set at 20 l/min. When the light-sensitive material was not developed, it was set at 6 l/min.

When the development work for the day was finished, the rollers at the crossover between development and fixation and between fixation and washing were each cleaned with 80 ml of water intermittently and automatically sprayed through 10 nozzles from the washing water stock tank.

The dry-to-dry processing time was set at 60 seconds as described above.

Table 1 shows the residual color after processing (the value obtained by measuring the transmitted optical density of the non-image portion using a green light).

TABLE 1

| Present Invention Compound added to Fixing Solution | Residual Color after Processing (fresh properties) | Transmitted Optical Density after 50° C.-5 days |
|---|---|---|
| Control | 0.209 | 0.220 |

TABLE 1-continued

| Present Invention Compound added to Fixing Solution | Residual Color after Processing (fresh properties) | Transmitted Optical Density after 50° C.-5 days |
|---|---|---|
| Compound A (comparative) | 0.147 | 0.191 |
| Compound I-(2) (present invention) | 0.147 | 0.149 |
| Compound I-(4) (") | 0.149 | 0.149 |
| Compound I-(12) (") | 0.150 | 0.151 |
| Compound II-(1) (") | 0.151 | 0.153 |
| Compound II-(5) (") | 0.149 | 0.150 |
| Compound II-(7) (") | 0.148 | 0.149 |
| Compound II-(10) (") | 0.150 | 0.152 |

Table 1 shows that all the fixing solutions comprising the present compounds exhibit a small residual color after processing.

Compound A

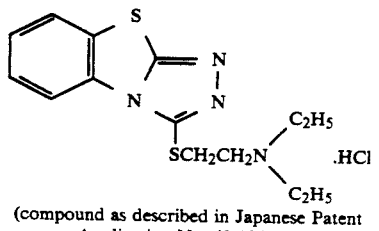

(compound as described in Japanese Patent Application No. 63-136717)

It was found that the present fixing solution is excellent in age stability as compared to the method described in Japanese Patent Application No. 63-136717.

EXAMPLE 2

A photographic material was prepared in the same manner as in Example 1, subjected to an X-ray exposure, and then subjected to development with a developer comprising 5 mmol/l of a compound of the present invention, followed by fixation, and washing in the same manner as in Example 1.

For residual color after processing, the transmitted optical density of the non-image portion was measured using green light. The results obtained are set forth in Table 2 below.

TABLE 2

| Sample No. | Compound of the Invention Added | Residual Color after Processing |
|---|---|---|
| 1 | None | 0.210 |
| 2 | I-(2) | 0.148 |
| 3 | I-(4) | 0.150 |
| 4 | I-(12) | 0.149 |
| 5 | II-(5) | 0.149 |
| 6 | II-(7) | 0.151 |

Table 2 shows that photographic materials which have been processed with developers comprising the present compounds exhibit less residual color after processing.

A photographic material comprising 200 ml/mol Ag of a $10^{-3}$ mol methanol solution of Compound I-(2) in the surface protective layer was processed with a developer free of this compound. As a result, the photographic material exhibited a residual color of 0.163 after processing.

EXAMPLE 3

Photographic materials, Samples 301 to 307 were prepared in the same manner as in Example 1 except that various sensitizing dyes set forth below were incorporated into the materials, and then the materials were subjected to development in an automatic processor in the same manner as in Example 1.

TABLE 3

| Sample No. | Sensitizing Dye (amount added mg/mol Ag) | Compound Added to the Photosensitive Material (5 mmol/l) | (Residual Color Density when a Compound of the Invention was not Used)-(Residual Color Density when a Compound of the Invention was Used) |
|---|---|---|---|
| 301 | A (500) | I-(2) | 0.072 |
| 302 | B (500) | II-(7) | 0.074 |
| 303 | C (400) | II-(7) | 0.073 |
| 304 | D (500) | I-(2) | 0.073 |
| 306 | E (500) | II-(7) | 0.070 |
| 306 | F (500) | II-(7) | 0.074 |
| 307 | G (500) | II-(5) | 0.073 |

In all cases, less residual color was obtained when a photographic material comprising a compound of the present invention was processed.

Sensitizing Dyes

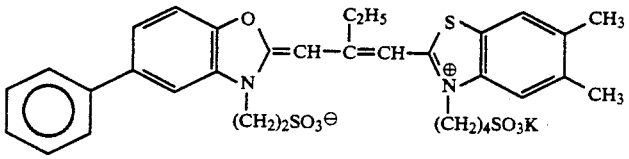

A

-continued

B

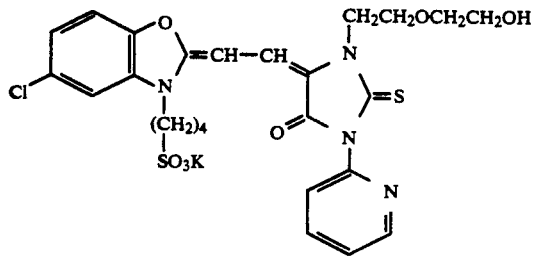

C

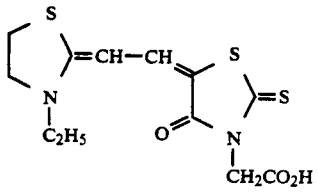

D

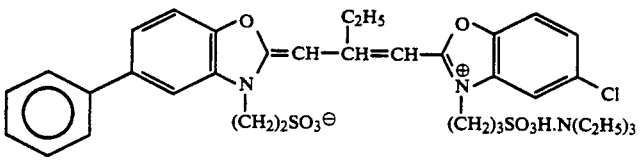

E

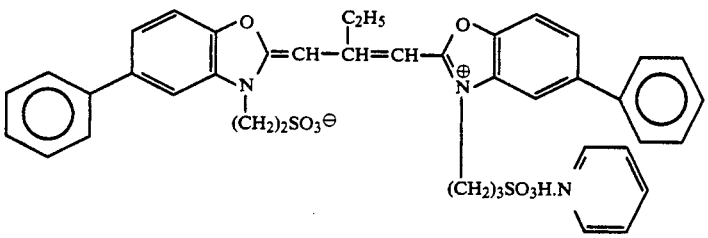

F

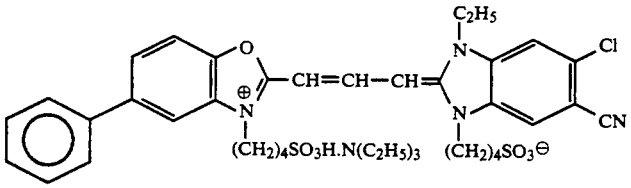

G

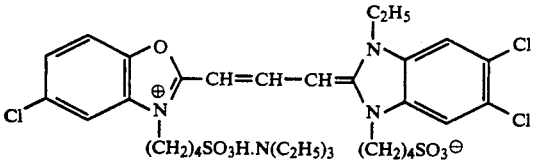

EXAMPLE 4

230 mg/l mol Ag of anhydro-5,5-dichloro-9-ethyl-3,3'-bis(3-sulfopropyl)oxacarbocyanine hydroxide sodium salt (sensitizing dye), 2.3 g/l mol Ag of a hydrazine derivative (as shown below), and 300 mg/l mol Ag of polyethylene glycol (molecular weight: about 1,000) were added to a 0.3 μm cubic silver bromoiodide emulsion containing 2.5 mol % of iodine and also then a dispersion of 5-methylbenzotriazole, 4-hydroxy-6-methyl-1,3,3a,7-tetraazaindene and polyethylene acrylate, and sodium 2-hydroxy-1,3,5-triazine was added. Furthermore, 1,3-divinylsulfonyl-2-propanol was added as a film hardener in an amount adjusted so that the percentage swelling was 120%.

A film was obtained by coating the coating solution thus prepared onto a polyethylene terephthalate film support together with a protective layer such that the coated silver amount was 3.5 g/m$^2$ and the coated gelatin amount (in both the emulsion layers and protective layer) was 3.0 g/m$^2$.

Hydrazine Derivative

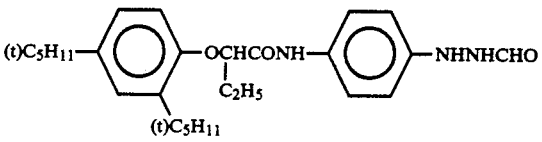

These films were exposed through a sensitometric optical wedge using a 150-line magenta contact screen and then developed for 15 seconds at a temperature of 40° C. in a developing solution with the following composition, followed by fixing using fixing solution GR-F1 made by Fuji Photo Film Co., Ltd., comprising Compound I(2) in an amount of 6 mmol/l, washed and dried.

The dry-to-dry time in the automatic processor used was set at 65 seconds.

| Developer | |
|---|---|
| Sodium Ethylenediaminetetraacetate | 1.0 g |
| Sodium Hydroxide | 9.0 g |
| 5-Sulfosalicylic Acid | 44.0 g |
| Potassium Sulfite | 100.0 g |
| 5-Methylbenzotriazole | 0.5 g |
| Potassium Bromide | 6.0 g |
| N-Methyl-p-aminophenol Hemisulfate | 0.4 g |
| Hydroquinone | 54.0 g |
| Sodium p-Toluenesulfonate | 30.0 g |
| Water to make | 1 l |
| pH | 11.7 |

An identical aqueous solution to that used in Example 1 was used for the washing water ad 250 ml of this solution was replenished per full size sheet (20 inch×24 inch).

The residual color after processing was measured in the same manner as in Example 1. The residual color density was found to be less than in the photographic material in which a compound of the present invention had not been used by 0.061.

EXAMPLE 5

A cubic monodisperse emulsion with an average [grain size of 0.25 μm and an average silver iodide content of 1 mol % was prepared by simultaneously adding, over 60 minutes while maintaining the pAg at 7.8, an aqueous solution of silver nitrate and an aqueous solution of potassium iodide and potassium bromide to an aqueous gelatin solution kept at 50° C., in the presence of $4\times10^{-7}$ mol per mol Ag of potassium hexachloroiridate (III). $5.6\times10^{-5}$ mol per mol Ag of the following compound as a sensitizing dye:

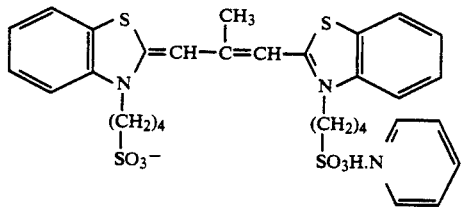

was added to these silver bromoiodide emulsions then, as stabilizers, 4-hydroxy-6-methyl-1,3,3a,7-tetraazaindene, a dispersion of polyethylene acrylate, polyethylene glycol, 1,3-vinylsulfonyl-2-propanol, 1-phenyl-5-mercaptotyetrazole 1,4-bis[3-(4-acetylaminopyridinio)-propionyloxy]-tetramethylene dibromide, the same hydrazine derivative as in Example 4 ($4.8\times10^{-3}$ mol per mol Ag) were added to the emulsions. The pH on the film surface was adjusted to 5.5 with ascorbic acid, and coating was carried out in a silver amount of 3.4 g/m$^2$ on a polyethyleneterephthalate film (the measurement of the film surface pH was in accordance with the method described in JP-A-62-25745). At the same time, a gelatin layer was coated onto the emulsion layer to a coated gelatin amount of 1.0 g/m$^2$. The resulting samples were exposed to light, developed, and then the photographic properties were measured.

The developer formulation was as follows:

| Developer | |
|---|---|
| Hydroquinone | 35.0 g |
| N-Methyl-p-aminophenol Hemisulfate | 0.8 g |
| Sodium Hydroxide | 13.0 g |
| Potassium Triphosphate | 74.0 g |
| Potassium Sulfite | 90.0 g |
| Tetrasodium Ethylenediaminetetraacetate Dihydrate | 1.0 g |
| Potassium Bromide | 4.0 g |
| 5-Methylbenzotriazole | 0.6 g |
| 3-Diethylamino-1,2-propanediol | 15.0 g |
| Compound I-(2) | 2.0 g |
| Water to make | 1 l |
| pH | 11.65 |

The fixing solution formulation was as follows:

| | | |
|---|---|---|
| Ammonium Thiosulfate | | 150.0 g |
| Sodium Sulfite | | 30.0 g |
| Acetic Acid | | 30.0 g |
| Water to make | | 1 l |
| pH adjusted with NaOH to | | 5.00 |
| Development | 40° C. | 15 sec. |
| Fixing | 37° C. | 16 sec. |
| Washing | | 12 sec. |
| Dry to dry | | 67 sec. |

Advantageously, the photographic properties (density Dmax, sensitivity) in the above samples had less residual color after processing (red density: 0.040).

EXAMPLE 6

A photographic material was prepared in the same manner as in Example 5, exposed, and then subjected to development in the same manner as in Example 5 except that 2.0 g/l of Compound II-(2) was added to the fixing solution instead of the developer. The samples exhibited a small residual color with a red density of 0.042.

EXAMPLE 7

A silver halide emulsion was prepared comprising silver bromochloride (5 mol % silver bromide; average grain diameter: 0.25 μm) containing $1\times10^{-5}$ mol of Rh per mol of silver.

500 mg/mol Ag of anhydro-5,5'-dichloro-9-ethyl-3,3'-di(3-sulfopropyl)oxacarbocyanine hydroxide sodium salt, as a sensitizing dye, was added to the above emulsion. Furthermore, sodium 2-hydroxy-4,6-dichloro-1,3,5-triazine was added as a film hardener and potassium polystyrene sulfonate was added as a viscosity enhancer and then coating was carried out onto a polyethylene terephthalate film at a coated silver amount of 4 g/m$^2$ A gelatin solution was coated onto this emulsion layer as a protective layer in a gelatin amount of 1.0 g/m$^2$ Sodium p-dodecylbenzensulfonate was used as a coating aid for this protective layer, and the same compound as in the emulsion layer was used as a viscosity enhancer.

A model P-607 printer available from Dai Nippon Screen Co., Ltd. was used to expose the resulting samples via an optical wedge and development processing was carried out using the following developing solution and fixing solution formulations.

Developer

Developer LD-8-35, available from Fuji Photo Film Co., Ltd., 38° C.-20 seconds

Fixing Solution

Solution obtained by adding 2.0 g/l of Compound I-(2) to fixing solution LF308, available from Fuji Photo Film Co., Ltd.

Automatic Processor

FD-800RA, available from Fuji Photo Film Co., Ltd.

TABLE 4

| Compound Added to Fixing Solution | Residual Color after Processing (fresh properties) | Transmitted Optical Density after 50° C.-5 days |
|---|---|---|
| Control | 0.211 | 0.219 |
| Compound A (comparative) | 0.159 | 0.189 |
| Compound I-(2) (present invention) | 0.162 | 0.164 |
| Compound I-(4) (present invention) | 0.159 | 0.160 |
| Compound I-(12) (present invention) | 0.160 | 0.160 |
| Compound II-(1) (present invention) | 0.163 | 0.164 |
| Compound II-(7) | 0.158 | 0.159 |

In all cases, less residual color was found when the photographic material was processed with the fixing solution comprising the compound used in the present invention. The present photographic materials also exhibited excellent age stability.

EXAMPLE 8

A sulfur-sensitized silver halide emulsion comprising 93 mol % of silver bromide and 7 mol % of silver iodide was prepared. The average diameter of the silver halide grains present in the emulsion was 0.7 μm. 1 kg of this emulsion contained 0.52 mol of silver halide.

1 kg portions of this emulsion were measured out into pots, 32 mg of Sensitizing Dye SD was added for each kilogram of emulsion and this was mixed with stirring at a temperature of 40° C. A photographic material was obtained by the sequential addition of 0.01 g per kilogram of emulsion of 4-hydroxy-6-methyl-1,3,3a,7-tetraazaindene, 0.1 g per kilogram of emulsion of sodium 1-hydroxy-3,5-dichlorotriazine, and $2\times10^{-4}$ mol per kilogram of emulsion of a compound used in the present invention and 0.1 g per kilogram of emulsion of sodium dodecylbenzenesulfonate, and coating the material onto a polyethylene terephthalate film base.

Sensitizing Dye SD

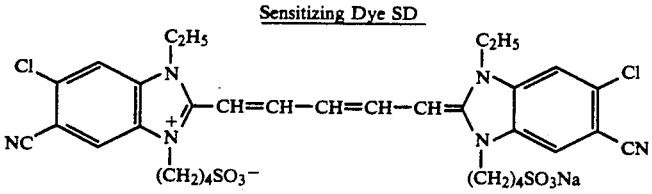

The film samples were subjected to an optical wedge exposure using a sensitometer and a light source with a color temperature of 2,854° K with a dark red filter (SC-74) made by Fuji Photo Film Co., Ltd. attached to the light source. After the exposure, development was carried out for 3 minutes at a temperature of 20° C. using a developer with the following composition, stopping was effected, and fixing was then carried out using the following fixing solution after which the samples were washed.

The residual color (transmitted optical density in the non-image areas) after processing is set forth in Table 5.

| Developer | |
|---|---|
| Water | 500 ml |
| N-Methyl-p-aminophenol | 2.2 g |
| Sodium Sulfite (anhydrous) | 96.0 g |
| Hydroquinone | 8.8 g |
| Sodium Carbonate (monohydrate) | 56.0 g |
| Potassium Bromide | 5.0 g |
| Water to make | 1 l |

Fixing Solution

Solution obtained by adding 2.0 g/l of the compound used in the present invention (set forth in Table 5 below) to fixing solution LF308, available from Fuji Photo Film Co., Ltd.

TABLE 5

| Sample No. | Compound added | (Residual Color Density when a Compound of the Invention Was Not Used)-(Residual Color Density when a Compound of the Invention Was Used) |
|---|---|---|
| 801 | I-(2) | 0.060 |
| 802 | I-(4) | 0.061 |
| 803 | II-(7) | 0.063 |

In all cases, less residual color was obtained when a photographic material was processed with the fixing solution containing the compound used in the present invention.

EXAMPLE 9

The double jet method was used to prepare a cubic monodisperse silver bromochloride emulsion with an average grain diameter of 0.3 μm (fluctuation coefficient: 0.13; silver iodide content: 0.1 mol %; silver bromide content: 33 mol %).

After this emulsion had been desalted, it was subjected to gold-sulfur sensitization. 6-Methyl-4-hydroxy-1,3,3a,7-tetraazaindene was added to the emulsion as a stabilizer. The emulsion was then subjected to dye sensitization with a sensitizing dye as set forth in Table 6 in an amount of 150 mg per mol of silver halide present in the emulsion. 500 mg of potassium bromide, 100 mg of sodium p-dodecylbenzenesulfonate, 30 mg of 5-nitroindazole, 20 mg of 5-methylbenzotriazole, 1.5 g of a styrene/maleic acid copolymer and 15 g of a styrene/ butyl acrylate copolymer latex (average grain diameter: 0.25 μm), each per mol of silver halide, were added. Furthermore, $1\times10^{-3}$ mol of a tetrazolium salt compound with the following structural formula was added for every mol of silver, and the material was then coated onto a support which had been subbed as disclosed in Example 1 of JP-A-59-19941 in a coated silver amount of 4.0 g/m2 and a gelatin amount of 2.1 g/m$^2$.

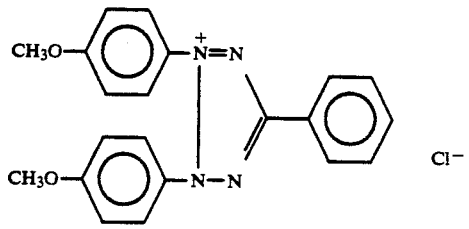

At this time, the sample was prepared by the simultaneous multi-layer coating of a protective layer containing 25 mg/m$^2$ of formaldehyde as a film hardener and 30 mg/m$^2$ of sodium 1-decyl-2-(3-isopentyl)succinate-2-sulfonate as an extender so that the gelatin amount was 1.2 g/m$^2$. These samples were processed for 30 seconds at a temperature of 28° C. using a GR-27 automatic processor made by Konica Corporation and under developing conditions using the Konica Developer CMD-651K and the Konica Fixer CGL-851 containing 2.0 g/l of each compound as set forth in Table 6.

Further, the coating of a backing layer with the formulation shown below was also carried out.

| Backing Layer | |
|---|---|
| Gelatin | 4 g/m$^2$ |
| Matting Agent: polymethyl methacrylate (grain diameter: 3.0 to 4.0 μm) | 10 mg/m$^2$ |
| Latex Polyethyl Acrylate | 2 g/m$^2$ |
| Surface Active Agent: Sodium p-Dodecylbenzenesulfonate | 40 mg/m$^2$ |
| Fluorine-based Surface Active Agent $C_8F_{17}SO_2N(C_3H_7)CH_2COOK$ | 5 mg/m$^2$ |
| Gelatin Hardener $(CH_2{=}CHSO_2CH_2CONH)_2(CH_2)_2$ | 110 mg/m$^2$ |
| Dye: a mixture of Dyes (a), (b) and (c) | |
| Dye (a) | 50 mg/m$^2$ |
| Dye (b) | 100 mg/m$^2$ |
| Dye (c) | 50 mg/m$^2$ |

-continued

Dye (a)

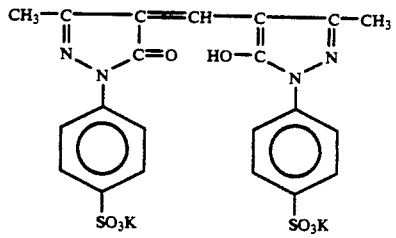

Dye (b)

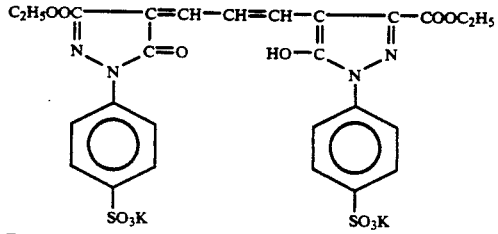

Dye (c)

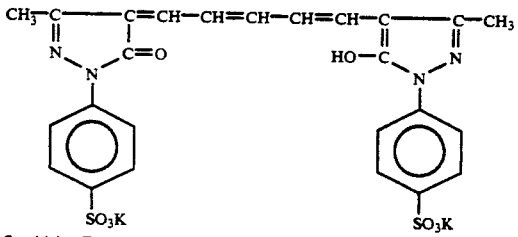

Sensitizing Dye A:
1-(β-Hydroxyethyl)-3-phenyl-5-[(3-α-sulfopropyl-α-benzoxazolidene)-ethylidene)thiohydantoin
Sensitizing Dye b:
Anhydro-5,5'-dichloro-9-ethyl-3,3'-di(3-sulfopropyl)oxaxarbocyanine hydroxide sodium salt
Sensitizing Dye C:
Potassium 4-[5-chloro-2-{2-[1-(5-hydroxy-3-oxapentyl-3-(2-pyridyl)-2-thiohydantoin-5-iridene]ethylidene}-3-benzoxazolinyl]butanesulfonate

TABLE 6

| Sample No. | Sensitizing Dye | Compound added | (Residual Color Density when a Compound of the Invention Was Not Used)-(Residual Color Density when a Compound of the Invention Was Used) |
|---|---|---|---|
| 901 | A | I-(2) | 0.051 |
| 902 | B | I-(2) | 0.053 |
| 903 | C | I-(4) | 0.053 |
| 904 | A | I-(4) | 0.049 |
| 905 | B | II-(7) | 0.048 |
| 906 | C | II-(7) | 0.050 |

In all cases, less residual color was found when a photographic material was processed with the fixing solution comprising the present compound.

EXAMPLE 10

A photographic material was prepared in the same manner as in Example 9, exposed, and then subjected to development in the same manner as in Example 9 except that the compound used in the present invention was added to the developer in stead of the fixing solution. The results obtained are set forth in Table 7 below.

TABLE 7

| Sample No. | Sensitizing Dye | Compound added | (Residual Color Density when a Compound of the Invention Was Not Used)-(Residual Color Density when a Compound of the Invention Was Used) |
|---|---|---|---|
| 1001 | A | I-(2) | 0.055 |
| 1002 | B | I-(2) | 0.057 |
| 1003 | C | I-(4) | 0.056 |
| 1004 | A | I-(4) | 0.053 |
| 1005 | B | II-(7) | 0.053 |
| 1006 | C | II-(7) | 0.056 |

EXAMPLE 11

A multi-layer color photographic material, Sample 1101 was prepared by multi-layer coating of the various layers thereof with the compositions shown below onto a subbed cellulose triacetate film support.

Composition of Light-Sensitive Layer

The figures corresponding to each of the constituents denote the amount coated given in units of g/m$^2$, while for the silver halides they denote the coated amount calculated as silver. However, the figures corresponding to the sensitizing dyes and the compounds used in the present invention denote the molar unit for the coated amount with respect to 1 mol of silver halide in the same layer.

Sample 1101

| | |
|---|---|
| First Layer: (Antihalation Layer) | |
| Black colloidal silver | 0.18 |
| Gelatin | 0.48 |
| Second Layer: (Interlayer) | |
| 2,5-Di-t-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.24 |
| Third Layer: (First Red-sensitive Emulsion Layer) | |
| Monodisperse silver bromoiodide emulsion (silver iodide content: 6 mol %; average grain diameter: 0.6 μm; grain diameter fluctuation coefficient: 0.15) | 0.55 |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| Sensitizing dye IV | $4.0 \times 10^{-5}$ |
| EX-2 | 0.350 |
| HBS-1 | 0.005 |
| EX-10 | 0.020 |
| Gelatin | 1.45 |
| Fourth Layer: (Second Red-sensitive Emulsion Layer) | |
| Tabular silver bromoiodide emulsion (silver iodide content: 10 mol %; average grain diameter: 0.7 μm; average aspect ratio: 5.5; average thickness: 0.2 μm) | 1.0 |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| EX-2 | 0.400 |
| EX-3 | 0.050 |
| EX-10 | 0.015 |
| Gelatin | 1.50 |

-continued

| | |
|---|---|
| Fifth Layer: (third Red-sensitive Emulsion Layer) | |
| Silver bromoiodide emulsion (silver iodide content: 16 mol %; average grain diameter: 1.1 μm) | 1.60 |
| Sensitizing Dye IX | $5.4 \times 10^{-5}$ |
| Sensitizing Dye II | $1.4 \times 10^{-5}$ |
| Sensitizing Dye III | $2.4 \times 10^{-4}$ |
| Sensitizing Dye IV | $3.1 \times 10^{-5}$ |
| EX-3 | 0.240 |
| EX-4 | 0.120 |
| HBS-1 | 0.22 |
| HBS-2 | 0.10 |
| Gelatin | 2.00 |
| Sixth Layer: (Interlayer) | |
| EX-5 | 0.040 |
| HBS-1 | 0.020 |
| EX-12 | 0.004 |
| Gelatin | 1.00 |
| Seventh Layer: (First Green-sensitive Emulsion Layer) | |
| Tabular silver bromoiodide emulsion (silver iodide content: 6 mol %; average grain diameter: 0.6 μm; average aspect ratio: 6.0; average thickness: 0.15 μm) | 0.40 |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-4 | 0.010 |
| Gelatin | 0.90 |
| Eighth Layer: (Second Green-sensitive Emulsion Layer) | |
| Monodisperse silver bromoiodide emulsion (silver iodide content: 9 mol %; average grain diameter: 0.7 μm; grain diameter fluctuation coefficient: 0.18) | 0.80 |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| EX-6 | 0.180 |
| EX-8 | 0.010 |
| EX-1 | 0.008 |
| EX-7 | 0.012 |
| HBS-1 | 0.160 |
| HBS-4 | 0.008 |
| Gelatin | 1.30 |
| Ninth Layer: (Third Green-sensitive Emulsion Layer) | |
| Silver bromoiodide emulsion (silver iodide content: 12 mol %; average grain diameter: 1.0 μm) | 1.2 |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| EX-6 | 0.065 |
| EX-11 | 0.030 |
| EX-1 | 0.025 |
| HBS-1 | 0.25 |
| HBS-2 | 0.10 |
| Gelatin | 2.00 |
| Tenth Layer: (Yellow Filter Layer) | |
| Yellow Colloidal Silver | 0.05 |
| EX-5 | 0.08 |
| HBS-3 | 0.03 |
| Gelatin | 1.10 |
| Eleventh Layer: (First Blue-sensitive Emulsion Layer) | |
| Tabular silver bromoiodide emulsion (silver iodide content: 6 mol %; average grain diameter: 0.6 μm; average aspect ratio: 5.6; average thickness: 0.15 μm) | 0.24 |
| Sensitizing Dye VIII | $3.5 \times 10^{-4}$ |
| EX-9 | 0.85 |
| EX-8 | 0.12 |
| HBS-1 | 0.28 |
| Gelatin | 1.50 |
| Twelfth Layer: (Second Blue-sensitive Emulsion Layer) | |
| Monodisperse silver bromoiodide emulsion | 0.45 |

-continued

| | |
|---|---|
| (silver iodide content: 10 mol %; average grain diameter: 0.8 μm; grain diameter fluctuation coefficient: 0.16 μm) | |
| Sensitizing Dye VIII | $2.1 \times 10^{-4}$ |
| EX-9 | 0.20 |
| EX-10 | 0.015 |
| HBS-1 | 0.03 |
| Gelatin | 0.55 |
| Thirteenth Layer: (Third Blue-sensitive Emulsion Layer) | |
| Silver bromoiodide emulsion (silver iodide content: 14 mol %; average grain diameter: 1.3 μm) | 0.77 |
| Sensitizing Dye VIII | $2.2 \times 10^{-4}$ |
| EX-9 | 0.20 |
| HBS-1 | 0.07 |
| Gelatin | 0.85 |
| Fourteenth Layer: (First Protective Layer) | |
| Silver bromoiodide emulsion (silver iodide content: 1 mol %; average grain diameter: 0.07 μm) | 0.5 |
| U-4 | 0.11 |
| U-5 | 0.17 |

-continued

| | |
|---|---|
| HBS-1 | 0.90 |
| Gelatin | 1.20 |
| Fifteenth Layer: (Second Protective Layer) | |
| Polymethyl Acrylate Grains (diameter: about 1.5 μm) | 0.54 |
| S-1 | 0.15 |
| S-2 | 0.05 |
| Gelatin | 0.90 |

As well as the above constituents, Gelatin Hardener H-1 and a surface active agent were incorporated into each layer.

Sample 1101 had a total photographic structural layer thickness of 22 μm and a film swelling rate $T_{\frac{1}{2}}$ of 12 seconds.

Following this, a change was made in the amount of gelatin and the amount of film hardener in each layer of Sample 1101 to prepare Sample 1102 with a thickness of 19 μm and with $T_{\frac{1}{2}}$ of 9 seconds, and Sample 1103 with a thickness of 17 μm and $T_{\frac{1}{2}}$ of 7 seconds.

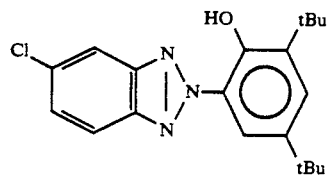

U-1

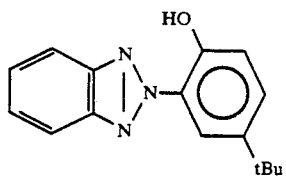

U-2

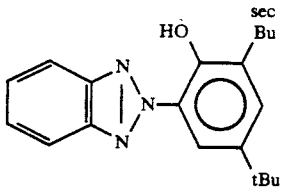

U-3

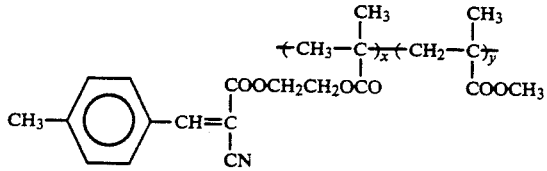

x/y = 7/3 (by weight)

U-4

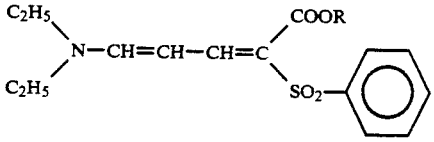

R = $C_8H_{17}$

U-5

-continued
EX-1
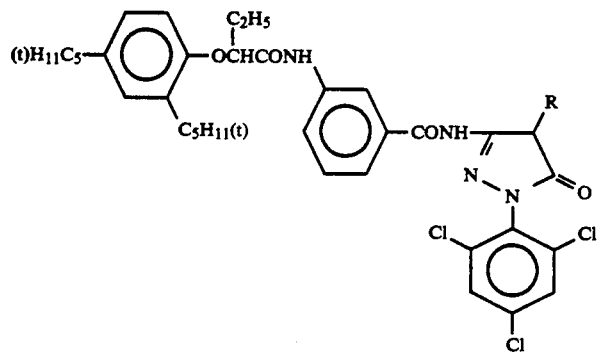
wherein R = 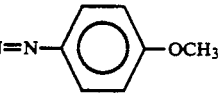
EX-2
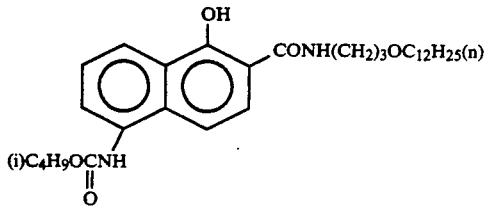
EX-3
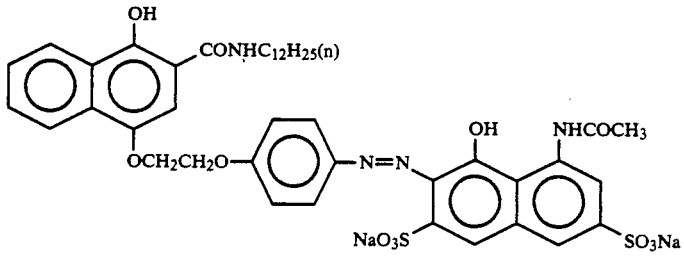
EX-4
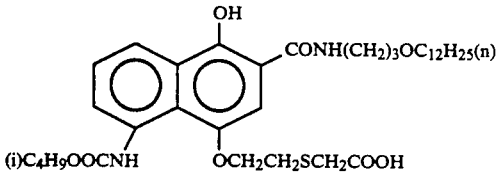
EX-5
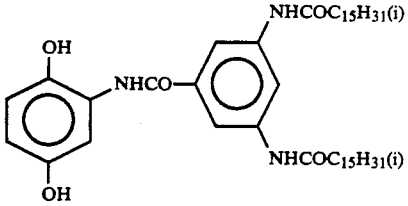
EX-6
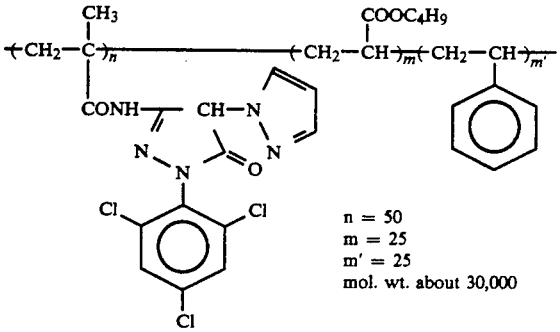
n = 50
m = 25
m' = 25
mol. wt. about 30,000

-continued
EX-7
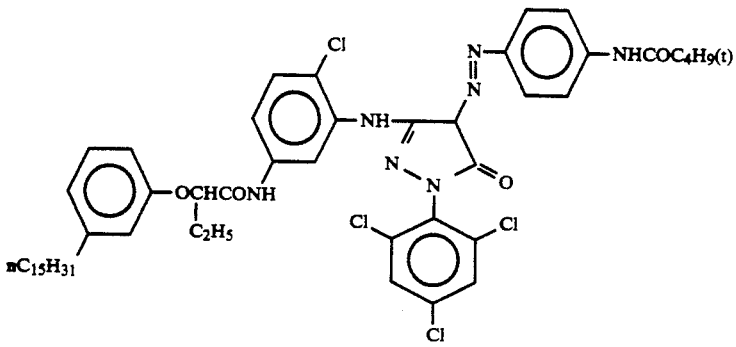
EX-8
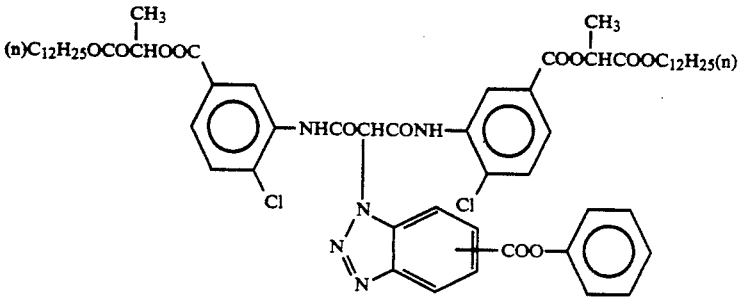
EX-9
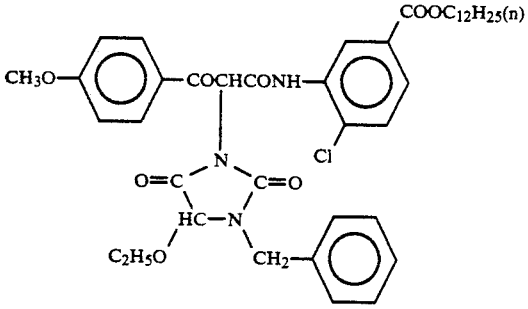
EX-10
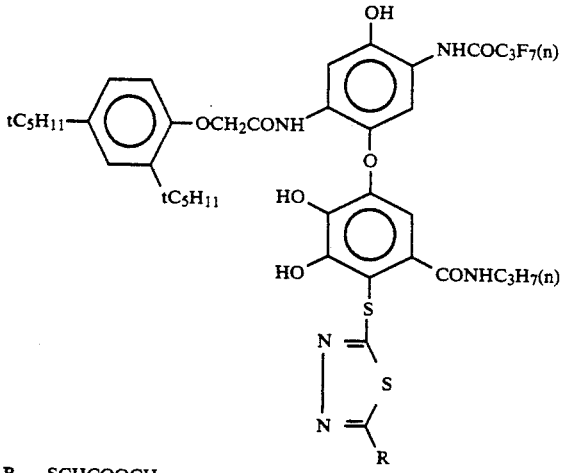
R = $SCHCOOCH_3$ (with $CH_3$)
EX-10
Same as EX-1 except that R = H
EX-11
EX-12
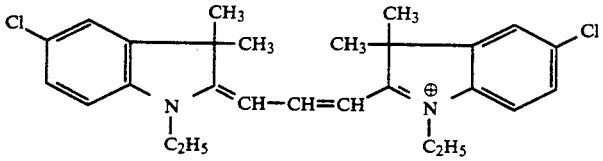

-continued
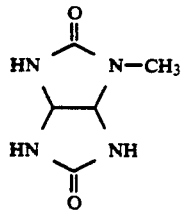
S-1
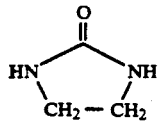
S-2
Tricresyl phosphate — HBS-1
Dibutyl phthalate — HBS-2
Bis(2-ethylexyl)phthalate — HBS-3
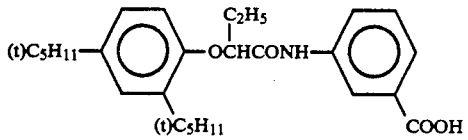
HBS-4
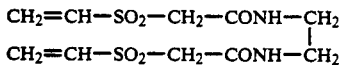
H-1
Sensitizing Dyes
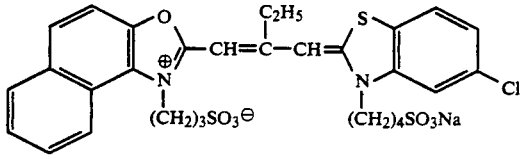
I
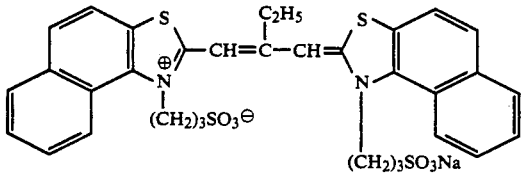
II
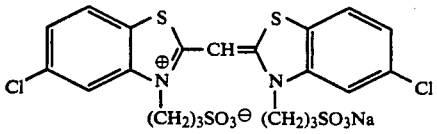
III
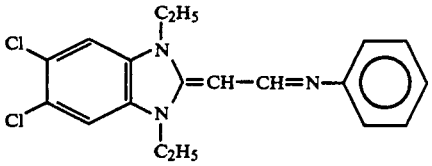
IV
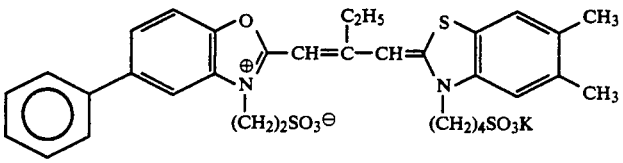
V -continued

VI

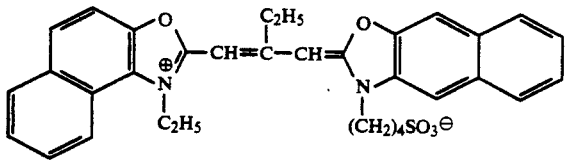

VII

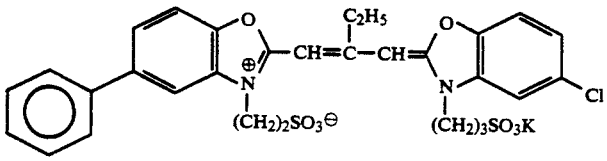

VIII

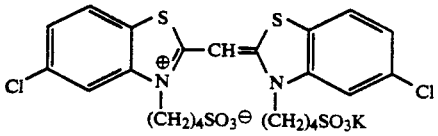

IX

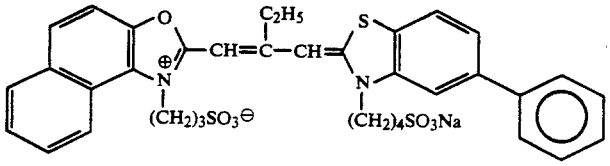

Samples 1101, 1102 and 1103 thus prepared were cut into 35 mm widths and then subjected to a standard exposure in a camera, 1 $m^2$ of each was subjected to mixed processing per day by means of the following processing using an automatic processor and this was continued for 10 days.

The transmitted magenta densities in the unexposed areas of the processed samples were measured at the beginning (fresh processing) and the end (running processing) of the above processing using Model X Light 310 photographic densitometer. The value for (running processing)—(fresh processing), which is to say the change in the magenta density due to the running, was determined.

Furthermore, the running processed samples were stored for 1 week under conditions of a relative humidity of 70% at a temperature of 60° C. to evaluate the changes in the transmitted magenta density over this period.

The results obtained are set forth in Table 8.

| Stage | Processing Time | Processing Temperature | Replenishment Rate | Tank Capacity |
|---|---|---|---|---|
| Color Development | 2 min 00 sec | 38° C. | 390 ml/$m^2$ | 10 l |
| Bleaching | 45 sec | 38° C. | 270 ml/$m^2$ | 4 l |
| Blix | 1 min 30 sec | 38° C. | 530 ml/$m^2$ | 8 l |
| Washing (1) | 15 sec | 35° C. | (countercurrent piping system in which water flows backward) | 4 l |
| Washing (2) | 15 sec | 35° C. | 270 ml/$m^2$ | 4 l |
| Stabilization | 15 sec | 38° C. | 270 ml/$m^2$ | 4 l |
| Drying | 1 min 15 sec | 55° C. | | |

In the above, the wet processing time from the time at which the photographic material is immersed in the color developer until it emerges from the stabilizing solution was 5 minutes. In addition, the total amount of replenisher was 1,730 ml.

| | Running Solution (g) | Replenisher (g) |
|---|---|---|
| Color Developer | | |
| Diethylenetriaminepentaacetic acid | 1.0 | 1.1 |
| 1-Hydroxyethylidene-1,1-diposphoric Acid | 3.0 | 3.2 |
| Sodium Sulfite | 4.0 | 5.8 |
| Potassium Carbonate | 30.0 | 37.0 |
| Potassium Bromide | 1.4 | — |
| Potassium Iodide | 1.5 mg | — |
| Hydroxylamine Sulfate | 2.4 | 3.5 |
| 4-(N-Ethyl-N-β-hydroxyethylamino)-2-methylaniline Sulfate | 4.5 | 7.2 |
| Water (tap water) to make | 1.0 l | 1.0 l |
| pH | 10.05 | 10.20 |

Bleaching Solution (The running solution and the replenisher were the same. (units: g))

| | |
|---|---|
| Ferric Ammonium Ethylenediaminetetraacetate Dihydrate | 160.0 |
| Disodium Ethylenediaminetetraacetate | 10.0 |
| Ammonium Bromide | 160.0 |
| Ammonium Nitrate | 10.0 |
| Bleach Accelerator | 0.010 mol |

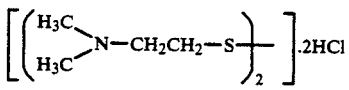

| | |
|---|---|
| Aqueous Ammonia (27% aq. soln.) | 5.0 ml |
| Compound I-(2) | 2.0 |
| Water (tap water) | 1.0 l |
| pH | 5.3 |

Blix Solution (The running solution and the replenisher were the same. (units: g))

| | |
|---|---|
| Ferric Ammonium Ethylenediaminetetraacetate Dihydrate | 80.0 |
| Disodium Ethylenediaminetetraacetate | 5.0 |

-continued

| | |
|---|---|
| Ammonium Sulfite | 15.0 |
| Ammonium Thiosulfate (700 g/l aq. soln.) | 300.0 l |
| Ammonia (27% aq. soln.) | 6.0 ml |
| Water to make | 1.0 l |
| pH | 7.2 |

Washing Water (The Running Solution and the Replenisher were the Same)

The following water quality was obtained by passing tap water through a mixed bed column charged with an H-type strongly acidic cation exchange resin (Amberlite IR-120B, commercially available from Rohm and Haas Company) and an OH-type anion exchange resin (Amberlite IR-400, commercially available from Rohm and Haas).

| | |
|---|---|
| Calcium: | 0.3 mg/l |
| Magnesium: | 0.1 mg/l |
| pH: | 6.5 |
| Conductivity: | 5.0 μs/cm |

Stabilizing Solution (The Running Solution and the Replenisher were the Same (Units: g))

| | |
|---|---|
| Formaldehyde (37% aq. soln.) | 1.0 ml |
| Polyoxyethylene-p-monononyl Phenyl Ether (average degree of polymerization: 10) | 0.3 |
| Disodium Ethylenediaminetetraacetate | 0.05 |
| Water (tap water) to make | 1.0 l |
| pH | 5.0–8.0 |

TABLE 8

| No. | Sample No. | Additive | Change in Magenta Density due to Running | Change in Magenta Density after 1 Week at 60° C.-70% RH |
|---|---|---|---|---|
| Comp. Ex. 1 | 1101 | None | +0.07 | +0.13 |
| Comp. Ex. 2 | 1102 | " | +0.06 | +0.11 |
| Comp. Ex. 3 | 1103 | " | +0.06 | +0.10 |
| Invention 4 | 1101 | I-(2) | +0.01 | +0.01 |
| Invention 5 | 1102 | I-(4) | ±0 | +0.01 |
| Invention 6 | 1103 | I-(11) | +0.02 | +0.02 |
| Invention 7 | 1101 | I-(13) | +0.02 | +0.02 |
| Invention 8 | 1102 | I-(16) | +0.01 | +0.01 |
| Invention 9 | 1103 | II-(2) | ±0 | +0.01 |
| Invention 10 | 1101 | II-(6) | +0.03 | +0.04 |
| Invention 11 | 1102 | II-(8) | +0.02 | +0.02 |
| Invention 12 | 1103 | II-(10) | +0.01 | +0.01 |

As shown by the results in Table 8, it is possible to control the increase in the magenta density in the non-exposed area caused by running at a level at which there is no practical impairment. Further, the increase in the magenta density in the unexposed area when stored at an elevated temperature or at a high humidity can also be controlled at the same time. It is also obvious that the above effects are improved by reducing the thickness of the photographic structural layers and accelerating the swelling rate $T_{\frac{1}{2}}$.

EXAMPLE 12

A multi-layer color photographic material, Sample 1201 was prepared by multi-layer coating of various layers with the compositions shown below onto a subbed cellulose triacetate film support.

Composition of Light-sensitive Layer

The figures corresponding to each of the components denote coated amounts in g/m$^2$, while for the silver halides they denote the coated amount calculated as silver. The figures corresponding to the sensitizing dyes and the compounds used in the present invention denote molar units for the coated amount with respect to 1 mol of silver halide in the same layer.

Sample 1201

| | |
|---|---|
| First Layer: (Antihalation layer) | |
| Black Colloidal Silver | 0.2 |
| Gelatin | 1.2 |
| Ultraviolet Absorbent UV-1 | 0.05 |
| Ultraviolet Absorbent UV-2 | 0.1 |
| Ultraviolet Absorbent UV-3 | 0.1 |
| Dispersing Oil OIL-1 | 0.02 |
| Second Layer: (Interlayer) | |
| Fine silver bromide grains (average grain size: 0.07 μm) | 0.15 |
| Gelatin | 1.2 |
| Third Layer: (First Red-sensitive Emulsion Layer) | |
| Monodisperse silver bromoiodide emulsion (silver iodide content: 6 mol %; average grain diameter: 0.4 μm; grain diameter fluctuation coefficient: 0.15) | 1.42 |
| Gelatin | 1.1 |
| Sensitizing Dye A | $2.0 \times 10^{-4}$ |
| Sensitizing Dye B | $1.0 \times 10^{-4}$ |
| Sensitizing Dye C | $0.3 \times 10^{-4}$ |
| Cp-b | 0.35 |
| Cp-c | 0.052 |
| Cp-d | 0.047 |
| D-1 | 0.023 |
| D-2 | 0.035 |
| HBS-1 | 0.10 |
| HBS-2 | 0.10 |
| Fourth Layer: (Interlayer) | |
| Gelatin | 1.0 |
| Cp-b | 0.10 |
| HBS-1 | 0.05 |
| Fifth Layer: (Second Red-sensitive Emulsion Layer) | |
| Monodisperse emulsion (silver iodide content: 6 mol %; average grain diameter: 0.5 μm; fluctuation coefficient: 15%) | 1.38 |
| Gelatin | 1.2 |
| Sensitizing Dye A | $1.5 \times 10^{-4}$ |
| Sensitizing Dye B | $2.0 \times 10^{-4}$ |
| Sensitizing Dye C | $0.5 \times 10^{-4}$ |
| Cp-b | 0.150 |
| Cp-d | 0.027 |
| D-1 | 0.005 |
| D-2 | 0.010 |
| HBS-1 | 0.050 |
| HBS-2 | 0.060 |
| Sixth Layer: (Third Red-sensitive Emulsion Layer) | |
| Monodisperse emulsion (silver iodide content: 7 mol %; average grain diameter: 1.1 μm; fluctuation coefficient: 16%) | 2.08 |
| Gelatin | 1.7 |
| Cp-a | 0.060 |
| Cp-c | 0.024 |
| Cp-d | 0.038 |
| D-1 | 0.006 |
| HBS-1 | 0.012 |
| Seventh Layer: (Interlayer) | |
| Gelatin | 1.2 |

-continued

| | |
|---|---|
| Cpd-A | 0.05 |
| HBS-2 | 0.05 |
| Eighth Layer: (First Green-sensitive Emulsion Layer) | |
| Monodisperse silver bromoiodide emulsion (silver iodide content: 3 mol %; average grain diameter: 0.4 μm; fluctuation coefficient: 19%) | 0.64 |
| Monodisperse silver bromoiodide emulsion (silver iodide content: 6 mol %; average grain diameter: 0.7 μm; fluctuation coefficient: 18%) | 1.12 |
| Gelatin | 1.2 |
| Sensitizing Dye D | $1 \times 10^{-4}$ |
| Sensitizing Dye E | $4 \times 10^{-4}$ |
| Sensitizing Dye F | $1 \times 10^{-4}$ |
| Cp-h | 0.20 |
| Cp-f | 0.61 |
| Cp-g | 0.084 |
| Cp-k | 0.035 |
| Cp-l | 0.036 |
| D-3 | 0.041 |
| D-4 | 0.018 |
| HBS-1 | 0.25 |
| HBS-2 | 0.45 |
| Ninth Layer: (Second Green-sensitive Emulsion Layer) | |
| Monodisperse silver bromoiodide emulsion (silver iodide content: 7 mol %; average grain diameter: 1.0 μm; grain diameter fluctuation coefficient: 18%) | 2.07 |
| Gelatin | 1.7 |
| Sensitizing Dye D | $1.5 \times 10^{-4}$ |
| Sensitizing Dye E | $2.3 \times 10^{-4}$ |
| Sensitizing Dye F | $1.5 \times 10^{-4}$ |
| Cp-f | 0.007 |
| Cp-h | 0.012 |
| Cp-g | 0.009 |
| HBS-2 | 0.088 |
| Tenth Layer: (Interlayer) | |
| Yellow Colloidal Silver | 0.06 |
| Gelatin | 1.4 |
| Cpd-A | 0.3 |
| HBS-1 | 0.3 |
| Eleventh Layer: (First Blue-sensitive Emulsion Layer) | |
| Monodisperse silver bromoiodide emulsion (silver iodide content: 6 mol %; average grain diameter: 0.4 μm; fluctuation coefficient: 20%) | 0.31 |

-continued

| | |
|---|---|
| Monodisperse silver bromoiodide emulsion (silver iodide content: 5 mol %; average grain diameter: 0.9 μm; fluctuation coefficient: 17%) | 0.38 |
| Gelatin | 2.0 |
| Sensitizing Dye G | $1 \times 10^{-4}$ |
| Sensitizing Dye H | $1 \times 10^{-4}$ |
| Cp-i | 0.63 |
| Cp-j | 0.57 |
| D-1 | 0.020 |
| D-4 | 0.015 |
| HBS-1 | 0.05 |
| Twelfth Layer: (Second Blue-sensitive Emulsion Layer) | |
| Monodisperse silver bromoiodide emulsion (silver iodide content: 8 mol %; average grain diameter: 1.3 μm; grain diameter fluctuation coefficient: 18%) | 0.77 |
| Gelatin | 0.7 |
| Sensitizing Dye G | $5 \times 10^{-5}$ |
| Sensitizing Dye H | $5 \times 10^{-5}$ |
| Cp-i | 0.10 |
| Cp-j | 0.10 |
| D-5 | 0.005 |
| HBS-2 | 0.10 |
| Thirteenth Layer: (Interlayer) | |
| Gelatin | 0.7 |
| Cp-m | 0.1 |
| UV-1 | 0.1 |
| UV-2 | 0.1 |
| UV-3 | 0.1 |
| HBS-1 | 0.05 |
| HBS-2 | 0.05 |
| Fourteenth Layer: (Protective Layer) | |
| Monodisperse silver bromoiodide emulsion (silver iodide content: 4 mol %; average grain diameter: 0.05 μm; grain diameter fluctuation coefficient: 10%) | 0.1 |
| Gelatin | 1.5 |
| Polymethyl methacrylate grains (average diameter: 1.5 μm) | 0.1 |
| S-1 | 0.2 |
| S-2 | 0.2 |

In addition, Surface Active Agent K-1 and Gelatin Hardener H-1 were also added.

Sensitizing Dye A

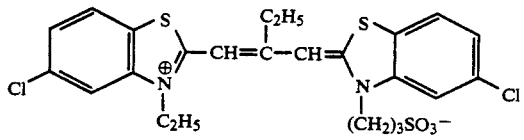

Sensitizing Dye B

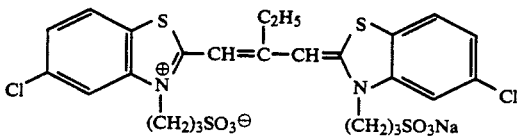

Sensitizing Dye C

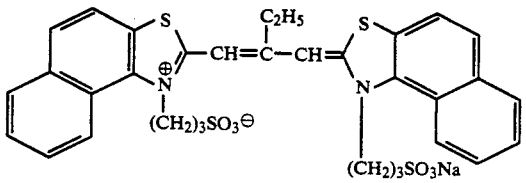

Sensitizing Dye D

-continued
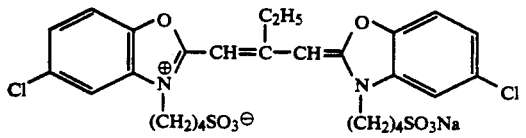
Sensitizing Dye E
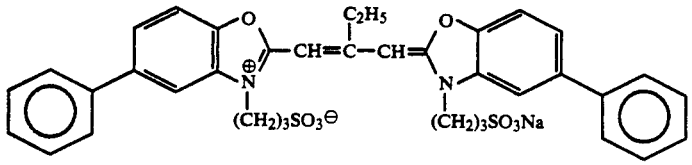
Sensitizing Dye F
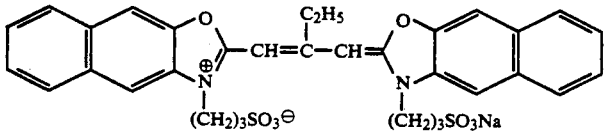
Sensitizing Dye G
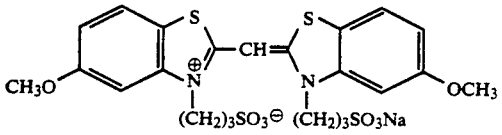
Sensitizing Dye H
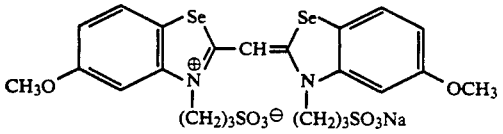
D-1
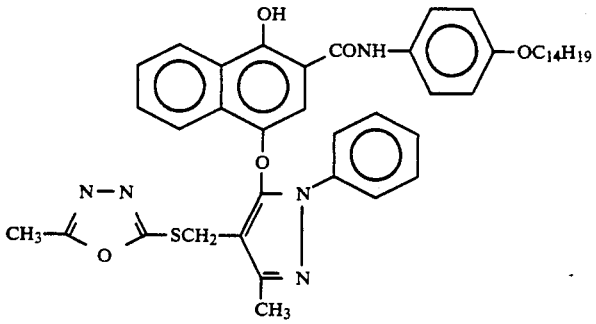
D-2
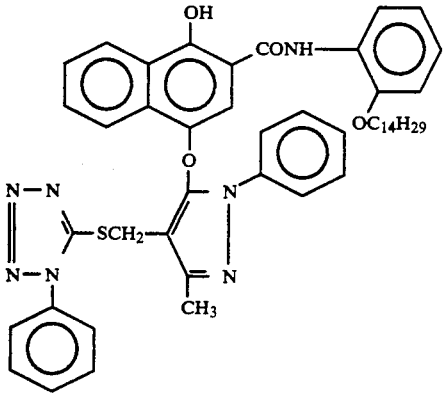

-continued
D-3
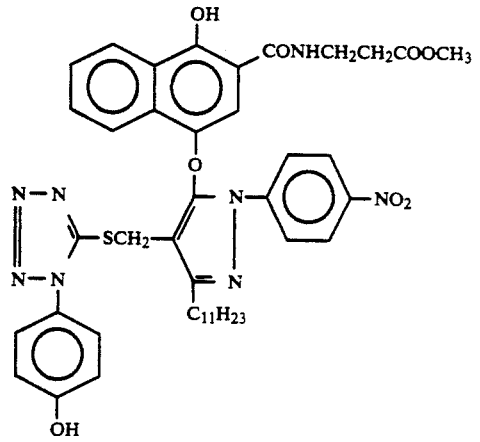
D-4
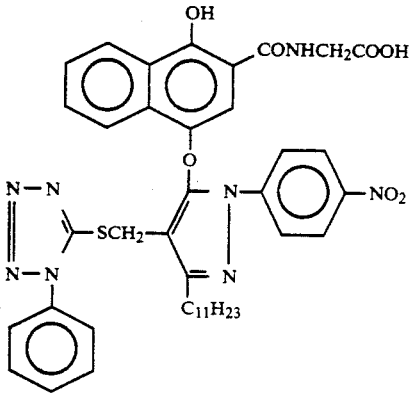
D-5
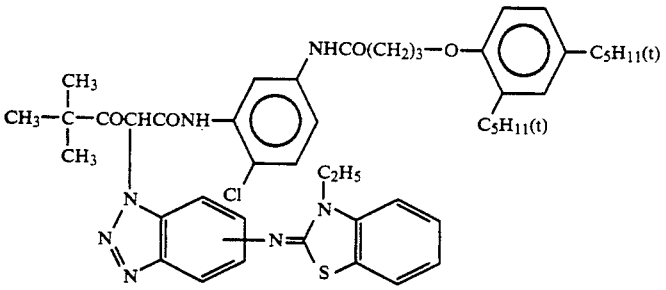
OIL-1
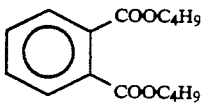
Cp-a
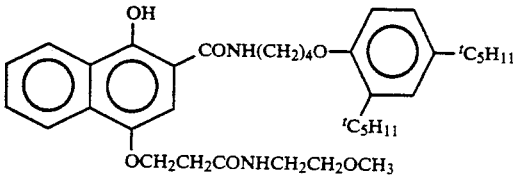
Cp-b -continued
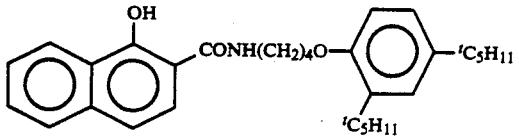
Cp-c
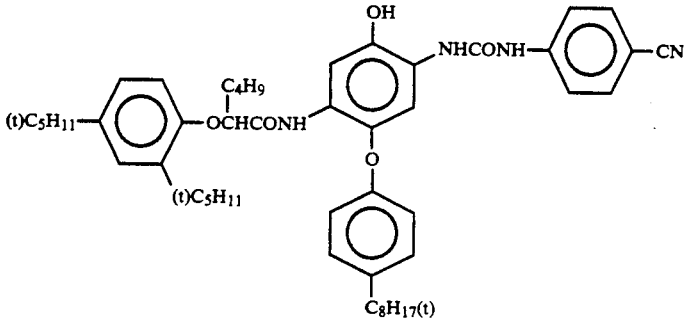
Cp-d
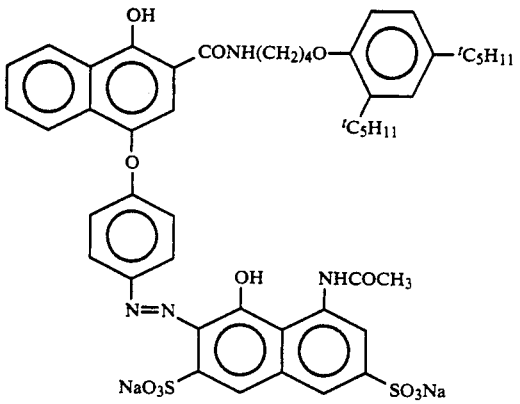
Cp-f
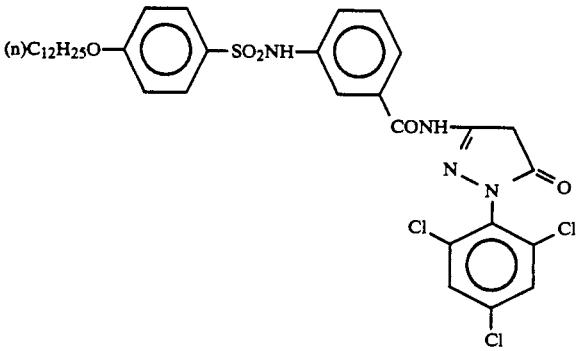
Cp-g -continued
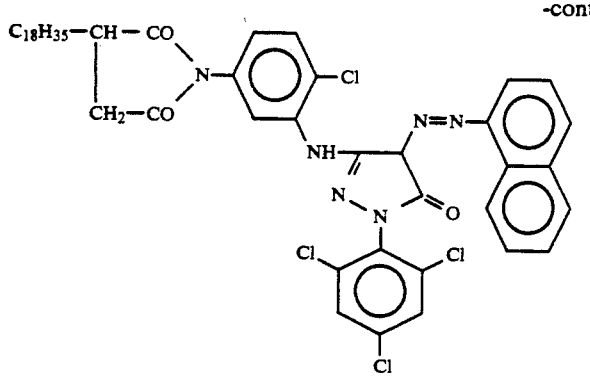
Cp-h
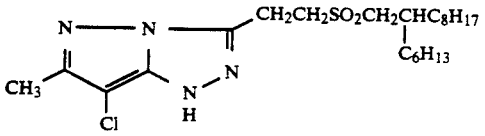
Cp-i
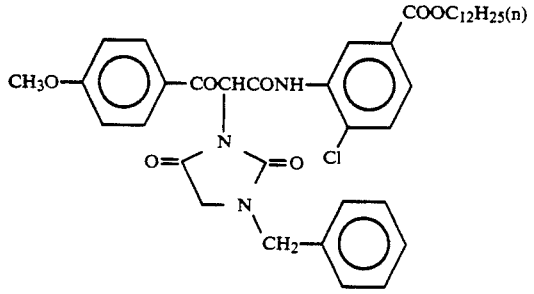
Cp-j
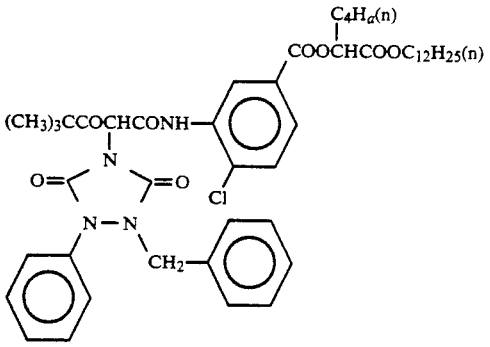
Cp-k
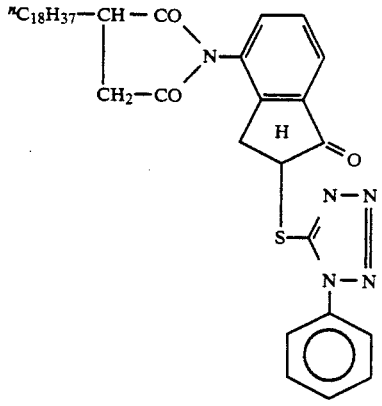
Cp-l -continued
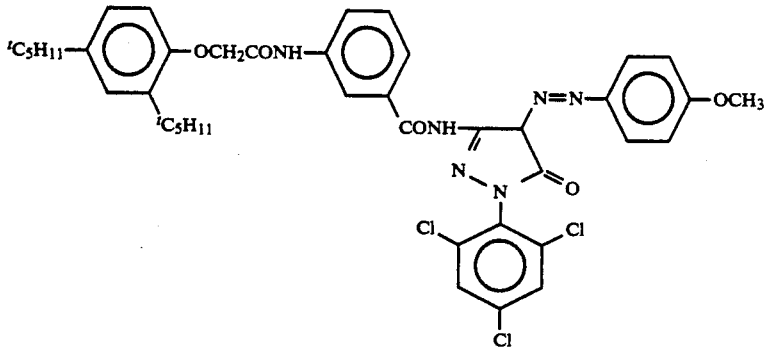
Cp-m
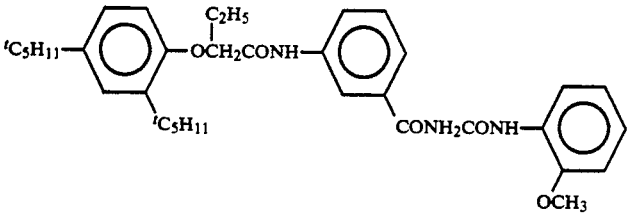
HBS-1
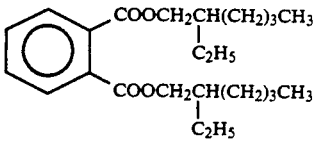
HBS-2
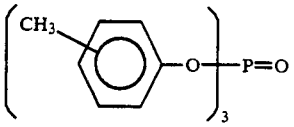
K-1
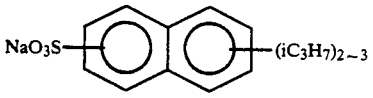
S-1
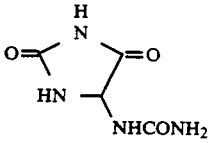
S-2
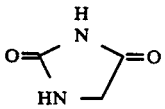
UV-1
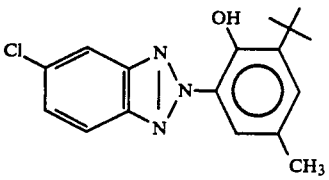
UV-2

-continued

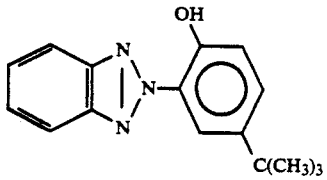

UV-3

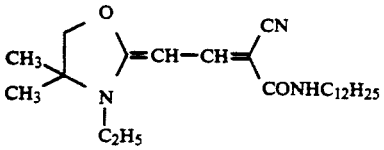

Cpd-A

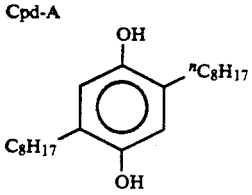

H-1

$CH_2{=}CH{-}SO_2{-}CH_2$
$CH_2{=}CH{-}SO_2{-}CH_2$

The amount of gelatin and the amount of film hardener in the above Sample 1201 was reduced overall to prepare the following samples.

| Sample No. | Thickness of Photographic Structural Layers | Film Swelling Rate $T_{\frac{1}{2}}$ |
|---|---|---|
| 1201 | 24 μm | 12 sec |
| 1202 | 19 μm | 8 sec |
| 1203 | 16 μm | 6 sec |

The above samples were exposed in a camera. These samples were each then subjected to mixed processing at 1 $m^2$ a day in the same manner as in Example 11, and this was continued for a total of 10 days.

The processing which was carried out was as is shown below.

Processing and evaluation of the samples were undertaken in the same manner as in Example 11.

| Stage | Processing Time | Processing Temperature | Replenishment Rate | Tank Capacity |
|---|---|---|---|---|
| Color development | 1 min 30 sec | 37.8° C. | 350 ml/$m^2$ | 10 l |
| Bleaching | 30 sec | 37.8° C. | 130 ml/$m^2$ | 5 l |
| Fixing | 1 min 15 sec | 37.8° C. | 500 ml/$m^2$ | 10 l |
| Stabilization (1) | 15 sec | 35° C. | (3-stage counter-current system in which water flows backward) | 5 l |
| Stabilization (2) | 15 sec | 35° C. | | 5 l |
| Stabilization (3) | 15 sec | 35° C. | 350 ml/$m^2$ | 5 l |
| Drying | 1 min | 55° C. | | |

The replenishment rates are per $m^2$.

In the above, the wet processing time was 4 minutes, and the total replenishment amount was 1,330 ml.

| | Running Solution (g) | Replenisher (g) |
|---|---|---|
| Color Developer | | |
| Diethylenetriaminepentaacetic Acid | 5.0 | 6.0 |
| Sodium Sulfite | 4.0 | 6.0 |
| Potassium Carbonate | 30.0 | 37.0 |
| Potassium Bromide | 1.3 | — |
| Potassium Iodide | 1.2 mg | — |
| Hydroxylamine Sulfate | 2.0 | 3.8 |
| 4-(N-Ethyl-N-β-hydroxyethylamino)-2-methylaniline Sulfate | 4.7 | 7.5 |
| Water (tap water) to make | 1.0 l | 1.0 l |
| pH | 10.00 | 10.20 |
| Bleaching Solution | | |
| Ferric 1,3-diaminopropanetetraacetate | 140 | 190 |
| Ethylenediaminetetraacetic Acid | 4.0 | 5.0 |
| Ammonium Bromide | 160.0 | 220.0 |
| Ammonium Nitrate | 30.0 | 50.0 |
| Ammonia (27% aq. soln.) | 20.0 ml | 23.0 ml |
| Acetic Acid (98% aq. soln.) | 80.0 ml | 120.0 ml |
| Water to make | 1.0 l | 1.0 l |
| pH | 4.3 | 4.0 |
| Fixing Solution | | |
| Disodium ethylenediaminetetraacetate | 0.5 | 0.7 |
| Ammonium Sulfite | 15.0 | 25.0 |
| Sodium Bisulfite | 5.0 | 10.0 |
| Ammonium Thiosulfate (700 g/l aq. soln.) | 270.0 ml | 320.0 ml |
| Compound used in the Present Invention (set forth in Table 9) | 2.0 | 2.0 |

The results obtained are set forth in Table 9 below.

TABLE 9

| No. | Sample No. | Additive | Change in Magenta Density due to Running | Change in Magenta Density after 1 Week at 60° C.-70% RH |
|---|---|---|---|---|
| Comp. Ex. 1 | 1201 | None | +0.08 | +0.14 |
| Comp. Ex. 2 | 1202 | " | +0.07 | +0.12 |
| Comp. Ex. 3 | 1203 | " | +0.07 | +0.11 |
| Invention 4 | 1201 | I-(2) | +0.02 | +0.02 |
| Invention 5 | 1202 | I-(4) | +0.01 | +0.01 |
| Invention 6 | 1203 | I-(11) | +0.01 | +0.01 |
| Invention 7 | 1201 | I-(13) | +0.02 | +0.03 |
| Invention 8 | 1202 | I-(16) | +0.01 | +0.01 |
| Invention 9 | 1203 | II-(2) | +0.02 | +0.02 |
| Invention 10 | 1201 | II-(6) | +0.03 | +0.03 |
| Invention 11 | 1202 | II-(8) | +0.02 | +0.03 |
| Invention 12 | 1203 | II-(10) | +0.02 | +0.02 |

As in Example 11, the present invention inhibits an increase in the magenta density of the unexposed areas and is effective in inhibiting an increase in the cyan density in the unexposed areas during storage at an elevated temperature and a high humidity.

EXAMPLE 13

A multi-layer color printing paper with the following layer structures was prepared on a paper support which had been laminated on both sides with polyethylene. The coating solutions were prepared as described below.

Preparation of the Coating Solution for the First Layer 27.2 cc of ethyl acetate and 8.2 g of a solvent (Solv-3) were added to 19.1 g of a yellow coupler (ExY), 4.4 g of a color image stabilizer (Cpd-1) and 0.7 g of a color image stabilizer (Cpd-7) to dissolve them. This solution was emulsified and dispersed in 185 cc o a 10% aqueous gelatin solution containing 8 cc of 10% sodium dodecylbenzenesulfonate. Meanwhile, the following blue-sensitizing dyes were added to a silver bromochloride emulsion (cubic; a 3:7 mixture (silver molar ratio) of grains with an average grain size of 0.88 μm and grains with an average grain size of 0.70 μm; fluctuation coefficients in the grain size distributions were 0.08 and 0.10, each emulsion containing 0.2 mol % of silver bromide localized at the grain surface) respectively in amounts of $2.0\times10^{-4}$ moles per mol of silver halide in the large-sized emulsion and respectively in amounts of $2.5\times10^{-4}$ moles per mol of silver halide in the small-sized emulsion, and after this sulfur sensitization was carried out. The above emulsified dispersion and this emulsion were mixed and dissolved to prepare a first coating solution with the composition given below.

The coating solutions for the second layer to the seventh layer were also prepared by methods similar to that for the first layer coating solution. Sodium 1-oxy-3,5-dichloro-s-triazine was used as a gelatin hardener in each layer.

The following spectral sensitizing dyes were incorporated into each layer.

Blue-sensitive Emulsion Layer

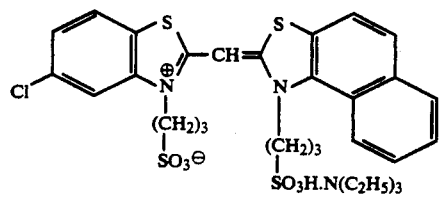

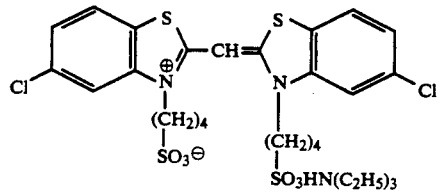

($2.0\times10^{-4}$ in the large-sized emulsion and $2.5\times10^{-4}$ mol n the small-sized emulsion with respect to 1 mol of silver halide)

Green-sensitive Emulsion Layer

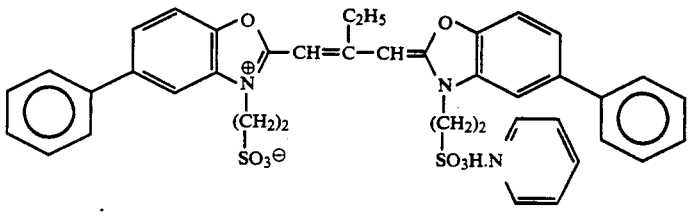

($6.0\times10^{-4}$ mol in the large-sized emulsion and $8.4\times10^{-4}$ mol in the small-sized emulsion with respect to 1 mol of silver halide)

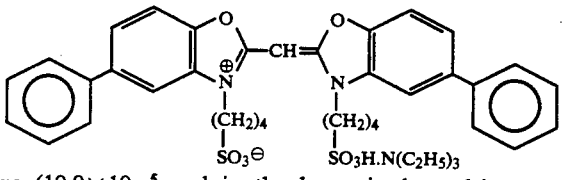

ps ($10.0\times10^{-5}$ mol in the large-sized emulsion and $1.5\times10^{-5}$ mol in the small-sized emulsion with respect to 1 mol of silver halide)

Red-sensitive Emulsion Layer

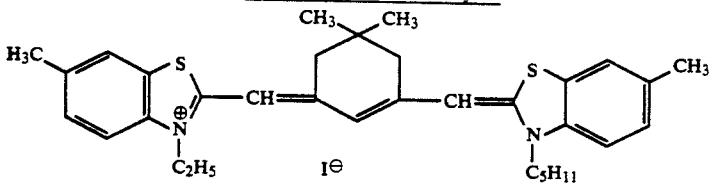

($0.9\times10^{-4}$ mol in the large-sized emulsion and $1.1\times10^{-4}$ mol in the small-sized emulsion with respect to 1 mol of silver halide)

The following compound was added to the red-sensitive emulsion layer in an amount of $2.6\times10^{-3}$ mol per mol of silver halide.

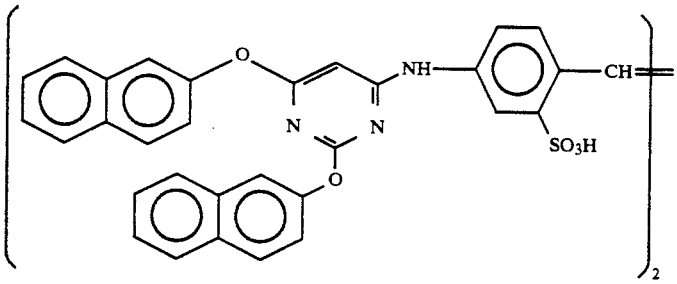

Further, 1-(5-methylureidophenyl)-5-mercaptotetrazole was added to the blue-sensitive emulsion layer, green-sensitive emulsion layer and red-sensitive emulsion layer in amounts of $8.5\times10^{-5}$ mol, $7.7\times10^{-4}$ mol and $2.5\times10^{-4}$ mol per mol of silver halide, respectively.

The following dyes were added to the emulsion layers to inhibit irradiation.

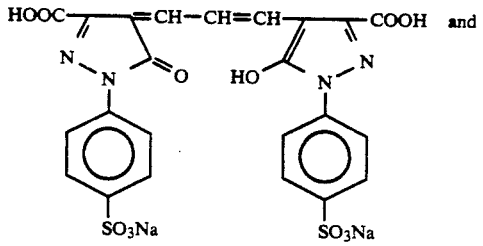

and

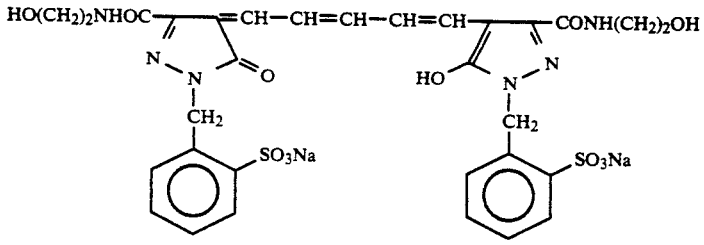

Layer Structure

The composition of each layer is given below. The figures represent coated amounts (g/m²). With the silver halide emulsions, they represent the coated amounts calculated in terms of silver.

Support

Polyethylene-laminated paper (containing a white pigment ($TiO_2$) and a blue dye (ultramarine) in the polyethylene on the first layer side)

| | |
|---|---|
| First Layer: (Blue-sensitive Layer) | |
| Silver bromochloride emulsion as mentioned above | 0.30 |
| Gelatin | 1.86 |
| Yellow Coupler (ExY) | 0.82 |
| Color Image Stabilizer (Cpd-1) | 0.19 |
| Solvent (Solv-3) | 0.35 |
| Dye Stabilizer (Cpd-7) | 0.06 |
| Second Layer: (Color Stain-inhibiting Layer) | |
| Gelatin | 0.99 |
| Color stain inhibitor (Cpd-5) | 0.08 |

-continued

| | |
|---|---|
| Solvent (Solv-1) | 0.16 |
| Solvent (Solv-4) | 0.08 |
| Third Layer: (Green-sensitive Layer) | |
| Silver bromochloride emulsion (cubic; a 1:3 mixture (Ag molar ratio) of grains with an average grain size of 0.55 μm and grains with an average grain size of 0.39 μm; fluctuation coefficients in the grain size distribution were 0.10 and 0.08, each emulsion contained 0.8 mol % of AgBr locally at the grain surface) | 0.12 |
| Gelatin | 1.24 |
| Magenta Coupler (ExM) | 0.20 |
| Color Image Stabilizer (Cpd-2) | 0.03 |
| Color Image Stabilizer (Cpd-3) | 0.15 |
| Color Image Stabilizer (Cpd-4) | 0.02 |
| Color Image Stabilizer (Cpd-9) | 0.02 |
| Solvent (Solv-2) | 0.40 |
| Fourth Layer: (Ultraviolet-absorbing Layer) | |
| Gelatin | 1.58 |
| Ultraviolet absorbent (UV-1) | 0.47 |
| Color stain inhibitor (Cpd-5) | 0.05 |
| Solvent (Solv-5) | 0.24 |
| Fifth Layer: (Red-sensitive Layer) | |
| Silver bromochloride emulsion (cubic; a 1:4 mixture (Ag molar ratio) of grains with an average grain size of 0.58 μm and grains with an average grain size of 0.45 μm; fluctuation coefficients in the grain size distribution were 0.09 and 0.11, each emulsion contained 0.6 mol % of AgBr locally at the grain surface) | 0.23 |
| Gelatin | 1.34 |
| Cyan Coupler (ExC) | 0.32 |
| Color Image Stabilizer (Cpd-6) | 0.17 |
| Color Image Stabilizer (Cpd-7) | 0.40 |
| Color Image Stabilizer (Cpd-8) | 0.04 |
| Solvent (Solv-6) | 0.15 |
| Sixth Layer: (Ultraviolet-absorbing Layer) | |
| Gelatin | 0.53 |
| Ultraviolet Absorbent (UV-1) | 0.16 |
| Color Stain Inhibitor (Cpd-5) | 0.02 |
| Solvent (Solve-5) | 0.08 |
| Seventh Layer: (Protective Layer) | |
| Gelatin | 1.33 |
| Acryl-modified Copolymer of Polyvinyl alcohol (degree of modification: 17%) | 0.17 |
| Liquid Paraffin | 0.03 |

(ExY) Yellow Coupler
1:1 mixture (molar ratio) of:

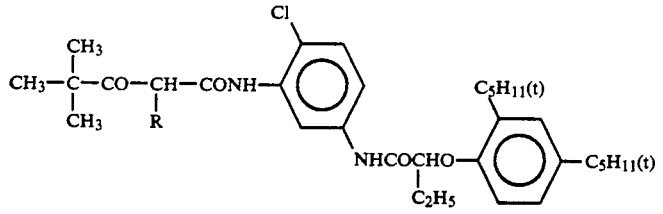

R =

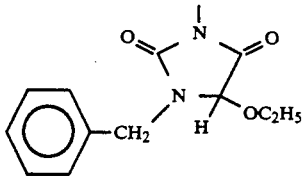

R =

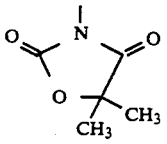

(ExM) Magenta Coupler
1:1 mixture (molar ratio) of:

-continued
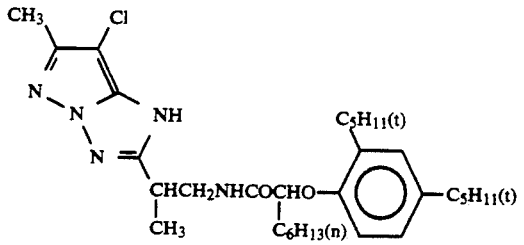
and
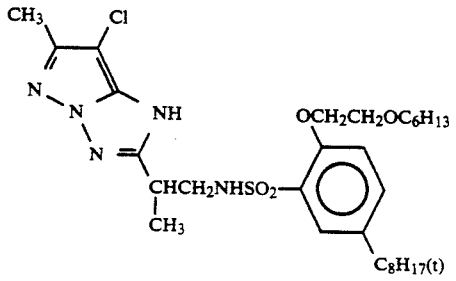
(ExC) Cyan Coupler
2:4:4 mixture by weight of:
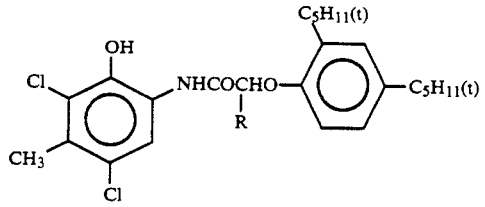
R = $C_2H_5$ and $C_4H_9$
and
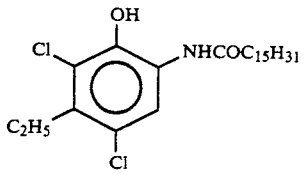
(Cpd-1) Color Image Stabilizer
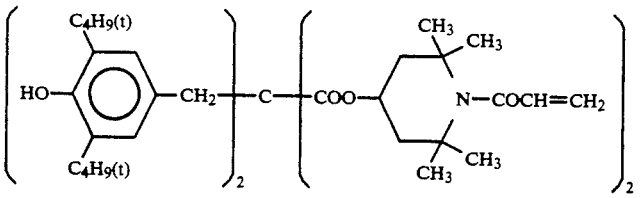
(Cpd-2) Color Image Stabilizer
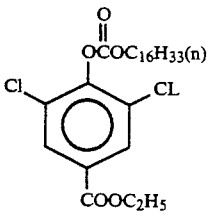
(Cpd-3) Color Image Stabilizer -continued
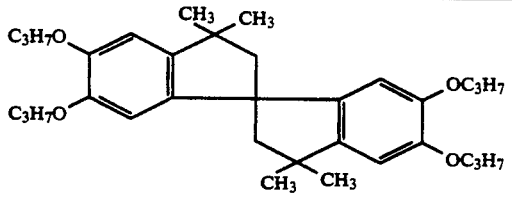
(Cpd-4) Color Image Stabilizer
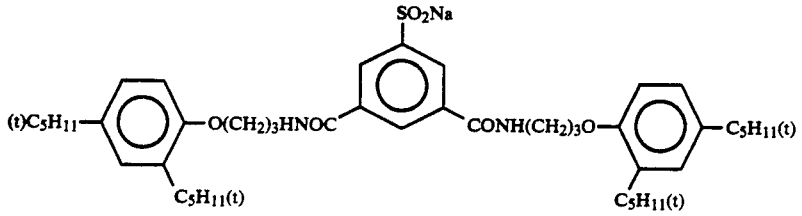
(Cpd-5) Color Stain Inhibitor
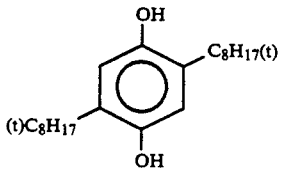
(Cpd-6) Color Image Stabilizer
2:2:4 mixture by weight of:
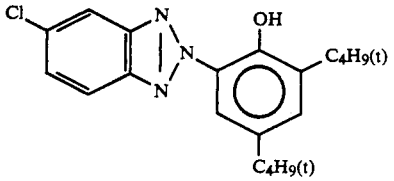
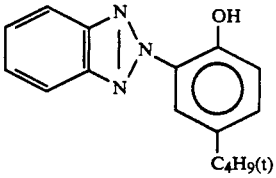
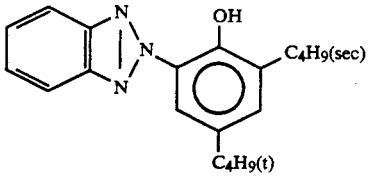
(Cpd-7) Color Image Stabilizer
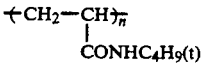
(Average molecular weight 60,000)
(Cpd-8) Color Image Stabilizer
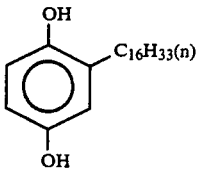
(Cpd-9) Color Image Stabilizer -continued
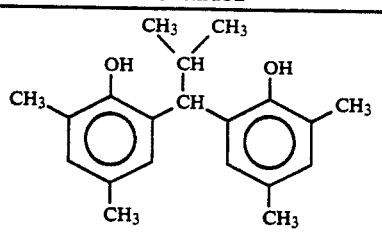
(UV-1) Ultraviolet Absorbent
4:2:4 mixture by weight of:
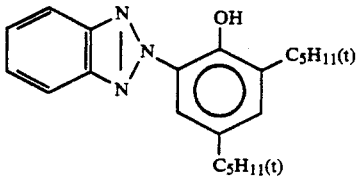
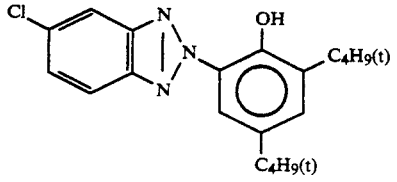
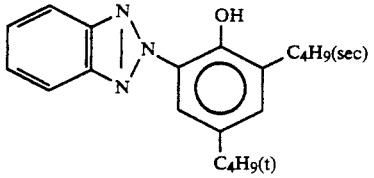
(Solv-1) Solvent
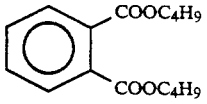
(Solv-2) Solvent
2:1 mixture by volume of:
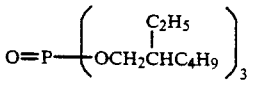
and
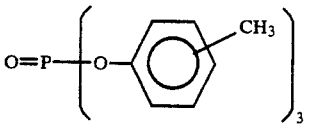
(Solv-3) Solvent
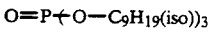
(Solv-4) Solvent
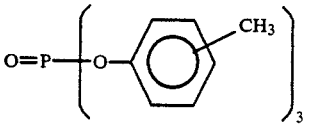
(Solv-5) Solvent
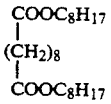

-continued (Solv-6) Solvent

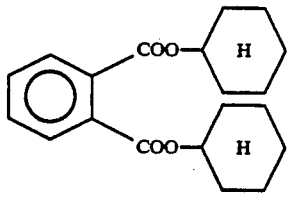

Firstly, each of the samples was subjected to continuous processing (running test) comprising the following processing stages and a paper processing machine until the color development tank capacity had been replenished twice.

| Processing Stage | Temperature | Time | Replenisher* | Tank Capacity |
|---|---|---|---|---|
| Color Development | 38° C. | 20 sec. | 161 ml | 17 l |
| Blix | 35–38° C. | 20 sec. | 215 ml | 17 l |
| Rinse (1) | 35–38° C. | 7 sec. | — | 10 l |
| Rinse (2) | 35–38° C. | 7 sec. | — | 10 l |
| Rinse (3) | 35–38° C. | 6 sec. | 350 ml | 10 l |
| Drying | 70–80° C. | 30 sec. | | |

*The replenishment rate is per $m^2$ of photographic material.

(The rinse was effected in a 3-tank counter-current system in which water flows backward.)

The compositions of the processing solutions used were as given below.

| | Running Solution (g) | Replenisher (g) |
|---|---|---|
| Color Developer | | |
| Water | 800 ml | 800 ml |
| Ethylenediamine-N,N,N,N-tetramethylene Phosphonate | 1.5 | 2.0 |
| Potassium Bromide | 0.015 | — |
| Triethanolamine | 8.0 | 12.0 |
| Sodium Chloride | 1.4 | — |
| Potassium Carbonate | 25 | 25 |
| N-Ethyl-N-(β-methanesulfonamidoethyl)-3-methyl-4-aminoaniline Sulfate | 5.0 | 7.0 |
| N,N-Bis(carboxymethyl)hydrazine | 5.5 | 7.0 |
| Water to make | 1,0000 ml | 1,000 ml |
| pH (25° C.) | 10.05 | 10.45 |
| Blix Solution | | |
| (The tank solution and the replenisher were the same.) | | |
| Water | | 400 ml |
| Compound I-(2) | | 2.0 g |
| Thiosulfate (70% aq. soln.) | | 100 ml |
| Sodium Sulfite | | 17 g |
| Ferric Ammonium Ethylenediaminetetraacetate | | 55 g |
| Disodium Ethylenediaminetetraacetate | | 5 g |
| Ammonium Bromide | | 40 g |
| Water to make | | 1,000 ml |
| pH (25° C.) | | 6.0 |

Rinse Solution (The tank solution and the replenisher were the same.)

Ion-exchanged water (calcium and magnesium concentrations: 3 ppm or less each)

Upon processing the photographic material containing a compound as used in the present invention produced as described above, the reflected density based on the residual color from sensitizing dye in the unexposed area was markedly improved and lower than a photographic material which did not contain a compound as used in the present invention by 0.049.

EXAMPLE 14

A 1N aqueous solution of silver nitrate and an aqueous solution containing 0.988 mol of potassium bromide and 0.012 mol of potassium iodide were mixed in the double jet process while the pAg of the system was appropriately controlled to obtain a silver bromoiodide emulsion. After washing with water and desalting, the emulsion was then subjected to gold sensitization and sulfur sensitization to obtain an optimum sensitization. As a result, an emulsion of tetradecahedral silver bromoiodide grains having an average grain diameter of 0.6 μm and containing (100) plane in a proportion of 86% was obtained.

30 g of the silver bromoiodide emulsion thus prepared was measured out in a pot. Sensitizing Dye (1) and Surface Active Agent (2)-1 or (2)-2 were added to the emulsion in amounts of $2.07\times10^{-4}$ mol/mol Ag and 3.54 g/mol Ag, respectively. Furthermore, a 0.02% solution of 5-mercapto-1-phenyltetrazole, a 2% solution of 2-hydroxy-4,6-dichlorotriazine sodium salt, a 10% gelatin gel, and water were added to the system in amounts such that the amount of silver and gelatin in 120 g thereof was 3.12 g and 5.4 g, respectively. Meanwhile, an aqueous solution mainly composed of gelatin was prepared. The aqueous gelatin solution and the above emulsion were simultaneously coated on a polyethylene-laminated paper with the emulsion kept in contact with the support in amounts such that the coated amount of the aqueous gelatin solution and the emulsion reached 1.5 g/$m^2$ and 2.25 g/$m^2$, calculated in terms of gelatin, respectively, to prepare photographic materials.

These samples were exposed to light of 3,200 lux at a color temperature of 2,854° K. through an optical wedge for $10^{-2}$ seconds and light from a xenon lamp through an optical wedge for $10^{-6}$ seconds.

After exposure to light, these samples were developed with a developer (replenishment rate: 0.39 l/$m^2$ of light-sensitive material) and a fixing solution having the following compositions for 15 seconds at a temperature of 35° C., stopped, fixed (replenishment rate: 0.39 l/$m^2$ of light-sensitive material) at a temperature of 30° C. for 12 seconds, and then washed with water to obtain strips having black-and-white images.

Sensitizing Dye (1)

-continued

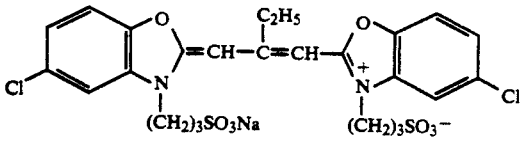

Sensitizing Dye (2)-1

$C_{14}H_{29}OSO_3Na$

Sensitizing Dye (2)-2

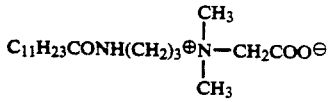

Developer

| | |
|---|---|
| 1-Phenyl-3-pyrazolidone | 0.4 g |
| Sodium Sulfite | 67.0 g |
| Hydroquinone | 23.0 g |
| Potassium Hydroxide | 11.0 g |
| Sodium Carbonate (monohydrate) | 11.0 g |
| Potassium Bromide | 3.0 g |
| 5-Methylbenzotriazole | 133 mg |
| Water to make | 1 l |

Fixing Solution

| | |
|---|---|
| Ammonium Thiosulfate | 170.0 g |
| Sodium Sulfite (anhydrous) | 15.0 g |
| Boric Acid | 7.0 g |
| Acetic Acid (glacial) | 15.0 ml |
| Potassium Alum | 20.0 g |
| Ethylenediaminetetraacetic Acid | 0.1 g |
| Tartaric Acid | 3.5 g |
| Water to make | 1 l |

For the evaluation of residual color, the absorption of the residual sensitizing dye at λmax was then measured on the unexposed portion thereof by means of Type 607 Color Analyzer available from Hitachi, Ltd. in a reflectmetric process.

TABLE 10

| Light-sensitive Material | | Processing | Residual Color |
|---|---|---|---|
| I | Surface Active Agent (2)-1 | Fixing solution as mentioned above | 0.125 |
| | | Fixing solution as mentioned above + Compound I-(2) 1.5 g | 0.048 |
| II | Surface Active Agent (2)-2 | Fixing solution as mentioned above | 0.065 |
| | | Fixing solution as mentioned above + Compound I-(2) 1.5 g | 0.040 |

The residual color is preferably 0.09 or less as represented by the figures in Table 10. If this value exceeds this range, the results can be recognized as residual color under a careful observation, and the products thus obtained cannot be put into commercial use. If this value exceeds 0.1, the results can be recognized as remarkable residual color.

In the present method, remarkably little residual color occurs.

EXAMPLE 15

30 g of gelatin, 5 g of potassium bromide, and 0.05 g of potassium iodide were added to 1 l of water and kept at a temperature of 75° C. An aqueous solution of silver nitrate (containing 5 g of silver nitrate) and an aqueous solution containing 0.75 g of potassium iodide were added to the system for 1 minute in the double jet process with stirring. Furthermore, an aqueous solution of silver nitrate and an aqueous solution of potassium bromide were added to the system in the double jet process.

The addition speed was accelerated so that the flow rate at the end of the addition was 8 times that at the beginning of the addition. Thereafter, 0.37 g of potassium iodide was added to the system. (Average grain size: 0.65 μm; average grain diameter/thickness ratio: 6.5).

After rinsing, gelatin in an amount of 50 g per 150 g of $AgNO_3$ was added to the system. The pH of the system was adjusted to 6.4 to obtain an unripened emulsion E-1.

The unripened emulsion E-1 thus obtained was dissolved at a temperature of 54° C. Dye (II) was then added to the emulsion in an amount of 87 mg per 100 g of $AgNO_3$. Dye (I) was then added to the emulsion in an amount of 350 mg per 100 g of $AgNO_3$. The emulsion was then vigorously stirred. The emulsion was then chemically sensitized with a sulfur compound as described in U.S. Pat. No. 1,574,944 and potassium chloroaurate.

Dye (I)

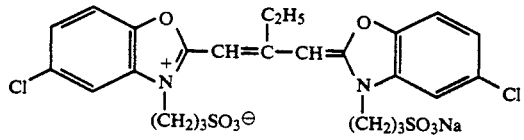

Dye (II)

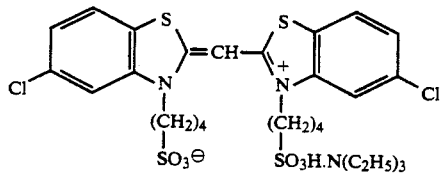

4-Hydroxy-6-methyl-1,3,3a,7-tetraazaindene as a fog inhibitor and a coating aid was added to the emulsion thus obtained to obtain a coating solution for emulsion layer.

A gelatin solution containing a bis type polyethylene oxide, a coating aid made of a fluorocarbon surface active agent and an anionic surface active agent, a polymethyl methacrylate matting agent (average grain diameter: 2.0 μm), a polysiloxane lubricant, and a film hardener (N,N'-methylene-bis-[β-(vinylsulfonyl)-propionamide) was prepared as a protective layer.

The emulsion layer and the protective layer were simultaneously coated onto a PET support (backing side) comprising an antihalation layer on the opposite side in an amount of 3.0 g/m² calculated in terms of silver.

The antihalation layer on the backing side of the support comprised a backing layer containing dyes, a compound for reducing residual color (as set forth in Table 15) and gelatin and a protective layer containing a matting agent, a surface active agent and gelatin.

Three dyes having the following structural formulae were incorporated in the antihalation layer. These Dyes 1, 2 and 3 were coated in proportions of 74 mg/m², 123 mg/m² and 35 mg/m², respectively.

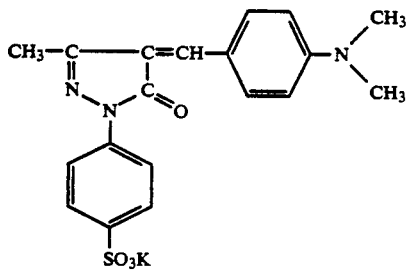

Dye 1

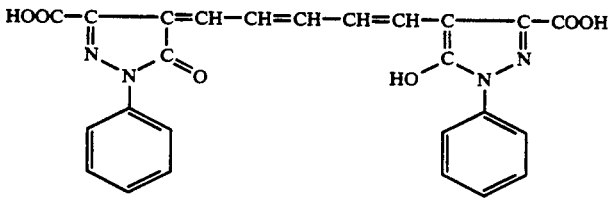

Dye 2

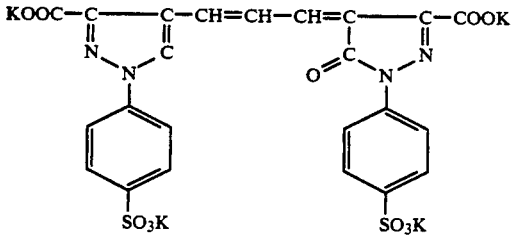

Dye 3

The coated amount of gelatin on the antihalation side of the support was adjusted to 3.9 g/m$^2$.

A gelatin solution containing a polyethylene oxide, a coating aid made of a fluorocarbon surface active agent and an anionic surface active agent, a polymethyl methacrylate matting agent (average grain diameter: 3.5 μm), a polysiloxane lubricant, and a film hardener (N,N'-methylene-bis-[β-(vinylsulfonyl)propion-amide) was prepared for protective layer. The coated amount of gelatin in the protective layer was adjusted at 1.24 g/m$^2$.

These samples were exposed to light, and then developed. The development was effected using a commercial automatic processor (Fuji FPM9000, available from Fuji Photo Film, Co., Ltd.) with a developer (Fuji RD-7, available from the same company) and a fixing solution (Fuji F, available from the same company). These samples were then rinsed, and dried. The conditions for development were as follows:

| | |
|---|---|
| Development: | 35° C., 15.8 seconds (including times for insertion and transfer) |
| Fixing: | 33° C., 8.2 seconds (including time for transfer) |
| Rinse: | 25° C., 7.2 seconds (including time for transfer) |
| Squeeze: | 40° C., 5.7 seconds |
| Drying: | 45° C., 8.1 seconds |
| Total: | 45 seconds |

The replenishment rate for both the developer and the fixing solution were each 25 ml per quarter.

Running processing was effected at a rate of 100 sheets a day for 2 months. The processing solution which had thus been used for 2 months was used to process a light-sensitive material. The residual color of the light-sensitive material thus processed was then examined. The results are set forth in Table 11.

TABLE 11

| Sample No. | Compound Added to Antihalation Layer | Residual Color after Processing |
|---|---|---|
| 1501 | — | 0.220 |
| 1502 | I-(11) (1 g/m$^2$) | 0.160 |

As shown in Table 11, the present invention enables a marked reduction in residual color caused by sensitizing dyes.

EXAMPLE 16

A development processing kit (concentrated solution comprising Part (A), Part (B) and Part (C) was prepared.

| | |
|---|---|
| Part (A) (to be diluted to 10 l of developer) | |
| Potassium Hydroxide | 291 g |
| Potassium Sulfite | 442 g |
| Sodium Hydrogencarbonate | 75 g |
| Boric Acid | 10 g |
| Diethylene Glycol | 120 g |
| Ethylenediaminetetraacetic Acid | 17 g |
| 5-Methylbenzotriazole | 0.6 g |
| Hydroquinone | 300 g |
| 1-Phenyl-4,4-dimethyl-3-pyrazolidone | 20 g |
| Water to make | 2.5 l |
| pH | 11.0 |
| Part (B) (to be diluted to 10 l of developer) | |
| Triethylene Glycol | 20 g |
| 5-Nitroindazole | 2.5 g |
| Acetic Acid (glacial) | 3 g |
| 1-Phenyl-3-pyrazolidone | 15 g |
| Water to make | 250 ml |
| Part (C) (to be diluted to 10 l of developer) | |
| Glutaraldehyde | 99 g |
| Sodium Metabisulfite | 126 g |
| Water to make | 250 ml |

-continued

A starter having the following composition was prepared.

| Starter | |
|---|---|
| Acetic Acid (glacial) | 270 g |
| Potassium Bromide | 300 g |
| Water to make | 1.5 l |

Preparation of Developer 2.5 l of Part (A), 250 ml of Part (B) and 250 ml of Part (C) were sequentially added to and dissolved in about 6 l of water with stirring. Water was added to the solution to make 10 l.

The starter was then added to the solution in an amount of 20 ml per l of the solution.

A solution obtained by adding a compound used in the present invention (set forth in Table 16) to Fuji F (available from Fuji Photo Film Co., Ltd.) was used as a fixing solution.

Water containing 0.5 g/l of disodium ethylenediaminetetraacetate dihydrate (antifungal agent) was used as a rinse solution.

A photographic material (unexposed) as prepared in Example 1 was then subjected to the following development in a roller conveyor type automatic processor system.

| Processing Stage | Temperature | Processing Time |
|---|---|---|
| Development | 35° C. | 12.5 sec. |
| Fixing | 30° C. | 10 sec. |
| Rinse and Squeeze | 20° C. | 12.5 sec. |
| Drying | 50° C. | 12.5 sec. |

The residual color (transmitted optical density in the non-image portion) after processing is set forth in Table 12.

TABLE 12

| Compound Added to Fixing Solution | Amount Added (g/l) | Residual Color after Processing (Transmitted Optical Density) |
|---|---|---|
| (Control) | — | 0.209 |
| (a) (Comparative Example) | 7.9 | 0.208 |
| (b) (Comparative Example) | 1.7 | 0.167 |
| (c) (Comparative Example) | 1.6 | 0.159 |
| III-(1) (Present Invention) | 1.7 | 0.141 |
| III-(3) (Present Invention) | 1.8 | 0.142 |
| III-(6) (Present Invention) | 1.6 | 0.140 |

TABLE 12-continued

| Compound Added to Fixing Solution | Amount Added (g/l) | Residual Color after Processing (Transmitted Optical Density) |
|---|---|---|
| III-(9) (Present Invention) | 1.8 | 0.148 |

(a)

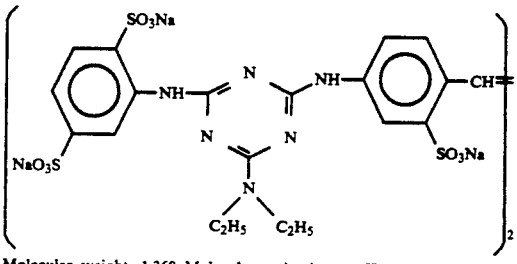

Molecular weight: 1,369 Molecular extinction coefficient (624 nm) of aqueous solution obtained according to the process specified in Condition 1:0

(b)

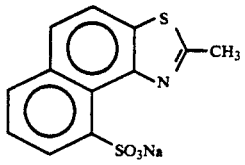

Molecular weight: 298 Molecular extinction coefficient (624 nm) of aqueous solution obtained according to the process specified in Conditon 1:0

(c)

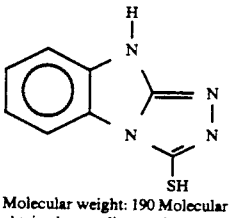

Molecular weight: 190 Molecular extinction coefficient (624 nm) of aqueous solution obtained according to the process specified in Condition 1:2.0 × $10^2$ As shown in Table 12, whenever a photographic material is processed with a fixing solution comprising a compound used in the present invention, less residual color after processing occurs.

EXAMPLE 17

A photographic material was exposed to X-ray in the same manner as in Example 1, and then subjected to development with the same developer, fixing solution and rinse solution as used in Example 16.

For evaluation of residual color after processing, the transmitted optical density of the non-image portion of the photographic material was measured using green light. The results obtained are set forth in Table 13.

TABLE 13

| Compound Added to Fixing Solution | Added Amount (g/l) | Residual Color after Processing (Transmitted Optical Density) |
|---|---|---|
| (Control) | — | 0.209 |
| (a) (Comparative Example) | 7.9 | 0.207 |
| (b) (Comparative Example) | 1.7 | 0.165 |
| (c) (Comparative Example) | 1.6 | 0.159 |
| III-(1) (Present Invention) | 1.7 | 0.140 |
| III-(3) (Present Invention) | 1.8 | 0.143 |
| III-(6) (Present Invention) | 1.6 | 0.138 |
| III-(9) (Present Invention) | 1.8 | 0.147 |

As shown by the results in Table 13, when a photographic material is processed with a fixing solution comprising a compound as used in the present invention, less residual color after processing occurs.

EXAMPLE 18

Photographic materials 1801 and 1807 were prepared using the following sensitizing dyes in the same manner as in Example 16, and then subjected to development in an automatic processor in the same manner as in Example 16.

TABLE 14

| Sample No. | Sensitizing Dye (Amount Added Ag/mol Ag) | Compound Added to Fixing Solution | (Residual Color Density When a Compound of the Invention Was Not Used)-(Residual Color Density When a Compound of the Invention Was Used) |
|---|---|---|---|
| 1801 | A (500) | III-(1) | 0.072 |
| 1802 | B (500) | III-(5) | 0.068 |
| 1803 | C (400) | III-(5) | 0.069 |
| 1804 | D (500) | III-(1) | 0.074 |
| 1805 | E (500) | III-(5) | 0.068 |
| 1806 | F (500) | III-(5) | 0.068 |
| 1807 | G (500) | III-(6) | 0.075 |

In all cases, when a photographic material was processed with a fixing solution containing a compound as used in the present invention, less residual color occurs. (Note: Sensitizing Dyes A to G are as defined in Example 3).

EXAMPLE 19

A photographic material was prepared in the same manner as in Example 4, exposed to light, and then subjected to development and fixing with a developer and a fixing solution as used in Example 4 in the same manner as in Example 4.

The same aqueous solution as used in Example 16 was used as a rinse solution. The replenishment rate was 250 ml per full-size (20 inch×24 inch) sheet. The same sample was similarly developed, and then fixed with a solution obtained by adding 1.6 g/l of Compound III-(6) to GR-F1.

The residual color after processing was measured in the same manner as in Example 16.

The results show that when a photographic material was processed with a fixing solution comprising a compound as used in the present invention, a small residual color of 0.058 occurs.

EXAMPLE 20

The same procedures as effected in Example 5 were repeated except that the developer did not comprise a compound as used in the present invention and the fixing solution comprised 1.7 g/l of Compound III-(1).

The sample thus processed exhibited excellent photographic properties (Dmax, sensitivity) and less residual color (red sensitivity: 0.045).

EXAMPLE 21

A double jet process was conducted at a temperature of 60° C. with the pAg and pH values of the system controlled to 8 and 2.0, respectively, to obtain a monodisperse emulsion of cubic silver bromoiodide having an average grain diameter of 0.20 μm and containing a silver iodide content of 2.0 mol %. A part of the emulsion was used as core on which the following growth was effected. More specifically, an ammonia solution of silver nitrate and a solution containing potassium iodide and potassium bromide were added to a solution containing these core grains and gelatin at a temperature of 40° C. with the pAg and pH of the system controlled to 9.0, respectively, in a double jet process to form a first coat layer containing 30 mol % of silver iodide. Furthermore, an ammonia solution of silver nitrate and a potassium bromide solution were added to the system with the pAg and pH of the system controlled to 9.0, respectively, in a double jet process to form a second coat layer of pure silver bromide. Thus, a monodisperse emulsion of cubic silver bromoiodide grains having an average diameter of 0.57 μm was prepared (E-1). The emulsion had an average silver iodide content of 2.0 mol %.

To the Emulsion (E-1) were added the following sensitizing dyes A and B in the following amounts. The emulsion was then subjected to optimum gold-sulfur sensitization with $8\times10^{-7}$ mol of a chloroaurate, $7\times10^{-6}$ mol of sodium thiosulfate, and $7\times10^{-4}$ mol of ammonium thiocyanate. The emulsion thus sensitized was stabilized with $2\times10^{-2}$ mol of 4-hydroxy-6-methyl-1,3,3a,7-tetraazaindene. The gelatin concentration of the emulsion was adjusted so that the amount of gelatin per side was 2.25 g/m².

Sensitizing Dye A

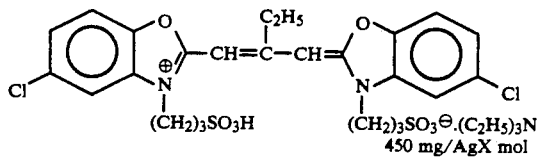

450 mg/AgX mol

Sensitizing Dye B

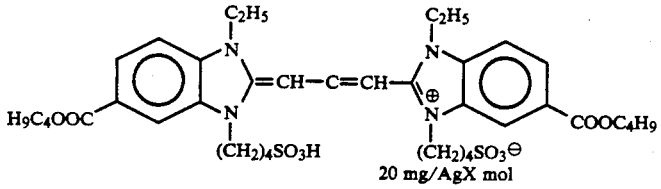

20 mg/AgX mol

The following additives were added to the emulsion and the protective film solution. The following film hardener was then added so that the melting time was 20 minutes.

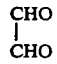

More specifically, $2\times10^{-4}$ mol of the compound as used in the present invention (set forth in Table 21), 400 ml of t-butyl-catechol, 1.0 g of polyvinylpyrrolidone (molecular weight: 10,000, 2.5 g of a styrene-maleic anhydride copolymer, 10 g of trimethylol propane, 5 g of diethylene glycol, 50 mg of nitrophenol-triphenylphosphonium chloride, 4 g of ammonium 1,3-dihydroxybenzene-4-sulfonate, 15 mg of sodium 2-mercaptobenzimidazole-5-sulfonate, 7 mg of

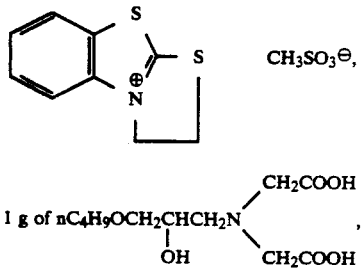

1 g of $nC_4H_9OCH_2CHCH_2N(CH_2COOH)_2$, OH 10 mg of 1,1-dimethylol-1-bromo-1-nitromethane and were used as additives for the emulsion layer.

The above emulsion, the film hardener and the additives as described subsequently were added to the system so that the melting time was 20 minutes. Thus, a protective layer having a gelatin content of 1.15 g/m$^2$ per side was prepared. The above emulsion and the protective layer thus prepared were simultaneously coated in a multi-layer structure onto both sides of a subbed polyester film support at a coating rate of 50 m/min. in such a manner that the silver halide emulsion layer (viscosity: 11 cP; surface tension: 35 dnn/cm; coat film thickness: 50 μm) and the protective layer (viscosity: 11 cP; surface tension; 25 dyn/cm; coat film thickness: 20 μm) were sequentially coated on the support to obtain a photographic material, Sample 2101. The photographic material had a silver content of 45 mg/cm$^2$.

The following compounds were used as additives for the protective layer.

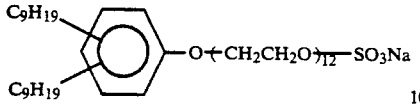

10 mg/g of gelatin

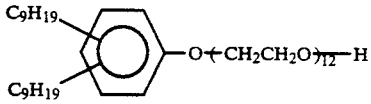

2 mg/g of gelatin

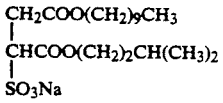

7 mg/g of gelatin

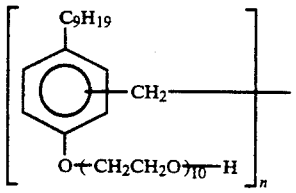

15 mg
(n: mixture of 2 to 5)

7 mg of a matting agent comprising polymethyl methacrylate grains having an average diameter of 5 μm and 7 mg of colloidal silica having an average grain diameter of 0.013 μm were added to the system.

The film hardener content of each layer was adjusted so that the melting time thereof was 20 minutes as determined by the following method.

Specifically, the melting time is defined as the time between when a 1 cm×2 cm piece of the sample is immersed in a 1.5% sodium hydroxide solution kept at a temperature of 50° C. and when the emulsion layer begins to be eluted.

Furthermore, sensitivity and fog were measured in the following manner. Specifically, the sample was clamped by two sheets of optical wedges having a mirror-symmetrical arrangement of density gradient, and exposed to light from a light source with a color temperature of 5,400° K. from both sides thereof at the same exposure level for 1/12.5 seconds.

Development was effected in accordance with the following steps using a roller conveyor type automatic processor which requires a total processing time of 45 seconds.

| | Processing Temperature | Processing Time |
|---|---|---|
| Insertion | — | 1.2 sec |
| Development + transfer | 35° C. | 14.6 sec. |
| Fixing + transfer | 33° C. | 8.2 sec. |
| Rinse + transfer | 25° C. | 7.2 sec. |
| Squeeze | 40° C. | 5.7 sec. |
| Drying | 45° C. | 8.1 sec. |
| Total | | 45.0 sec. |

The automatic processor used in this example had the following characteristics:

In particular, a rubber roller was used. The rubber roller in the transfer portion was made of silicone rubber (hardness: 48), and that in the processing solution was made of EPDM (hardness: 46), an ethylene propylene rubbers. The rubber roller had a maximum surface roughness Dmax of 4 μm. The development portion was equipped with 6 such rubber rollers. There were 84 such rubber rollers in total of these rollers, 51 were facing rollers. The ratio of number of facing rollers to the total number of rollers was 51/84 (=0.61). The developer replenishment rate was 20 cc/quarter. The fixing solution replenishment rate was 45 cc/quarter. The amount of washing water used was 1.5 l/min. The air flow in the drying portion was 11 m$^2$/min. The heater capacity was 3 KW (200 V).

The total processing time was 45 seconds as mentioned above.

The following Developer-1 and Fixing Solution-1 were used respectively as developer and fixing solution.

The exposure at base density+fog density+1.0 was determined from the resulting characteristic curve. Thus, the relative sensitivity was determined.

Composition of Developer and Fixing Solution

| Developer-1: | |
|---|---|
| Potassium Sulfite | 65.0 g |
| Hydroquinone | 25.0 g |
| 1-Phenyl-3-pyrazolidone | 2.5 g |
| Boric Acid | 10.0 g |
| Sodium Hydroxide | 21.0 g |
| Triethylene Glycol | 17.5 g |
| 6-Methylbenzotriazole | 0.06 g |
| 5-Nitroindazole | 0.14 g |
| Glutaraldehyde Bisulfite | 15.0 g |
| Acetic Acid (glacial) | 16.0 g |
| Potassium Bromide | 4.0 g |

-continued

| | |
|---|---|
| Triethylenetetraminehexaacetic Acid | 2.5 g |
| Water to make | 1 l |
| Fixing Solution-1: | |
| Ammonium Thiosulfate | 130.9 g |
| Sodium Sulfite (anhydrous) | 7.3 g |
| Boric Acid | 7.0 g |
| Acetic Acid (90 wt % aq. soln.) | 5.5 g |
| Sodium Acetate Trihydrate | 25.8 g |
| Aluminum Sulfate (octadecahydrate | 14.6 g |
| Sulfuric Acid (50 wt % aq. soln.) | 6.77 g |

The residual coloration was then evaluated. The transmitted optical density was measured in the non-image area using green light The photographic sensitivity was also determined for each of the samples when using a conventional 90-second processing by halving the line speed in the 45-second automatic processor described above. The results obtained are set forth in Table 15.

As shown in Table 15, the samples according to the present invention have outstanding sensitivity, fogging, residual coloring characteristics and the like, and it can be seen that they are suitable for ultra-rapid processing.

Further, in comparison with a conventional 90-second processing, it can be seen that it is possible to reduce the residual color and to halve the processing time while maintaining a high photographic sensitivity as compared with a conventional system. Thus, processing performance can be doubled.

TABLE 16

| Compound Added to Fixing Solution | Residual Color after Processing (Transmitted Optical Density) |
|---|---|
| (Control) | 0.211 |
| (a) (Comparative Example) | 0.209 |
| (b) (Comparative Example) | 0.200 |
| (c) (Comparative Example) | 0.158 |
| III-(1) (Invention) | 0.142 |
| III-(3) (Invention) | 0.144 |
| III-(4) (Invention) | 0.148 |
| III-(6) (Invention) | 0.141 |
| III-(9) (Invention) | 0.143 |

EXAMPLE 23

The same photographic material as used in Example 8 was exposed to light in the same manner as in Example 8. The photographic material thus exposed was then developed with a developer having the following composition at a temperature of 20° C. for 3 minutes, stopped, fixed with the following fixing solution, and rinsed.

The residual coloration after processing (transmitted optical density in the non-image portion) is set forth in Table 17.

| Developer | |
|---|---|
| Water | 500 ml |
| N-methyl-p-aminophenol | 2.2 g |
| Sodium Sulfite (anhydrous) | 96.0 g |
| Hydroquinone | 8.8 g |
| Sodium Carbonate (monohydrate) | 56.0 g |
| Potassium Bromide | 5.0 g |
| Compound III-(6) | 1.7 g |
| Water to make | 1 l |

TABLE 15

| Sample No. | Compound Added | Bath to which Compound was Added: Development Bath | Bath to which Compound was Added: Fixing Bath | Added Amount (g/l) | 90-sec Processing: Sensitivity | 90-sec Processing: Residual Color after Processing (Transmitted Optical Density) | 45-sec Processing: Sensitivity | 45-sec Processing: Fog | 45-sec Processing: Residual Color after Processing (Transmitted Optical Density) |
|---|---|---|---|---|---|---|---|---|---|
| 2101 | (Comparative)- | — | — | — | 100 | 0.186 | 94 | 0.04 | 0.211 |
| 2102 | (Comparative) (a) | — | ○ | 7.9 | 100 | 0.184 | 85 | 0.03 | 0.207 |
| 2103 | (Comparative) (b) | | ○ | 0.6 | 95 | 0.152 | 95 | 0.03 | 0.188 |
| 2104 | (Comparative) (c) | | ○ | 1.6 | 99 | 0.148 | 95 | 0.02 | 0.167 |
| 2105 | (Invention) III-(1) | | ○ | 1.7 | 100 | 0.145 | 100 | 0.04 | 0.152 |
| 2106 | (Invention) III-(3) | | ○ | 1.8 | 100 | 0.144 | 100 | 0.03 | 0.151 |
| 2107 | (Invention) III-(6) | | ○ | 1.6 | 100 | 0.142 | 100 | 0.02 | 0.149 |
| 2108 | (Invention) III-(9) | | ○ | 2.0 | 95 | 0.145 | 95 | 0.02 | 0.151 |
| 2109 | (Comparative) (a) | ○ | — | 7.9 | 95 | 0.184 | 90 | 0.02 | 0.210 |
| 2110 | (Comparative) (b) | ○ | ○ | 0.6 (for both baths) | 95 | 0.155 | 90 | 0.02 | 0.184 |
| 2111 | (Comparative) (c) | ○ | — | 1.6 | 95 | 0.155 | 95 | 0.03 | 0.160 |
| 2112 | (Invention) III-(1) | ○ | — | 1.7 | 95 | 0.147 | 90 | 0.02 | 0.144 |
| 2113 | (Invention) III (1) | ○ | ○ | 1.7 (for both baths) | 95 | 0.143 | 90 | 0.02 | 0.142 |
| 2114 | (Invention) III-(3) | ○ | — | 1.8 | 95 | 0.142 | 90 | 0.03 | 0.141 |
| 2115 | (Invention) III-(3) | ○ | ○ | 1.8 (for both baths) | 95 | 0.140 | 90 | 0.02 | 0.140 |
| 2116 | (Invention) III-(6) | ○ | — | 1.6 | 100 | 0.141 | 95 | 0.02 | 0.139 |
| 2117 | (Invention) III-(6) | ○ | ○ | 1.6 (for both baths) | 100 | 0.140 | 90 | 0.01 | 0.138 |
| 2118 | (Invention) III-(9) | ○ | — | 2.0 | 95 | 0.143 | 95 | 0.02 | 0.145 |
| 2119 | (Invention) III-(9) | ○ | ○ | 2.0 (for both baths) | 95 | 0.142 | 90 | 0.02 | 0.143 |

EXAMPLE 22

A photographic material was processed in the same manner as in Example 7 except that the compounds to be added to the fixing solution were altered as set forth in Table 16 below.

Fixing Solution LF308 (available from Fuji Photo Film Co., Ltd.)

TABLE 17

| Sample No. | Compound Added to Developer | [Residual Color Density When a Compound of the Invention is not Used] − [Residual Color Density When a Compound of the Invention is Used] |
|---|---|---|
| 2301 | III-(1) | 0.062 |
| 2302 | III-(3) | 0.063 |
| 2303 | III-(6) | 0.065 |

In all cases, when the photographic material was processed with the developer comprising a compound as used in the present invention, less residual coloration

EXAMPLE 24

A photographic material was processed in the same manner as in Example 9 except that the compounds to be added to the fixing solution were altered as set forth in Table 18. The results obtained are set forth in Table 18 below.

TABLE 18

| Sample No. | Sensitizing Dye | Compound Added to Fixing Solution | [Residual Color Density When a Compound of the Invention is not Used] − [Residual Color Density When a Compound of the Invention is Used] |
|---|---|---|---|
| 2401 | A | III-(1) | 0.048 |
| 2402 | B | III-(1) | 0.050 |
| 2403 | C | III-(3) | 0.050 |
| 2404 | A | III-(3) | 0.047 |
| 2405 | B | III-(9) | 0.045 |
| 2406 | C | III-(9) | 0.044 |

In all cases, when the photographic material was processed with a developer containing a compound as used in the present invention, less residual coloration occurs.

EXAMPLE 25

Preparation of Emulsion

The double jet method was used for 1 minute, with stirring, to add an aqueous solution of silver nitrate (5 g as silver nitrate) and an aqueous solution of potassium bromide containing 0.15 g of potassium iodide to a vessel in which 30 g of gelatin and 6 g of potassium bromide had been added to 1 l of water and which was maintained at 60° C. In addition, the double jet method was used to add an aqueous solution of silver nitrate (145 g as silver nitrate) and an aqueous solution of potassium bromide containing 4.2 g of potassium iodide. The addition flow rate was accelerated so that the flow rate at the end of addition was 5 times that at the start of addition. At the end of the addition, the soluble salts were removed by precipitation at 35° C. and then the temperature was raised to 40° C., 75 g of gelatin were added and the pH was adjusted to 6.7. The resulting emulsion comprised tabular grains with a projected surface area diameter of 0.98 μm and an average thickness of 0.138 μm and had a silver iodide content of mol %. The emulsion was chemically sensitized by the combined use of gold and sulfur sensitization.

Preparation of Photographic Material

An aqueous gelatin solution containing sodium polystyrenesulfonate, fine polymethyl methacrylate grains (average grain size: 3.0 μm), polyethylene oxide, 200 ml/mol Ag of a $10^{-3}$ mol methanol solution of the compound as used in the present invention (set forth in Table 19), and a film hardener as well as gelatin acting as a surface protective layer. Anhydro-5,5'-dichloro-9-ethyl-3,3'-di(3-sulfopropyl)oxacarbocyanine hydroxide sodium salt, as a sensitizing dye, was added to the above emulsion in a proportion of 500 ml/mol of Ag and potassium iodide was added in a proportion of 200 mg/mol of Ag. Furthermore, a photographic material was produced by preparing a coating solution by adding 4-hydroxy-6-methyl-1,3,3a,7-tetraazaindene and 2,6-bis(hydroxyamino)-4-diethylamino-1,3,5-triazine, trimethylol propane as a dry antifoggant and adding coating aids and film hardeners, coating the material onto both sides of a polyethylene terephthalate support simultaneously with the respective surface protective layers and drying the material. The coated silver amount in this photographic material was 3.7 g/m² on each side.

Processing Method

The developer and the fixing solution (1) used had the following compositions:

| | |
|---|---|
| Developer | |
| Diethylenetriaminepentaaceic Acid | 2 g |
| 1-Phenyl-3-pyrazolidone | 2 g |
| Hydroquinone | 30 g |
| 5-Nitroindazole | 0.25 g |
| 5-Methylbenzotriazole | 0.02 g |
| Potassium Bromide | 1 g |
| Sodium Sulfite (anhydrous) | 60 g |
| Potassium Hydroxide | 30 g |
| Potassium Carbonate | 5 g |
| Boric Acid | 6 g |
| Diethylene Glycol | 20 g |
| Glutaraldehyde | 5 g |
| Water to make | 1 l |
| pH | 10.50 |
| Fixing Solution (I) | |
| Ammonium Thiosulfate | 175 g |
| Sodium Sulfite (anhydrous) | 20.0 g |
| Boric Acid | 8.0 g |
| Disodium ethylenediaminetetraacetate dihydrate | 0.1 g |
| Aluminum Sulfate | 15.0 g |
| Sulfuric Acid | 2.0 g |
| Acetic Acid (glacial) | 22.0 g |
| Compound III-(6) | 1.7 g |
| Water to make | 1.0 l |
| pH | 4.20 |

Processing

| | Temperature | Time | Amount of Tank Solution | Replenishment Rate |
|---|---|---|---|---|
| Development | 35° C. | 13.7 sec. | 16.5 l | 25 ml/quarter size (10 inch × 12 inch) |
| Fixing | 30° C. | 10.6 sec. | 13 l | 60 ml or 30 ml |
| Rinse | Tap water (10° C.) (running water) | 6.2 sec. | 12 l | 5 l/min. |
| Squeeze | | 4.9 sec. | | |
| Drying | (55° C.) | 10.2 sec. | | |

A solution obtained by adding to 1 l of the above-mentioned replenisher 20 ml of an aqueous solution (starter) containing 2 g of potassium bromide and 4 g of acetic acid (90%) was used as a developer in the tank in the automatic processor. Thereafter, every time the photographic material was processed, the replenisher was supplied at a predetermined rate. A solution having the same composition as that of the replenisher was used as a fixing solution.

The above-mentioned photographic material samples were each processed in an amount of 500 quarter sheets under the following conditions. The residual coloration caused by sensitizing dyes in the processing solution (on the 500th sheet) was as follows:

TABLE 19

| Compound Added to Fixing Solution | Upon Replenishment with 60 ml of Fixing Solution per Quarter Sheet | | Upon Replenishment with 30 ml of Fixing solution per Quarter Sheet | |
|---|---|---|---|---|
| | Amount of I-ions in the Fixing Solution | Residual Color | Amount of I-ions in the Fixing Solution | Residual Color |
| Control | 0.93 mmol/l | Slightly pink residual color | 1.87 mmol/l | Much pink residual color, cannot be used for diagnosis |
| III-(6) | 0.92 mmol/l | Absolutely no problem | 1.91 mmol/l | Absolutely no problem |

EXAMPLE 26

The same procedures as described in Example 11 were repeated except that the bleaching solution did not comprise a compound as used in the present invention and the blix solution comprised the compound as set forth in Table 20.

TABLE 20

| No. | Sample No. | Additive* to Blix Solution | Change in Magenta Density due to Running | Change in Magenta Density after 1 Week at 60° C.-70% RH |
|---|---|---|---|---|
| Comp. Ex. 1 | 1101 | None | +0.07 | +0.13 |
| Comp. Ex. 2 | 1102 | " | +0.06 | +0.11 |
| Comp. Ex. 3 | 1103 | " | +0.06 | +0.10 |
| Invention 4 | 1101 | III-(1) | +0.01 | +0.01 |
| Invention 5 | 1102 | III-(2) | +0.01 | +0.01 |
| Invention 6 | 1103 | III-(3) | +0.01 | +0.01 |
| Invention 7 | 1101 | III-(4) | +0.02 | +0.01 |
| Invention 8 | 1102 | III-(5) | +0.02 | +0.01 |
| Invention 9 | 1103 | III-(6) | ±0 | ±0 |
| Invention 10 | 1101 | III-(7) | +0.04 | +0.02 |
| Invention 11 | 1102 | III-(8) | +0.02 | +0.01 |
| Invention 12 | 1103 | III-(9) | +0.01 | +0.01 |

*Added amount: 2 g/l

As shown in Table 20, it is possible to control the increase in the magenta density in the non-exposed area caused by running at a level at which there is n practical impairment. Further, the increase in the magenta density in the unexposed portion when stored at an elevated temperature or at a high humidity can also be controlled at the same time. It is also obvious that the above effects are improved by reducing the thickness of the photographic structural layers and accelerating the swelling rate $T_{\frac{1}{2}}$.

EXAMPLE 27

The same procedures as conducted in Example 12 was repeated except that the compounds as used in the present invention to be added to the fixing solution were altered as set forth in Table 21.

TABLE 21

| No. | Sample | Compound Added to Blix Solution | Change in Magenta Density due to Running | Change in Magenta Density after 1 Week at 60° C.-70% RH |
|---|---|---|---|---|
| Comp. Ex. 1 | 1201 | None | +0.08 | +0.14 |
| Comp. Ex. 2 | 1202 | " | +0.07 | +0.12 |
| Comp. Ex. 3 | 1203 | " | +0.06 | +0.09 |
| Invention 4 | 1201 | III-(1) | +0.02 | +0.03 |
| Invention 5 | 1202 | III-(2) | +0.01 | +0.02 |
| Invention 6 | 1203 | III-(3) | +0.01 | +0.02 |
| Invention 7 | 1201 | III-(4) | +0.01 | +0.03 |
| Invention 8 | 1202 | III-(5) | +0.01 | +0.02 |
| Invention 9 | 1203 | III-(6) | +0.01 | +0.02 |
| Invention 10 | 1201 | III-(7) | +0.03 | +0.05 |
| Invention 11 | 1202 | III-(8) | +0.01 | +0.02 |
| Invention 12 | 1203 | III-(9) | +0.01 | +0.02 |

As in Example 26, the present invention inhibits the increase in the magenta density of the unexposed areas and is effective in inhibiting the increase in the cyan density in the unexposed areas during storage at an elevated temperature and a high humidity.

EXAMPLE 28

The same procedures as described in Example 13 were repeated except that the compounds as used in the present invention to be incorporated in the blix solution were replaced by III-(6) in an amount of 1.7 g/l.

Upon processing the photographic material containing a compound as used in the present invention obtained as described above, the reflected density based on the residual color from the sensitizing dye in the unexposed area was markedly improved and was lower than a photographic material which did not contain a compound as used in the present invention by 0.055.

EXAMPLE 29

The same procedures as described in Example 14 were repeated except that the compound as used in the present invention as set forth in Table 22 was incorporated in the photographic material in an amount of $2\times10^{-3}$ mol/mol Ag and the fixing solution did not comprise a compound as used in the present invention.

TABLE 22

| Sample No. | Compound Added | Residual Color after Processing |
|---|---|---|
| 2901 | None | 0.125 |
| 2902 | III-(1) | 0.048 |
| 2903 | III-(3) | 0.065 |
| 2904 | III-(6) | 0.045 |
| 2905 | III-(8) | 0.068 |
| 2906 | III-(10) | 0.071 |

Whenever the compound as used in the present invention is incorporated in the photographic material, remarkably little residual color occurs.

EXAMPLE 30

30 g of gelatin, 5 g of potassium bromide, and 0.05 g of potassium iodide were added to 1 l of water and kept at a temperature of 75° C. An aqueous solution of silver nitrate (containing 5 g of silver nitrate) and an aqueous solution containing 0.75 g of potassium iodide were added to the system for 1 minute in the double jet process with stirring. Furthermore, an aqueous solution of silver nitrate and an aqueous solution of potassium bromide were added to the system in the double jet process.

The addition speed was accelerated so that the flow rate at the end of the addition was 8 times that at the beginning of the addition. Thereafter, 0.37 g of potassium iodide was added to the system. (Average grain size: 0.65 μm; average grain diameter/thickness ratio: 6.5)

After rinsing, gelatin in an amount of 50 g per 150 g of $AgNO_3$ was added to the system. The pH of the system was adjusted to 6.4 to obtain an unripened emulsion.

The unripened emulsion thus obtained was dissolved at a temperature of 54° C. Dye (II) was then added to the emulsion in an amount of 87 mg per 100 g of $AgNO_3$. Dye (I) was then added to the emulsion in an amount of 350 mg per 100 g of $AgNO_3$. The emulsion was then vigorously stirred. The emulsion was then chemically sensitized with a sulfur compound as described in U.S. Pat. No. 1,574,944 and potassium chloroaurate.

Dye (I)

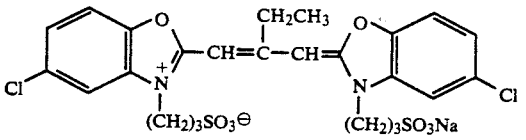

Dye (II)

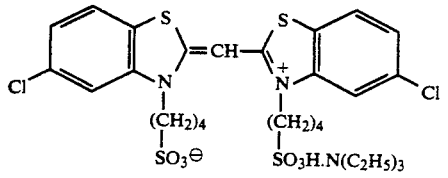

4-Hydroxy-6-methyl-1,3,3a,7-tetraazaindene as a fog inhibitor and a coating aid were added to the emulsion thus obtained to obtain a coating solution for an emulsion layer.

A gelatin solution containing a bis type polyethylene oxide, a coating aid comprising a fluorocarbon surface active agent and an anionic surface active agent, a polymethyl methacrylate matting agent (average grain diameter: 2.0 μm), a polysiloxane lubricant, and a film hardener (N,N'-methylene-bis-[β-(vinylsulfonyl)-propionamide) was prepared as a protective layer.

The emulsion layer and the protective layer were simultaneously coated onto a PET support (backing side) comprising an antihalation layer on the side opposite that of the emulsion in an amount of 3.0 g/m² as calculated in terms of silver.

The antihalation layer on the backing side of the support comprised a backing layer containing dyes, a compound for reducing residual color (as set forth in Table 30) and gelatin and a protective layer containing a matting agent, a surface active agent and gelatin.

Three days having the following structural formulae were incorporated in the antihalation layer. Dyes 1, 2 and 3 were coated in proportions of 74 mg/m², 123 mg/m² and 35 mg/m², respectively.

Dye 1

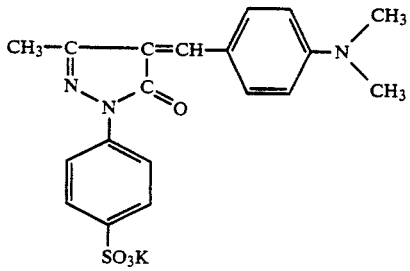

Dye 2

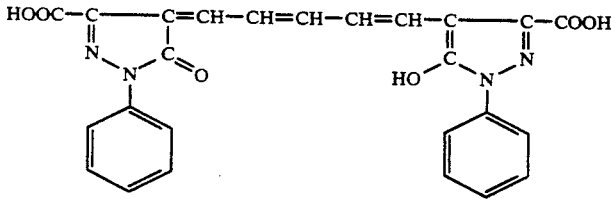

Dye 3

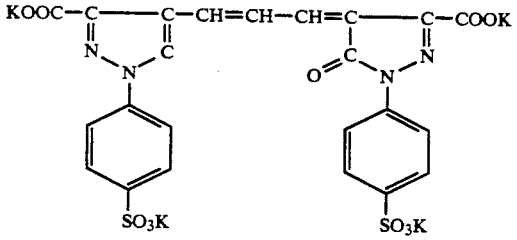

The coated amount of gelatin on the antihalation side of the support was appropriately adjusted at 3.9 g/m².

A gelatin solution containing a polyethylene oxide, a coating aid comprising a fluorocarbon surface active agent and an anionic surface active agent, a polymethyl methacrylate matting agent (average grain diameter: 3.5 μm), a polysiloxane lubricant, and a film hardener (N,N'-methylene-bis-[β-(vinylsulfonyl)propionamide) was prepared for protective layer. The coated amount of gelatin in the protective layer was adjusted to 1.24 g/m².

These samples were exposed to light, and then developed. The development was effected by means of a commercial automatic processor (Fuji FPM9000, available from Fuji Photo Film, Co., Ltd.) with a developer (Fuji RD-7, available from the same company) and a fixing solution (Fuji F, available from the same company). These samples were then rinsed, and dried. The conditions for development were as follows:

| | |
|---|---|
| Development: | 35° C., 15.8 seconds (including times for insertion and transfer) |
| Fixing: | 33° C., 8.2 seconds (including time for transfer) |
| Rinse: | 25° C., 7.2 seconds (including time for transfer) |
| Squeeze: | 40° C., 5.7 seconds |
| Drying: | 45° C., 8.1 seconds |
| Total: | 45 seconds |

The replenishment rate for both the developer and fixing solution were each 25 ml per quarter-sized sheet.

A running processing was effected at a rate of 100 sheets a day for 2 months. The processing solution which had thus been used for 2 months was used to process a light-sensitive material. The residual color of the light-sensitive material thus processed was then examined. The results obtained are set forth in Table 23 below.

TABLE 23

| Specimen No. | Compound Added to Antihalation Layer (added amount: 1 g/m$^2$) | Residual Color after Processing (Transmitted Optical Density) |
|---|---|---|
| 1 (Comparative) | — | 0.220 |
| 2 (Invention) | III-(6) | 0.135 |

As shown in Table 30, the use of the compound as used in the present invention enables a remarkable reduction in residual coloration.

While the invention has been described in detail and with reference to specific embodiments thereof, it will be apparent to one skilled in the art that various changes and modifications can be made therein without departing from the spirit and scope thereof.

What is claimed is:

1. A method for the processing of a silver halide photographic material comprising processing a spectrally sensitized silver halide photographic material with a processing solution containing a compound represented by the general formula (I) or (II) or a salt thereof;

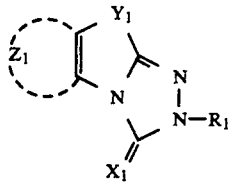

(I)

wherein $Z_1$ represents a nonmetallic atom group required to form an unsaturated ring; $Y_1$ represents an oxygen atom, a sulfur atom or

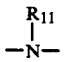

in which $R_{11}$ represents a hydrogen atom, an alkyl group; $R_1$ represents an alkyl group substituted with an amino, dialkylamino or sulfonamido group; and $X_1$ represents an oxygen atom

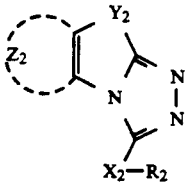

(II)

wherein $Z_2$ represents a nonmetallic atom group required to form an unsaturated ring; $Y_2$ represents an oxygen atom, a sulfur atom or

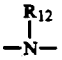

in which $R_{12}$ has the same meaning as $R_{11}$; $R_2$ represents an alkyl group substituted with an amino group, a dialkylamino group or a sulfonamido group; $X_2$ represents an oxygen atom, a methylene group or

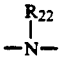

in which $R_{22}$ has the same meaning as $R_{11}$; or a compound represented by the general formula (III):

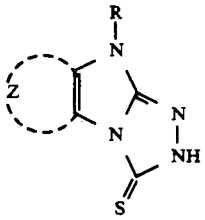

(III)

wherein Z represents a nonmetallic atom group required to form an unsaturated ring; and R represents a hydrogen atom, an alkyl group, a sulfo group, a dialkylamino group, a phosphoryl group, an aryl group, an acyl group, an allyl group or an alkanesulfonyl group, wherein the compound of formula (I), (II) or (III) is present in the processing solution in an amount of from $5\times10^{-5}$ to $10^{-1}$ mol/l.

2. A method for the processing of a silver halide photographic material according to claim 1, the unsaturated ring formed by $Z_1$ or $Z_2$ is a benzene ring, a naphthalene ring or a 5- or 6-membered heterocyclic ring.

3. A method for the processing of a silver halide photographic material according to claim 2, wherein said heterocyclic ring formed by $Z_1$ or $Z_2$ is a pyridine ring, a pyrimidine ring, a pyrazine ring, a furan ring, a thiene ring, a pyrrole ring, a triazine ring, an imidazole ring, a quinazoline ring, a purine ring, a quinoline ring, an acridine ring, an indole ring, a thiazole ring, an oxazole ring, a selenazole ring, a furazalane ring or a heterocyclic ring comprising a benzo or naphtho ring condensed therewith.

4. A method for the processing of a silver halide photographic material according to claim 1, wherein $R_{11}$ and $R_{12}$ is an alkyl group substituted with a dialkylamino group, an unsubstituted alkyl group or an alkoxy group.

5. A method for the processing of a silver halide photographic material according to claim 1, wherein $Y_1$ is a sulfur atom, $X_1$ is an oxygen atom, and $X_2$ is —O— or —NH—.

6. A method for the processing of a silver halide photographic material according to claim 1, wherein the unsaturated ring formed by Z is a benzene ring, a naphthalene ring or a 5- or 6-membered heterocyclic ring.

7. A method for the processing of a silver halide photographic material according to claim 6, wherein said heterocyclic ring formed by Z is a pyridine ring, a pyrimidine ring, a pyrazine ring, a furan ring, a thiene ring, a pyrrole ring, a triazine ring, an imidazole ring, a quinazoline ring, a purine ring, a quinoline ring, an acridine ring, an indole ring, a thiazole ring, an oxazole ring, a selenazole ring, a furazalane ring or a heterocyclic ring comprising a benzo or naphtho ring condensed therewith.

8. A method for the processing of a silver halide photographic material according to claim 1, wherein R represents a substituted or unsubstituted alkyl group.

9. A method for the processing of a silver halide photographic material according to claim 1, wherein the processing solution contains a compound represented by general formula (I) or a salt thereof.

10. A method for the processing of a silver halide photographic material according to claim 1, wherein the processing solution contains a compound represented by general formula (II) or a salt thereof.

11. A method for the processing of a silver halide photographic material according to claim 1, wherein the processing solution contains a compound represented by general formula (III).

* * * * *